US006030737A

United States Patent [19]

Ugai et al.

[11] Patent Number: 6,030,737

[45] Date of Patent: Feb. 29, 2000

[54] NON-MAGNETIC TONER FOR DEVELOPING ELECTROSTATIC IMAGE, PROCESS FOR PRODUCING NON-MAGNETIC TONER PARTICLES, AND IMAGE FORMING METHOD

[75] Inventors: Toshiyuki Ugai, Tokyo; Kenji Okado, Yokohama, both of Japan

[73] Assignee: Canon Kabushiki Kaisha, Tokyo, Japan

[21] Appl. No.: 08/969,064

[22] Filed: Nov. 12, 1997

[30] Foreign Application Priority Data

Nov. 11, 1996 [JP] Japan ..... 8-298385
Nov. 6, 1997 [JP] Japan ..... 9-304105

[51] Int. Cl.[7] ..... G03G 9/09; G03G 9/097

[52] U.S. Cl. ..... 430/106; 430/110; 430/137; 430/45; 430/124; 430/126

[58] Field of Search ..... 430/106, 110, 430/137, 45, 124, 126

[56] References Cited

U.S. PATENT DOCUMENTS

| | | | |
|---|---|---|---|
| 3,634,251 | 1/1972 | Maeda et al. | 252/62.1 |
| 4,623,606 | 11/1986 | Ciccarelli | 430/110 |
| 5,314,773 | 5/1994 | Kubo et al. | 430/106 |

FOREIGN PATENT DOCUMENTS

| | | |
|---|---|---|
| 43-10799 | 5/1968 | Japan . |
| 51-14895 | 5/1976 | Japan . |
| 56-116044 | 9/1981 | Japan . |
| 63-210849 | 9/1988 | Japan . |
| 64-35457 | 2/1989 | Japan . |
| 1-145664 | 6/1989 | Japan . |
| 4-139460 | 5/1992 | Japan . |

OTHER PUBLICATIONS

Chemical Abstracts 118:112970, May 1993.

(List continued on next page.)

*Primary Examiner*—Christopher D. Rodee

*Attorney, Agent, or Firm*—Fitzpatrick, Cella, Harper & Scinto

[57] ABSTRACT

A non-magnetic toner for developing an electrostatic image has non-magnetic toner particles produced by polymerizing in an aqueous medium a polymerizable monomer composition containing at least a polymerizable monomer, a carbon black and an azo type iron compound. The carbon black has a DPB oil absorption of from 110 ml/100 g to 200 ml/100 g, a specific surface area of 100 $m^2/g$ or below as measured by nitrogen adsorption, a volatile component of 2% or less and an average primary particle diameter of from 20 m$\mu$ to 60 m$\mu$, and the azo type iron compound is a compound represented by the following Formula (1).

Formula (1)

64 Claims, 9 Drawing Sheets

OTHER PUBLICATIONS

Diamond, Arthur S. Handbook of Imaging Materials. New York: Marcel–Dekker, Inc., pp. 177, 187, & 188, 1991.

Lee, et al.; "The Glass Transition Temperatures of Polymers", Polymer Handbook, 2nd Ed., Publ. by J. Wiley & Sons, pp. (III–139) –(III–192).

Database WPI, Section Ch, Week 8931, Derwent Publ. AN89–222999, XP–002056158 for JPI–145,664.

Database WPI, Section Ch, Week 9226, Derwent Pub. AN92–212171, XP–002056159 for JP4–139,460.

Database WPI, Section Ch, Week 9531, Derwent Publ., AN95–234563, XP–002056160 fn JP 07–140,707.

NON-MAGNETIC TONER FOR DEVELOPING ELECTROSTATIC IMAGE, PROCESS FOR PRODUCING NON-MAGNETIC TONER PARTICLES, AND IMAGE FORMING METHOD

BACKGROUND OF THE INVENTION

1. Field of the Invention

This invention relates to a non-magnetic toner for developing an electrostatic image, used in electrophotography, and a process for producing non-magnetic toner particles.

2. Related Background Art

Developers used in electrophotographic processes are hitherto commonly produced by a pulverization process comprising melt-kneading a binder resin such as polyester resin, styrene-acrylic resin or epoxy resin and added thereto a colorant, a charge control agent and a release agent, to uniformly disperse them, and thereafter pulverizing the kneaded product into particles with a stated size, further followed by removal of excess fine particles and coarse particles by means of a classifier. However, with a recent trend toward higher image quality, it has become necessary to make toner have much smaller particle diameter.

As toners come to have a weight average particle diameter of 7 $\mu$m or smaller as measured by a Coulter counter, there is a tendency that it becomes very difficult to achieve uniform dispersion of materials used and highly efficient pulverization, which have hitherto not come into question, and also to classify toner particles in a sharp particle size distribution.

In order to overcome such problems on toners produced by pulverization, Japanese Patent Publication No. 36-10231, No. 43-10799 and No. 51-14895 propose a process for producing toner particles by suspension polymerization. The suspension polymerization is a process in which polymerizable monomers, a colorant and a polymerization initiator, optionally together with a cross-linking agent, a charge control agent and other additives are uniformly dissolved or dispersed to form a monomer composition, and thereafter this monomer composition is dispersed in a continuous phase such as an aqueous phase, containing a dispersion stabilizer, by the use of a suitable dispersion machine to simultaneously carry out polymerization reaction to obtain toner particles with the desired particle diameters.

This production process does not have the step of pulverization, and hence it is unnecessary to impart brittleness to toner particles and also it is possible to use a low-softening substance in a large quantity, which has been difficult to use in conventional pulverization processes. Accordingly, materials can be selected over a broader range. The process recently attracts notice because of its characteristic features that release agents and colorants, which are hydrophobic materials, may become exposed to toner particle surfaces with difficulty and hence may less contaminate toner carrying members, photosensitive members, transfer rollers and fixing assemblies.

In addition, in recent years, digital full-color copying machines and printers have been put into practical use, so that it has become necessary for toners to be more improved in their performances such as image fidelity, releasability and color reproduction.

As quality requirements for the achievement of image fidelity, in the digital full-color copying machines, toners must be transferred from the photosensitive member to a transfer medium in a larger quantity than in monochrome copying machines. Also, it is foreseen that toners are sought to be made to have finer particle diameters corresponding to finer dots so as to cope with a continuing demand for higher image quality. From this viewpoint too, the polymerization process that can relatively easily produce toner particles having a sharp particle size distribution and fine particle diameter has superior features.

However, the production of toner particles by such a polymerization process has caused many problems when carbon black is used as a colorant.

In the first place, carbon black has on its surface a functional group such as a quinone group that inhibits the polymerizability of polymerizable monomers. Hence, the rate of polymerization decreases to make it difficult to enhance the degree of polymerization, so that the particles may become unstable at the time of granulation to cause agglomeration and coalescence, making it difficult to take out the product as particles.

Secondly, when carbon black is dispersed in polymerizable monomers, the carbon black can be dispersed with great difficulty because it has smaller primary particle diameter and larger specific surface area than other pigments and also has a long structure. Thus, it tends to localize in particles or to cause particles containing no carbon black.

Thirdly, since carbon black has a conductivity, electric charges on the toner particle surfaces tend to leak to tend to cause problems such as fog and toner scatter at the time of development.

To solve these problems, e.g., to cope with the inhibition of polymerizability, there is a method in which carbon black whose particle surfaces have been grafted is used, as disclosed in Japanese Patent Application Laid-open No. 56-116044, and a method in which carbon black whose particle surfaces have been treated with an aluminum coupling agent is used, as disclosed in Japanese Patent Application Laid-open No. 63-210849. These methods, however, require cumbersome steps for the surface treatment of carbon black, take a much time, result in a production cost increase, and are difficult to employ in an industrial scale.

With regard to dispersibility, Japanese Patent Applications Laid-open No. 64-35457 and No. 1-145664 disclose a method by which the dispersibility is improved using a specific dispersant, which, however, is in such a state that can not be said to have been well settled.

SUMMARY OF THE INVENTION

An object of the present invention is to provide a non-magnetic toner for developing an electrostatic image, a process for producing non-magnetic toner particles and an image forming method that have solved the problems discussed above.

Another object of the present invention is to provide a toner for developing an electrostatic image, having a high coloring power and a good charging performance, and an image forming method making use of such a toner.

Still another object of the present invention is to provide a non-magnetic toner for developing an electrostatic image, having a small weight average particle diameter and a sharp particle size distribution, and an image forming method making use of such a toner.

A further object of the present invention is to provide a process for producing non-magnetic toner particles promising a high coloring power and a good charging performance, which can obtain stable particles when toners are produced by polymerization.

Still further object of the present invention is to provide a process for producing non-magnetic toner particles having a small weight average particle diameter and a sharp particle size distribution.

To achieve the above objects, the present invention provides a non-magnetic toner for developing an electrostatic image, comprising non-magnetic toner particles produced by polymerizing in an aqueous medium a polymerizable monomer composition containing at least a polymerizable monomer, a carbon black and an azo type iron compound, wherein;

the carbon black has a DPB oil absorption of from 110 to 200 ml/100 g, a specific surface area of 100 $m^2/g$ or below as measured by nitrogen adsorption, a volatile component of 2% or less and an average primary particle diameter of from 20 to 60 mμ; and the azo type iron compound comprises a compound represented by the following Formula (1).

Formula (1)

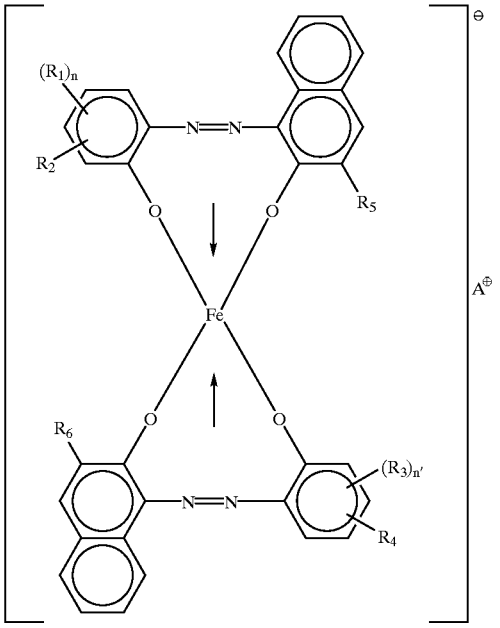

wherein $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ is the same or different; n and n' each represent an integer of 1 to 3; $R_2$ and $R_4$ each represent a member selected from the group consisting of a hydrogen atom and a nitro group, and $R_2$ and $R_4$ is the same or different; $R_5$ and $R_6$ each represent a member selected from the group consisting of a hydrogen atom, a halogen atom, a nitro group, a carboxyl group, an anilide group, an alkyl group having 1 to 18 carbon atoms, an alkenyl group, an aralkyl group, an alkoxyl group, a aryl group, a carboxylate group and a

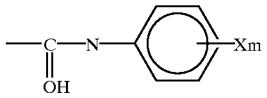

group, where X represents a member selected from the group consisting of a hydrogen atom, a lower alkyl group, a lower alkoxyl group, a nitro group and a halogen atom and m represents an integer of 1 to 3, and $R_5$ and $R_6$ is the same or different; and $A^+$ represents a member selected from the group consisting of a hydrogen ion, a sodium ion, a potassium ion, an ammonium ion and a mixture of any of these.

The present invention also provides a process for producing non-magnetic toner particles, comprising the step of;

mixing at least a first polymerizable monomer, a carbon black and an azo type iron compound to prepare a dispersion in which the carbon black and the azo type iron compound are dispersed in the polymerizable monomer, wherein;

the carbon black has a DPB oil absorption of from 110 to 200 ml/100 g, a specific surface area of 100 $m^2/g$ or below as measured by nitrogen adsorption, a volatile component of 2% or less and an average primary particle diameter of from 20 to 60 mμ; and the azo type iron compound comprises a compound represented by the following Formula (1).

Formula (1)

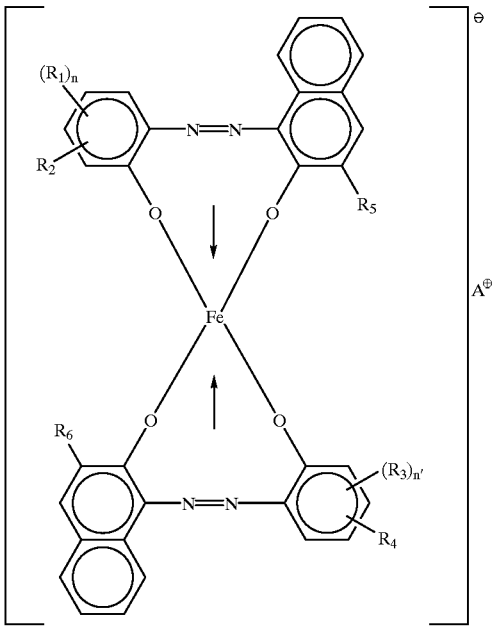

wherein $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ is the same or different; n and n' each represent an integer of 1 to 3; $R_2$ and $R_4$ each represent a member selected from the group consisting of a hydrogen atom and a nitro group, and $R_2$ and $R_4$ is the same or different; $R_5$ and $R_6$ each represent a member selected from the group consisting of a hydrogen atom, a halogen atom, a nitro group, a carboxyl group, an anilide group, an alkyl group having 1 to 18 carbon atoms, an alkenyl group, an aralkyl group, an alkoxyl group, a aryl group, a carboxylate group and a

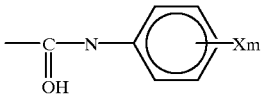

group, where X represents a member selected from the group consisting of a hydrogen atom, a lower alkyl group, a lower alkoxyl group, a nitro group and a halogen atom and m represents an integer of 1 to 3, and $R_5$ and $R_6$ is the same or different; and $A^+$ represents a member selected from the group consisting of a hydrogen ion, a sodium ion, a potassium ion, an ammonium ion and a mixture of any of these;

mixing at least the resultant dispersion and a second polymerizable monomer to prepare a polymerizable monomer composition; and polymerizing the resultant polymerizable monomer composition in an aqueous medium to produce non-magnetic toner particles.

The present invention still also provides an image forming method comprising the steps of;

developing an electrostatic latent image held on a latent image bearing member, by the use of a non-magnetic toner to form a toner image;

transferring the toner image formed on the latent image bearing member, to a recording medium via or not via an intermediate transfer member; and fixing the toner image transferred onto the recording medium;

wherein;

the non-magnetic toner comprises non-magnetic toner particles produced by polymerizing in an aqueous medium a polymerizable monomer composition containing at least a polymerizable monomer, a carbon black. and an azo type iron compound, wherein;

the carbon black has a DPB oil absorption of from 110 to 200 ml/100 g, a specific surface area of 100 $m^2/g$ or below as measured by nitrogen adsorption, a volatile component of 2% or less and an average primary particle diameter of from 20 to 60 mμ; and the azo type iron compound comprises a compound represented by the following Formula (1).

Formula (1)

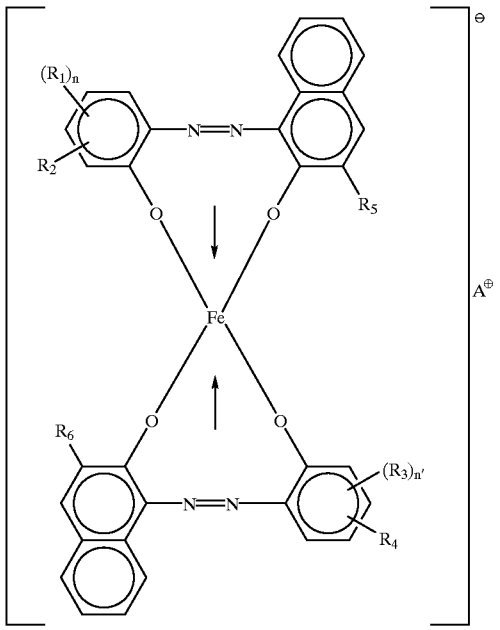

wherein $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ is the same or different; n and n' each represent an integer of 1 to 3; $R_2$ and $R_4$ each represent a member selected from the group consisting of a hydrogen atom and a nitro group, and $R_2$ and $R_4$ is the same or different; $R_5$ and $R_6$ each represent a member selected from the group consisting of a hydrogen atom, a halogen atom, a nitro group, a carboxyl group, an anilide group, an alkyl group having 1 to 18 carbon atoms, an alkenyl group, an aralkyl group, an alkoxyl group, a aryl group, a carboxylate group and a

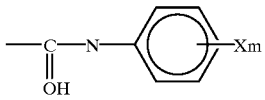

group, where X represents a member selected from the group consisting of a hydrogen atom, a lower alkyl group, a lower alkoxyl group, a nitro group and a halogen atom and m represents an integer of 1 to 3, and $R_5$ and $R_6$ is the same or different; and $A^+$ represents a member selected from the group consisting of a hydrogen ion, a sodium ion, a potassium ion, an ammonium ion and a mixture of any of these.

DESCRIPTION OF THE PREFERRED EMBODIMENTS

Figure 1:
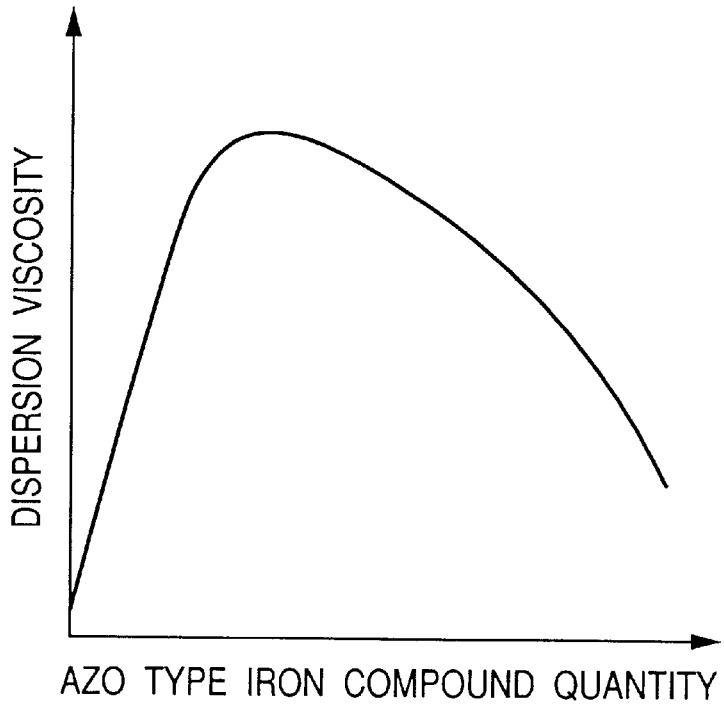
FIG. 1 is a graph showing the correlation between quantity of an azo type iron compound added and viscosity.

As a result of extensive studies, the present inventors have discovered that the dispersibility of carbon black in polymerizable monomers can be dramatically improved and the coloring power and production stability thereof can also be improved when a carbon black having specific physical properties and a specific azo type iron compound are used in combination. They have also discovered that, because of an improvement in the dispersibility of carbon black, it becomes possible to use a carbon black having a smaller specific surface area and less volatile component, and the use of such a carbon black having a smaller specific surface area and less volatile component makes it possible to prevent its polymerization inhibitory action when toner particles are produced by polymerization, and also to produce a toner having a sharp particle size distribution. They have further discovered that, because of the achievement of an improvement in the dispersibility of carbon black in toner particles, the problem of a lowering of charging performance of toner that is caused by an increase in conductivity and comes into question in carbon black having a large oil absorption can be settled and a better charging performance can be attained than the case when conventional carbon black is used.

The present invention is characterized in that the non-magnetic toner has non-magnetic toner particles produced by polymerizing in an aqueous medium a polymerizable monomer composition containing at least a polymerizable monomer and a colorant, where a carbon black having a DPB oil absorption of from 110 to 200 ml/100 g, a specific surface area of 100 $m^2/g$ or below as measured by nitrogen adsorption, a volatile component of 2% or less and an average primary particle diameter of from 20 to 60 m$\mu$ is used as the colorant and a specific azo type iron compound is used as a dispersant.

As previously stated, the carbon black is a pigment that can be dispersed with difficulty compared with other pigments. Especially when the carbon black is dispersed in polymerizable monomers, it has been very difficult to disperse it because no sufficient shear force is applicable thereto. The present inventors have solved this problem by using in combination, a specific azo type iron compound and carbon black having a larger oil absorption than conventional ones.

Like the carbon black used in the present invention, carbon black having a high oil absorption and a long structure has so high a conductivity that it tends to make poor the charging performance of toner, and usually has not been used in toners for electrophotography.

However, the present inventors have discovered that, when a specific azo type iron compound is used as a dispersant, the carbon black is much more improved in its dispersibility in toner particles produced by polymerization than the carbon black conventionally used and consequently the conducting paths inside the toner particles are intercepted and in reverse the toner can have better charging performance than toners containing conventional carbon black.

When toners are produced by suspension polymerization, a masterbatching step to pre-disperse at least the specific carbon black and specific azo type iron compound in the polymerizable monomer used may be carried out in order to well disperse the pigment, whereby the carbon black can be dispersed in a higher concentration with respect to the polymerizable monomer. Hence, it becomes easier to apply a shear force to dispersions and the carbon black dispersion effect becomes greater. Thus, such a step is particularly preferred.

FIG. 1 shows a change in viscosity of a dispersion (fluid dispersion) in the case when the specific carbon black and specific azo type iron compound used in the present invention are dispersed in styrene monomer. As is clear from FIG. 1, the viscosity of a fluid dispersion dramatically increases with an increase in the quantity of the azo type iron compound, so that the carbon black can be stably dispersed.

Figure 2:
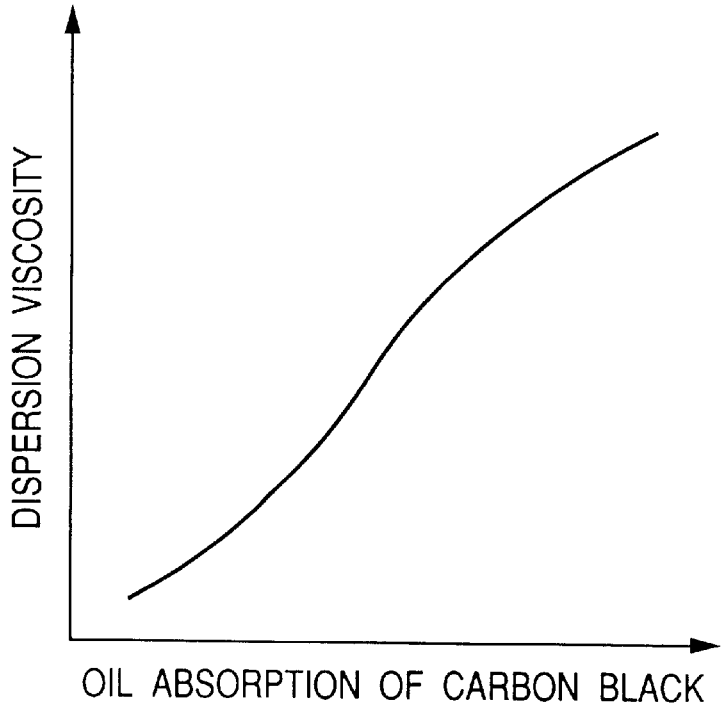
FIG. 2 is a graph showing the correlation between oil absorption of carbon black and viscosity.

FIG. 2 shows the relationship between oil absorption of carbon black and viscosity in the case when the azo type iron compound is added in a stated quantity and dispersed in styrene monomer, in respect of carbon black having an average primary particle diameter of from 20 to 60 m$\mu$. This FIG. 2 shows that carbon black having an oil absorption of 110 ml/100 g or above makes the viscosity of a fluid dispersion higher and has a better dispersibility in the polymerizable monomer. If, however, the carbon black has an oil absorption more than 200 ml/100 g, the fluid dispersion may have too high a viscosity to be readily taken out when the fluid dispersion is prepared by masterbatching, and also a problem may occur in granulation properties at the time of suspension polymerization. Also, with regard to the toner produced, if the carbon black has an oil absorption less than 110 ml/100 g, the carbon black can not be well dispersed in toner particles to tend to cause a lowering of coloring power or charge quantity, and, if the carbon black has an oil absorption more than 200 ml/100 g, the toner may have too high a surface conductivity and may undesirably cause a lowering of charging performance especially in an environment of high humidity.

Thus, in the present invention, the carbon black may have an oil absorption of from 110 to 200 ml/100 g, preferably from 120 to 180 ml/100 g, and more preferably from 120 to 160 ml/100 g.

The carbon black used in the present invention may have a smaller specific surface area and less volatile component than those used in usual toners. The carbon black having a smaller specific surface area and less volatile component has a small number of polymerization inhibitory functional groups, and is advantageous in that it has a low polymerization inhibitory action.

Accordingly, the carbon black used in the present invention may have a specific surface area of 100 $m^2/g$ or below, preferably from 90 to 30 $m^2/g$, and more preferably from 90 to 40 $m^2/g$, as measured by nitrogen adsorption, and also a volatile component of 2% or less, preferably from 0.1 to 1.8%, and more preferably from 0.1 to 1.7%.

If the carbon black has a specific surface area larger than 100 $m^2/g$ as measured by nitrogen adsorption, polymerization tends to be inhibited. Also, if the carbon black has a volatile component more than 2%, a large number of polymerization inhibitory functional groups are present on the carbon black particle surfaces, and such carbon black is not suited for use.

The carbon black used in the present invention may have an average primary particle diameter of from 20 to 60 mμ, preferably from 25 to 55 mμ, and more preferably from 25 to 45 mμ.

If the carbon black has an average primary particle diameter smaller than 20 mμ, it may cause too high a viscosity when used in combination with the specific azo type iron compound used in the present invention, and can be managed with difficulty. Also, because of a very fine average primary particle diameter, a sufficient dispersibility can be attained with difficulty. If the carbon black has an average primary particle diameter larger than 60 mμ, the toner may have too low a coloring power even if the carbon black is well dispersed, and the toner may have a low charging performance if the carbon black is used in a large quantity in order to enhance coloring power. Thus, such a carbon black is not suited for use.

According to studies made by the present inventors, content A (% by weight) of the carbon black and content B (% by weight) of the azo type iron compound, based on the weight of the toner particles, may preferably satisfy the following relationship:

$$3 \leqq A/B \leqq 50$$

and may more preferably satisfy the following relationship:

$$3 \leqq A/B < 38$$

If the azo type iron compound is in too small a quantity with respect to the carbon black, the fluid dispersion can not have a high viscosity as can be seen also from FIG. 1, and the carbon black can be stably dispersed with difficulty. In such an instance, the carbon black settles with time. If the toner is produced using such a fluid dispersion, it is difficult for the toner to have a sufficient coloring power.

If the azo type iron compound is in too large a quantity with respect to the carbon black, the azo type iron compound tends to cause secondary agglomeration, resulting in a lowering of dispersibility, and also the secondary agglomerates thus formed may cause the inhibition of polymerization to make it difficult to take out the product as toner particles.

In the present invention, in view of a high image density, the charge stability of toner and the uniform dispersibility of carbon black, the content A (% by weight) of the carbon black based on the weight of the toner particles may preferably be from 2 to 20% by weight, more preferably from 3 to 15% by weight;, and still more preferably from 5 to 13% by weight.

If the content A (% by weight) of the carbon black is less than 2% by weight, the toner may have a low coloring power and can not achieve a high image density. If it is more than 20% by weight, the uniform dispersibility can not be achieved even with use of the azo type iron compound of the present invention, so that fog and toner scatter may seriously occur.

In the present invention, in view of maintaining the fluid dispersion viscosity in a proper state and improving the uniform dispersibility of carbon black, the content B (% by weight) of the azo type iron compound based on the weight of the toner particles may preferably be from 0.1 to 3.0% by weight, more preferably from 0.3 to 2.0% by weight, and still more preferably from 0.5 to 1.5% by weight.

If the content B (% by weight) of the azo type iron compound is less than 0.1% by weight, the fluid dispersion can not have a high viscosity and the effect of improving the dispersibility of carbon black can not be exhibited. If it is more than 3.0% by weight, the fluid dispersion may inversely a low viscosity and similarly the the effect of improving the dispersibility of carbon black may be lost.

As previously stated, the present inventors have succeeded in attaining electrophotographic performance superior to that of suspension polymerization toners making use of conventional carbon black, because the carbon black having a high oil absorption and a long structure that has not been usually used is used in combination with a specific azo type iron compound.

The azo type iron compound used in the present invention has a complex structure represented by the following Formula (1).

Formula (1)

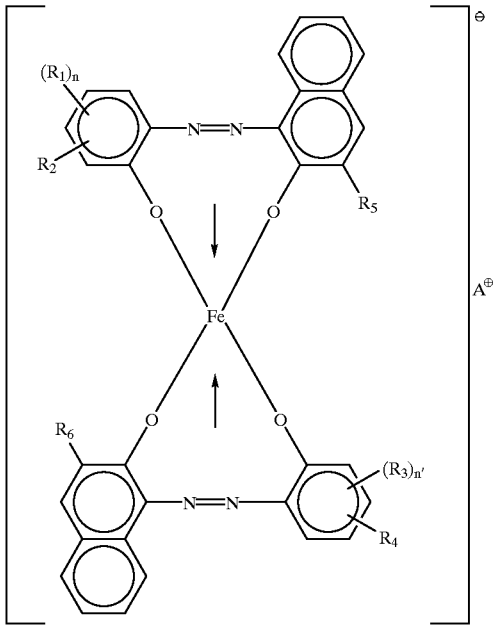

wherein $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ is the same or different; n and n' each represent an integer of 1 to 3; $R_2$ and $R_4$ each represent a member selected from the group consisting of a hydrogen atom and a nitro group, and $R_2$ and $R_4$ is the same or different; $R_5$ and $R_6$ each represent a member selected from the group consisting of a hydrogen atom, a halogen atom, a nitro group, a carboxyl group, an anilide group, an alkyl group having 1 to 18 carbon atoms, an alkenyl group, an aralkyl group, an alkoxyl group, a aryl group, a carboxylate group and a

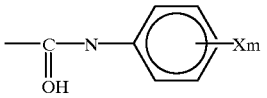

group, where X represents a member selected from the group consisting of a hydrogen atom, a lower alkyl group (preferably an alkyl group having 1 to 18 carbon atoms), a lower alkoxyl group (preferably an alkoxyl group having 1 to 18 carbon atoms), a nitro group and a halogen atom and m represents an integer of 1 to 3, and $R_5$ and $R_6$ is the same or different; and $A^+$ represents a member selected from the group consisting of a hydrogen ion, a sodium ion, a potassium ion, an ammonium ion and a mixture of any of these.

In the compound represented by the above Formula (1), a compound represented by the following Formula (2) is preferred in view of its dispersibility in the polymerizable monomer used in the present invention, its readiness to become present on toner particle surfaces in the aqueous medium and its contribution to a sharp particle size distribution of toner.

Formula (2)

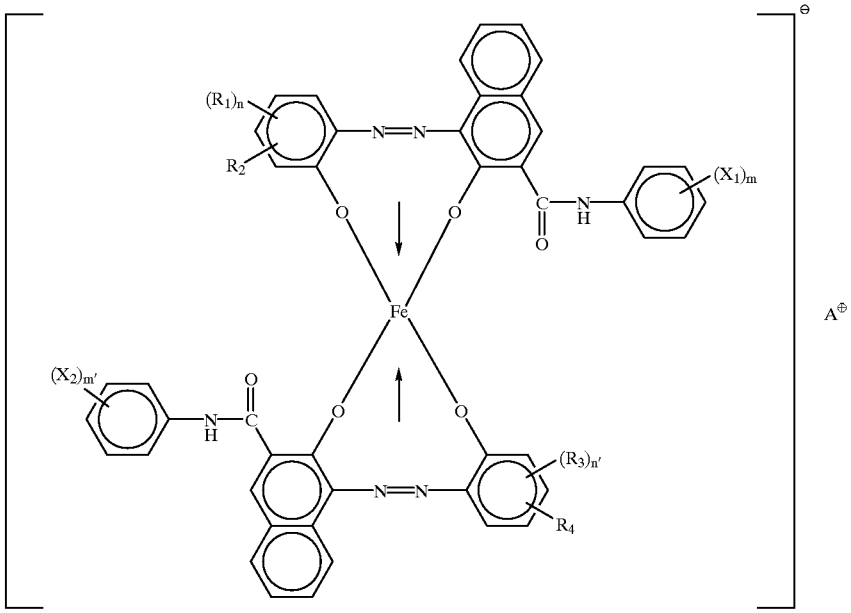

wherein $X_1$ and $X_2$ each represent a member selected from the group consisting of a hydrogen atom, a lower alkyl group (preferably an alkyl group having 1 to 18 carbon atoms), a lower alkoxyl group (preferably an alkoxyl group having 1 to 18 carbon atoms), a nitro group and a halogen atom, and $X_1$ and $X_2$ is the same or different; m and m' each represent an integer of 1 to 3; $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ is the same or different; n and n' each represent an integer of 1 to 3; $R_2$ and $R_4$ each represent a member selected from the group consisting of a hydrogen atom and a nitro group; and $A^+$ represents a hydrogen ion, a sodium ion, a potassium ion, an ammonium ion and a mixture of any of these.

The above azo type iron compound is used also as a negative charge control agent in the toner. This azo type iron complex compound can be synthesized by known means.

According to studies made by the present inventors, the mechanism by which the azo type iron compound represented by the above Formula (1) brings about an improvement in the dispersibility of the specific carbon black in the polymerizable monomer is considered as follows: The azo type iron compound used in the present invention has an appropriate wettability to the polymerizable monomers and also may cause no problem of foaming or the like, and hence the fluid dispersion viscosity can be stably controlled by the carbon black, so that the process latitude for dispersing the carbon black can be broad to enable achievement of a uniformly dispersed state in a short time.

On the other hand, when an azo type chromium compound whose central metal is chromium, commonly used as a charge control agent in conventional toners is mixed in combination with the polymerizable monomer and the specific carbon black, the controlling of fluid dispersion viscosity is so difficult that any slight change in quantity for its addition or change in time for dispersing the carbon black may cause a great change in the fluid dispersion viscosity, and consequently it becomes very difficult to achieve the uniformly dispersed state.

As typical examples of the azo type iron compound represented by the above Formula (1), it may include the following compounds.

Azo type iron compound (1)
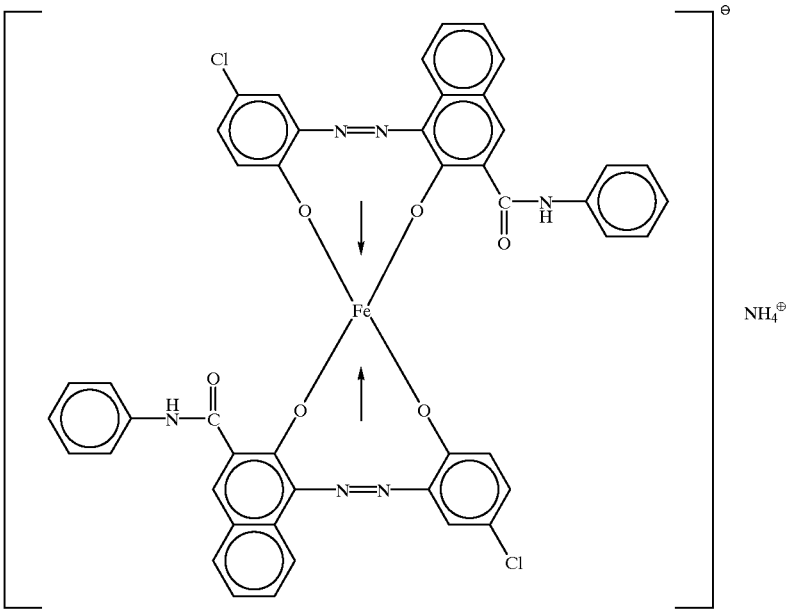
Azo type iron compound (2)
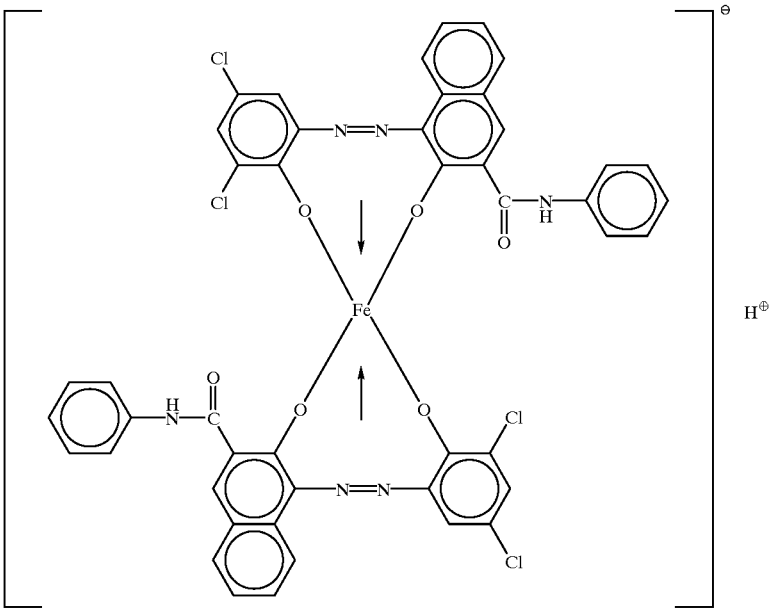

-continued
Azo type iron compound (3)
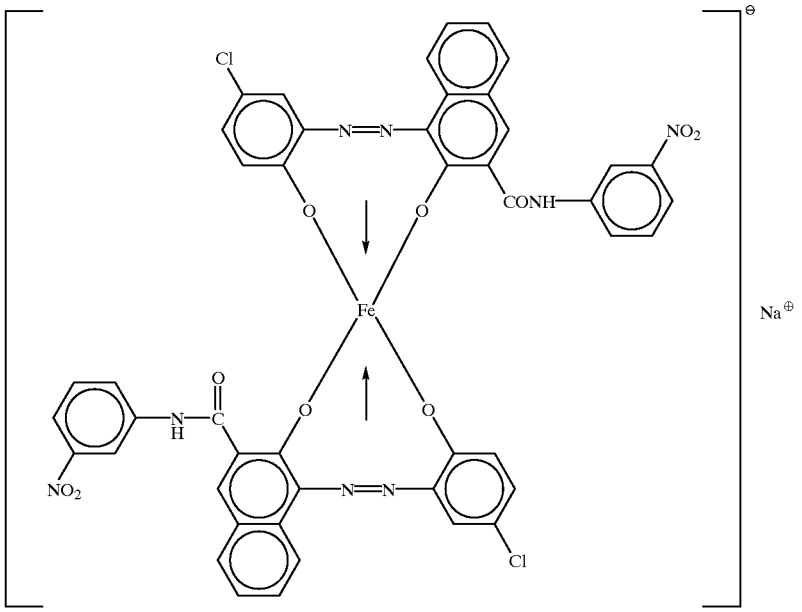
Azo type iron compound (4)
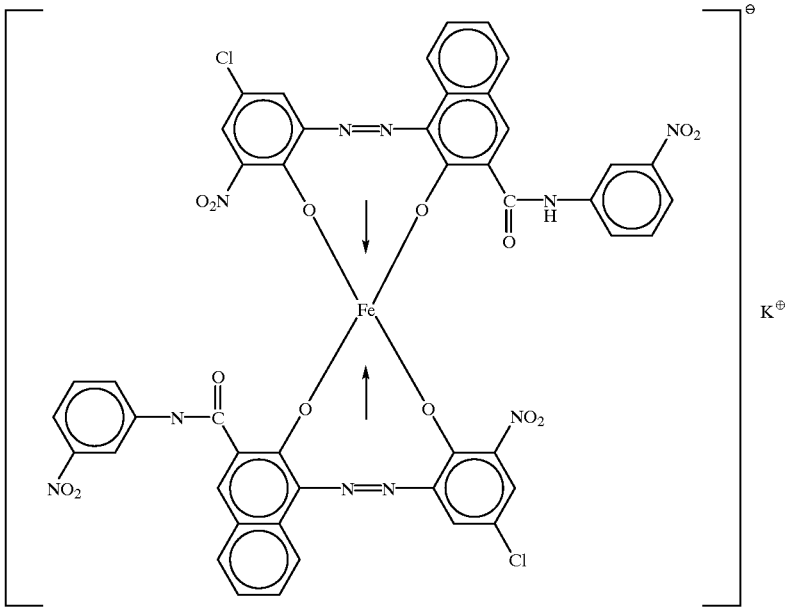

-continued
Azo type iron compound (5)
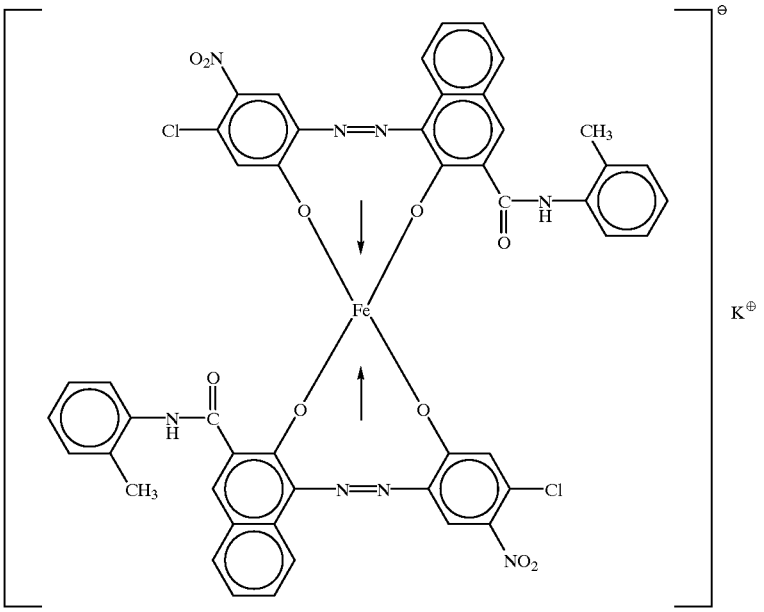
Azo type iron compound (6)
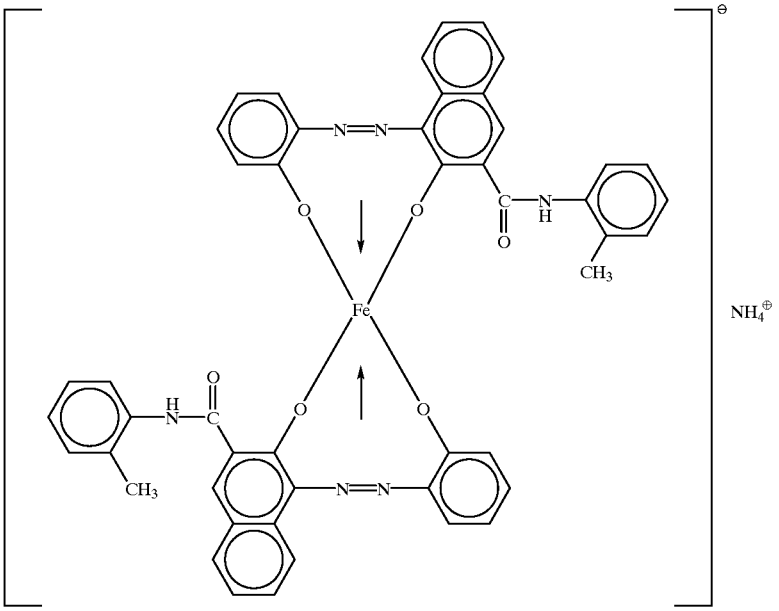

-continued
Azo type iron compound (7)
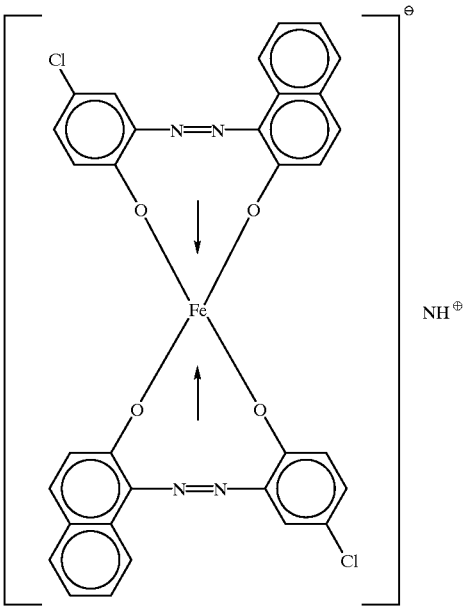
Azo type iron compound (8)
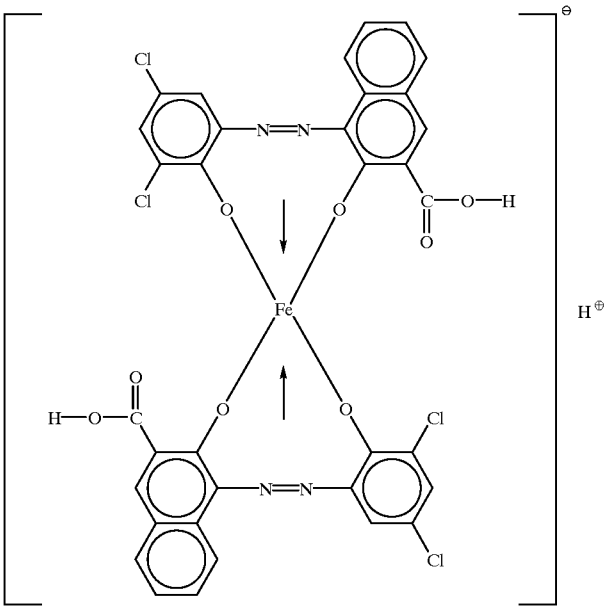

-continued
Azo type iron compound (9)
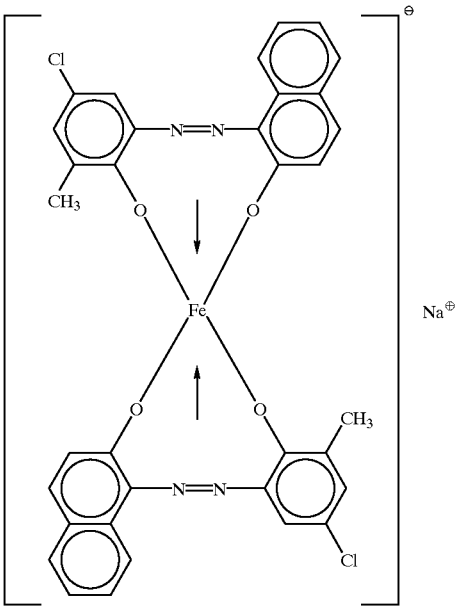
Azo type iron compound (10
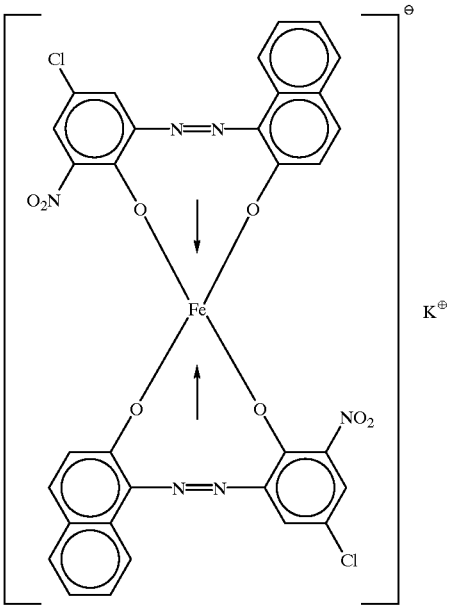

-continued

Azo type iron compound (11)

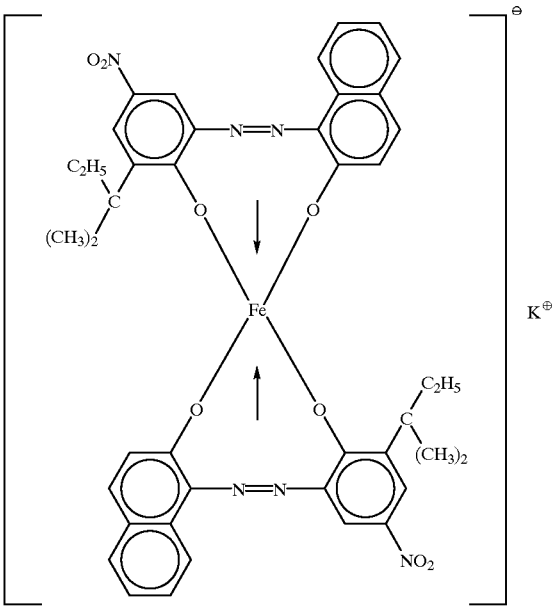

Azo type iron compound (12)

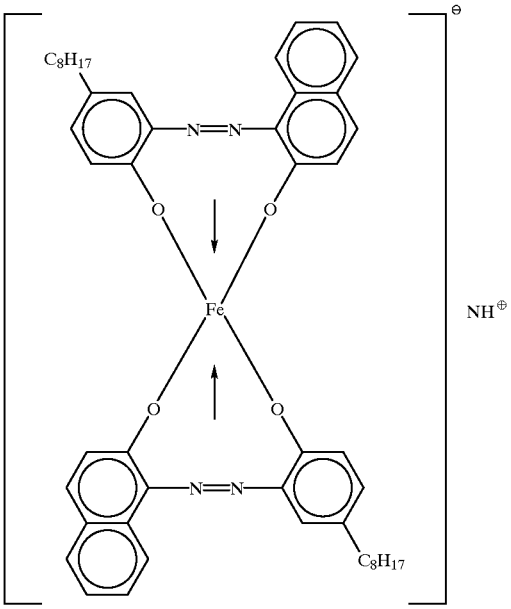

In the present invention, the toner particles may preferably have a weight average particle diameter (D4) of from 2 to 10 μm, and more preferably from 3 to 8 μm, in view of achievement of both a high image density and a high image quality.

If the toner particles have a weight average particle diameter smaller than 2 μm, difficulties such as toner scatter and fog may occur. If it is larger than 10 μm, the reproducibility of fine dots may lower or toner scatter may occur at the time of transfer to cause a difficulty in achieving a high image quality In the present invention, the toner particles are produced by polymerization. In this course of polymerization, the carbon black may hardly cause the inhibition of polymerization as previously stated. Accordingly, the toner particles formed, too, may contain ultra fine powder or coarse powder in a smaller proportion, the coarse powder being formed by agglomeration of toner particles themselves, and hence can have a sharp particle size distribution.

As the particle size distribution of the toner particles, toner particles with diameters of 4 μm or smaller may be in a content of not more than 25% by number, and preferably from 5 to 20% by number; and toner particles with diameters of 10.1 μm or larger, in a content of not more than 2.0% by volume, and preferably from 0.1 to 1.3% by volume in view of uniformity of charging performance of the toner.

If the toner particles with diameters of 4 μm or smaller is in a content more than 25% by number, fog tends to occur because of the reuse of toner when applied in a cleanerless system, which is an example in the present invention. On the other hand, if the toner particles with diameters of 10.1 μm or larger is in a content of more than 2.0% by volume, toner scatter tends to occur when applied in an intermediate transfer member system, which is an example in the present invention.

In the present invention, as the state of dispersion of carbon black in the toner particles, the carbon black may preferably be present in the binder resin in such a state that it is in a larger quantity at the centers of toner particles than at the surfaces of toner particles when a cross section of the toner is observed by transmission microscope.

In the present invention, the non-magnetic toner and the non-magnetic toner particles are meant to be toner and toner particles having a saturation magnetization of 20 $Am^2/kg$ or below.

In the present invention, the non-magnetic toner may preferably have a volume resistivity of from $10^{10}$ to $10^{16}$ Ω·cm, more preferably from $10^{12}$ to $10^{16}$ Ω·cm, and still more preferably from $10^{13}$ to $10^{16}$ Ω·cm, in view of making the charging performance of toner stable over a long period of time.

If the non-magnetic toner has a volume resistivity lower than $10^{10}$ Ω·cm, the charging performance of toner tends to lower especially in an environment of high humidity. If it is higher than $10^{16}$ Ω·cm, image density tends to lower when an original having an image area percentage of 2% or less is continuously printed especially in an environment of low humidity.

In the present invention, when the above toner is formed, the improvement in dispersibility of the carbon black is remarkably effective especially in the fluid dispersion prepared in the masterbatching step to pre-disperse the carbon black and the azo type iron compound in the polymerizable monomer used. This is because the carbon black can be dispersed in a higher concentration with respect to the polymerizable monomer and hence the effect of dispersion can be great.

The polymerizable monomer used in the toner of the present invention may preferably include styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and butadiene, isoprene, cyclohexene, acrylo- or methacrylonitrile and acrylic acid amide. Any of these may be used alone or in the form of a mixture. When used in the form of a mixture, monomers may be used in appropriate combination so that the theoretical glass transition temperature (Tg) as described in a publication POLYMER HANDBOOK, 2nd Edition III, pp.139–192 (John Wiley & Sons, Inc.) ranges from 40 to 75° C. An instance where the theoretical glass transition temperature is lower than 40° C. is not preferable in respect of storage stability of toners or running stability of developers. If it is higher than 75° C., the fixing point of the toner may become higher. Especially in the case of full-color toners, the color mixing performance of the respective color toners may lower, resulting in a poor color reproducibility. Also, the transparency of OHP images may lower. This is not preferable in view of high image quality.

In the present invention, the resin component of the toner may preferably have, in its molecular weight distribution as measured by GPC (gel permeation chromatography), a weight average molecular weight (Mw) of from 5,000 to 1,000,000, and more preferably from 7,000 to 500,000, and a ratio of weight average molecular weight (Mw) to number average molecular weight (Mn), Mw/Mn, of preferably from 2 to 100, and more preferably from 3 to 50, in view of broad of fixing latitude and the prevention of contamination of toner charging members.

If the resin component of the toner has a weight average molecular weight (Mw) less than 5,000, the non-offset region on the side of high temperature may narrow and simultaneously the toner charging member tends to be contaminated to tend to cause faulty charging. If it is more than 1,000,000, charging performance may lower. Also, if the resin component of the toner has an Mw/Mn of less than 2, the fixable temperature range may extremely narrow. If it is more than 100, black images formed may have a dull i:one to give a sense of unfitness undesirably.

The azo type iron compound used in the present invention has also the function as a charge control agent, and may be used further in combination with a different charge control agent. As the charge control agent usable in combination, any known agents may be used. As specific compounds, they may include, as negative type agents, metal compounds of salicylic acid, naphthoic acid and dicarboxylic acids, polymer type compounds having sulfonic acid or carboxylic acid in the side chain, boron compounds, urea compounds, silicon compounds, and carycsarene. As positive type agents, they may include quaternary ammonium salts, polymer type compounds having such a quaternary ammonium salt in the side chain, guanidine compounds, and imidazole compounds.

In the present invention, for the purpose of improving the releasability to fixing members at the time of heat fixing, a wax component comprised of a hydrocarbon compound may preferably be used as a release agent in the toner particles. The wax used in the present invention as a release agent may include paraffin wax, polyolefin wax, ester wax and modified products of these (e.g., oxides or graft-treated products), higher fatty acids and metal salts thereof, and amide wax. These wax may have a softening point of from 40 to 130° C., and preferably from 50 to 120° C., as measured by the ring and ball method (JIS K2531). If this wax component has a softening point lower than 40° C., the toner may have insufficient anti-blocking properties and shape retentivity. If it is higher than 130° C., the effect of releasability may be insufficient.

Any of these wax components may be used alone or in combination, and may preferably be contained in the toner particles in an amount of 0.1 to 50% by weight, and more preferably from 0.5 to 30% by weight.

If the content of the wax component based. on the weight of the toner particles is less than 0.1% by weight, its content is so small that the addition of wax component can be less effective for the releasability to fixing members. If it is more than 50% by weight, the wax may become present on -toner particles in a large quantity to tend to contaminate toner charging members undesirably.

In the present invention, the non-magnetic toner particles may contain a different resin in addition to the resin synthesized by the polymerization of polymerizable monomers as previously described.

The non-magnetic toner particles further containing such a different resin can be produced by, in the process for producing non-magnetic toner particles by polymerization, adding this different resin together with at least the polymerizable monomer, the carbon black and the azo type iron compound to prepare the polymerizable monomer composition, and polymerizing the polymerizable monomer composition thus prepared. When, e.g., a polymerizable monomer component containing a hydrophilic functional group such as an amino group, a carboxylic acid group, a hydroxyl group, a sulfonic acid group, a glycidyl group or a nitrile group, which can not be used because it is water-soluble and hence dissolve in an aqueous suspension to cause emulsion polymerization, is introduced into toner particles, it becomes usable when used in the form of a copolymer such as a random copolymer, block copolymer or graft copolymer thereof with a vinyl compound such as styrene or ethylene or in the form of a polycondensation product such as, polyester or polyamide or a polyaddition product such as polyether or polyimine.

When a high polymer containing such a polar functional group is made present together in toner particles, the wax component described above can be phase-separated at the time of the polymerization of the polymerizable monomer composition in the aqueous medium, and can be more strongly encapsulated in the toner particles, thus this is a preferred embodiment.

Such a high polymer containing a polar functional group may preferably be contained in an amount of from 1 to 20% by weight, and more preferably from 2 to 16% by weight, based on the weigh of the toner particles. If this high polymer containing a polar functional group is contained in an amount less than 1% by weight, the wax encapsulated may come to the toner particle surfaces, resulting in too small a quantity to exhibit release effect. If it is in an amount more than 20% by weight, the wax can be encapsulated with difficulty, resulting in contamination of toner charging members undesirably.

This high polymer containing a polar functional group may preferably have a weight average molecular weight of 5,000 or more. If it has a weight average molecular weight less than 5,000, in particular, less than 4,000, the high polymer containing a polar functional group tends to localize in the vicinity of particle surfaces to undesirably tend to adversely affect developing performance and anti-blocking properties.

A toner having a broader molecular weight distribution and higher anti-offset properties can be obtained when a high polymer with a molecular weight different from the molecular weight range of the toner obtained by polymerizing polymerizable monomers is dissolved in the polymerizable monomer composition to carry out polymerization.

A polymerization initiator, which is used in the present invention to produce toner particles by polymerization may include, e.g., azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide and lauroyl peroxide.

The amount of the polymerization initiator to be added differs depending on the intended degree of polymerization. Usually, the polymerization initiator may be used in an amount of from 0.5 to 20% by weight based on the weight of the polymerizable monomers, which is preferable in view of controlling the molecular weight distribution of toner and broadening the latitude of reaction conditions. The polymerization initiator may a little differ in type depending on the methods for polymerization, and may be used alone or in the form of a mixture, making reference to its 10-hour half-life period temperature.

In order to control the degree of polymerization when toner particles are produced by polymerization, any known cross-linking agent, chain transfer agent and polymerization inhibitor may be further added to produce the toner particles.

As a dispersant other than the azo type iron compound previously described, used in the present invention in the polymerization process, it may include, as inorganic oxides, tricalcium phosphate, magnesium phosphate, aluminum phosphate, zinc phosphate, hydroxyapatite, calcium carbonate, magnesium carbonate, calcium hydroxide, magnesium hydroxide, aluminum hydroxide, calcium metasilicate, calcium sulfate, barium sulfate, bentonite, silica, alumina, magnetic materials and ferrite. As organic compounds, it may include, e.g., polyvinyl alcohol, gelatin, methyl cellulose, methyl hydroxypropyl cellulose, ethyl cellulose, carboxymethyl cellulose sodium salt, and starch, which may be dispersed in an aqueous phase when used. Any of the stabilizers may preferably be used in an amount of from 0.2 to 10.0 parts by weight based on 100 parts by weight of the polymerizable monomers, in order to achieve a sharp particle size distribution and prevent toner particles from coalescing.

As these dispersants, those commercially available may be used as they are. In order to obtain dispersed particles having a fine and uniform particle size, however, fine particles of the inorganic compound may be formed in the dispersion medium under high-speed agitation. For example, in the case of tricalcium phosphate, an aqueous sodium phosphate solution and an aqueous calcium chloride solution may be mixed under high-speed agitation, whereby a fine-particle dispersant preferable for the suspension polymerization can be obtained. In order to make the particles of these dispersants fine, 0.001 to 0.1 part by weight of a surface active agent may be used in combination. Stated specifically, commercially available nonionic, anionic or cationic surface active agents may be used. For example, those preferably used are sodium dodecylsulfate, sodium tetradecylsulfate, sodium pentadecylsulfate, sodium octylsulfate, sodium oleate, sodium laurate, potassium stearate and calcium oleate.

The non-magnetic toner particles according to the present invention can be materially produced by a production process as described below.

The carbon black, the azo type iron compound and optionally further the charge control agent, the polymerization initiator and other additives are added in the polymerizable monomer, which are then uniformly dissolved or dispersed by means of a mixing machine such as a homogenizer or an ultrasonic dispersion machine to prepare the polymerizable monomer composition. The polymerizable monomer composition thus prepared is dispersed in an aqueous medium containing a dispersion stabilizer, by means of a conventional stirrer or a mixing machine such as a homomixer or a homogenizer. Granulation is carried out preferably while controlling the agitation speed and time so that droplets of the polymerizable monomer composition can have the desired toner particle size. After the granulation, agitation may be carried out to such an extent that the state of particles is maintained and the particles can be prevented from settling, by the acton of the dispersion stabilizer. The polymerization may be carried out at a polymerization temperature set at 40° C. or above, usually from 50 to 90° C. At the latter half of the polymerization, the temperature may be raised, and also the aqueous medium may be removed in part from the reaction system at the latter half of the polymerization reaction or after the polymerization reaction has been completed, in order to remove unreacted polymerizable monomers, by-products and so forth so that the running performance can be improved in the image forming method employing the toner of the present invention. After the polymerization reaction has been completed, the toner particles formed are washed and collected by filtration, followed by drying. In such suspension polymerization, water may usually be used as a dispersion medium preferably in an amount of from 300 to 3,000 parts by weight based on 100 parts by weight of the monomer composition.

In the process for producing the non-magnetic toner particles of the present invention, as described above, the polymerizable monomer composition is prepared through masterbatching in order to improve the dispersibility of carbon black in the toner particles.

Stated specifically, the carbon black preferably in an amount of from 10 to 40 parts by weight, and more preferably from 10 to 25 parts by weight, and the azo type iron compound preferably in an amount of from 0.2 to 5 parts by weight, and more preferably from 0.5 to 3 parts by weight, based on 100 parts by weight of a first polymerizable monomer, may be mixed and dispersed, whereby the carbon black can be dispersed in a very high concentration, and hence the fluid dispersion can have a high viscosity and the shear force can be well applied at the time of mixing, so that the dispersibility of carbon black can be dramatically improved because of its combination with the dispersion effect attributable to the azo type iron compound.

If the carbon black is mixed in an amount less than 10 parts by weight, the fluid dispersion may have so small a viscosity that no sufficient dispersion can be achieved even when the azo type iron compound is used. On the other hand, if it is in an amount more than 40 parts by weight, the viscosity of the fluid dispersion can be controlled with difficulty, and consequently dispersion tends to be non-uniform.

If the azo type iron compound is mixed in an amount less than 0.2 parts by weight, the viscosity of the fluid dispersion can not be well effectively enhanced. On the other hand, if it is in an amount more than 5 parts by weight, the fluid dispersion may have a low viscosity, and dispersion tends to be non-uniform.

The (masterbatch) fluid dispersion containing the first polymerizable monomer and at least the carbon black and the azo type iron compound optionally together with the wax component and/or the charge control agent may preferably have a viscosity of from 100 to 2,000 cPs (centipoises), and more preferably from 150 to 1,600 cPs.

If this fluid dispersion has a viscosity lower than 100 cPs, the fluid dispersion may have too low a viscosity, and dispersing shear can not be applied to make it difficult to achieve uniform dispersion of the carbon black. On the other hand, if it has a viscosity higher than 2,000 cPs, the fluid dispersion may have too high a viscosity, and the uniformly dispersed state can be maintained with difficulty, simultaneously resulting in a poor dischargeability to cause a lowering of productivity.

This fluid dispersion is mixed with a second polymerizable monomer and further optionally with the wax component, the high polymer containing a polar functional group, the charge control agent, the polymerization initiator and other additives to prepare a polymerizable monomer composition.

The second polymerizable monomer may preferably be mixed in an amount of from 20 to 100 parts by weight, and more preferably from 30 to 70 parts by weight, based on 100 parts by weight of the fluid dispersion, as being preferable in view of uniform dispersibility of the second polymerizable monomer in the masterbatch components.

If this second polymerizable monomer is mixed in an amount less than 20 parts by weight, it takes a time until it is uniformly dispersed. If it is in an amount more than 100 parts by weight, the carbon black tends to agglomerate, also taking a time for uniform dispersion.

In this polymerizable monomer composition, the proportion of the carbon black based on the weight of the polymerizable monomer composition may preferably be from 2 to 20% by weight, and more preferably from 3 to 15% by weight, in view of coloring power of toner and stable charging performance of toner.

If the proportion of the carbon black in the polymerizable monomer composition is less than 2% by weight, a high image density can be achieved with difficulty. If it is more than 20% by weight, the charging performance of toner tends to lower especially in an environment of high humidity.

In this polymerizable monomer composition, the proportion of the azo type iron compound based on the weight of the polymerizable monomer composition may preferably be from 0.1 to 3.0% by weight, and more preferably from 0.3 to 2.0% by weight, in view of improvement in uniform dispersibility of carbon black while maintaining the fluid dispersion viscosity in a proper state.

If the proportion of the azo type iron compound in the polymerizable monomer composition is less than 0.1% by weight, the fluid dispersion viscosity can not be enhanced and the effect of improving the dispersibility of carbon black can not be exhibited. If it is more than 3.0% by weight, the fluid dispersion may inversely have a low viscosity, and similarly the effect of improving the dispersibility of carbon black may be lost.

Various methods for measurement according to the present invention will be described below.

(1) Measurement of DPB oil absorption of carbon black:
Measured according to JIS 4656/1.

(2) Measurement of specific surface area of carbon black by nitrogen adsorption:
Measured according to JIS 4652.

(3) Measurement of volatile component of carbon black:
Measured according to JIS 1126.

(4) Measurement of average primary particle diameter of carbon black:
Using a transmission microscope, an enlarged photograph of cross sections of particles is taken at 30,000 magnifications, and an average value of 100 particles is calculated.

(5) Measurement of weight average particle diameter (D4) of toner, and % by number of toner particles with diameters of 4.0 $\mu$m or smaller and % by volume of toner particles with diameters of 10.1 $\mu$m or larger:
The average particle diameter and particle size distribution of the toner can be measured by various methods using a Coulter counter Model TA-II or Coulter Multisizer (manufactured by Coulter Electronics, Inc.). In the present invention, they are measured using Coulter Multisizer (manufactured by Coulter Electronics, Inc.). An interface (manufactured by Nikkaki k.k.) that outputs number distribution and volume distribution and a personal computer PC9801 (manufactured by NEC.) are connected. As an electrolytic solution, an aqueous 1% NaCl solution is prepared using first-grade sodium chloride. For example, ISOTON R-II (available from Coulter Scientific Japan Co.) may be used. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion treatment for about 1 minute to about 3 minutes in an ultrasonic dispersion machine. The volume distribution and number distribution are calculated by measuring the volume and number of toner particles with particle diameters of not smaller than 2 pm by means of the above Coulter Multisizer, using an aperture of 100 $\mu$m as its aperture. Then the values according to the present invention are determined, which are the volume-based (the middle value of each channel is used as the representative value for each channel), weight average particle diameter (D4) determined from volume distribution, the % by number of toner particles with diameters of 4.0 $\mu$m or smaller determined from number distribution and the % by volume of toner particles with diameters of 10.1 $\mu$m or larger determined from volume distribution.

(6) Observation of the degree of dispersion of carbon black:

Using a transmission microscope, an enlarged photograph of cross sections of toner particles is taken at 30,000 magnifications, and relative evaluation is made on the state of dispersion.

Figure 6:
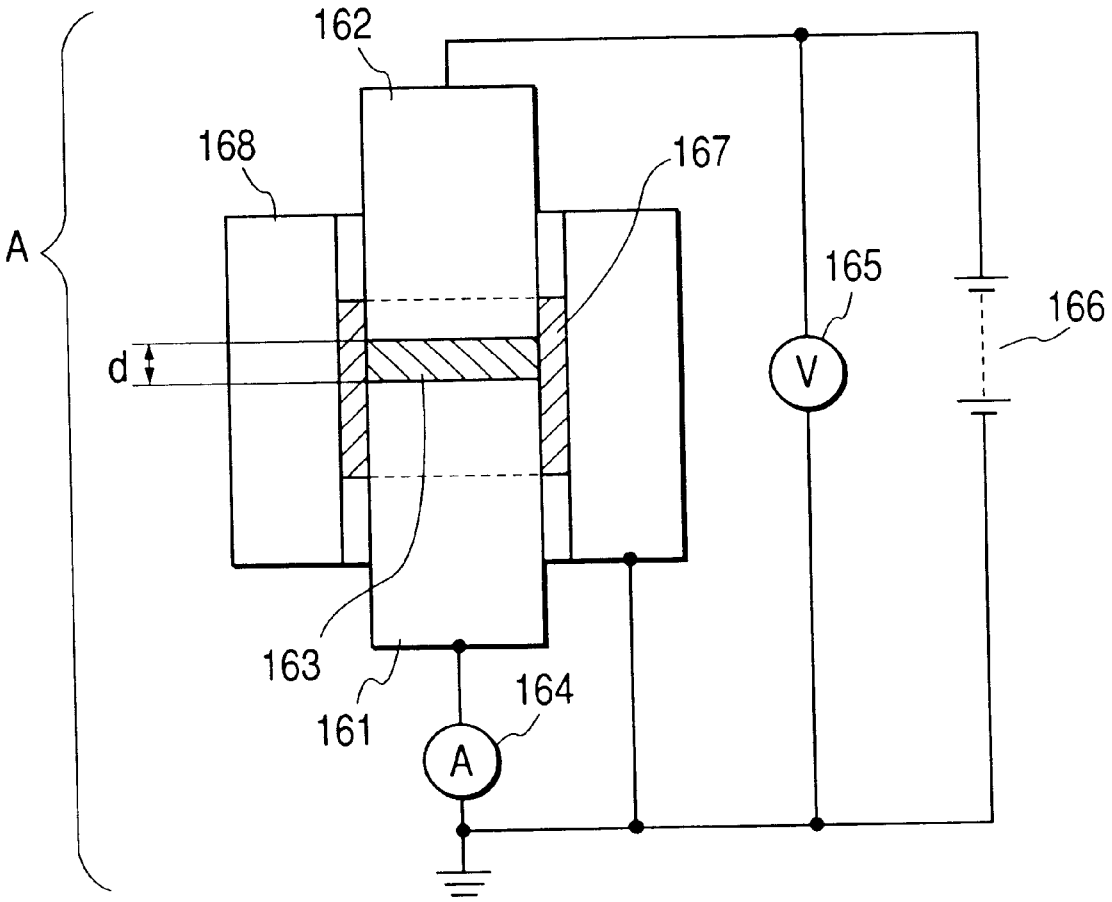
FIG. 6 schematically illustrates a device for measuring volume resistivity.

(7) Measurement of volume resistivity of toner and toner particles:

In the measuring device shown in FIG. 6, reference numeral 161 denotes a lower electrode; 162, an upper electrode; 163, a sample to be measured; 164, an ammeter; 165, a voltmeter; 166, a constant-voltage device; and 167, an insulating material.

Measured using the cell shown in FIG. 6. More specifically, a cell A is packed with the sample, and the lower and upper electrodes 161 and 162 are so provided as to come into contact with the sample thus packed, where a 1,000 V of DC voltage is applied across the electrodes and the currents flowing at that time are measured to determine resistivity. The measurement is made under conditions of contact area S between the sample packed and the cell: 2 $cm^2$; thickness d: 3 mm;

and load of the upper electrode: 15 kg.

(8) Measurement of molecular weight distribution by GPC of the resin component of toner and the high polymer containing a polar functional group:

As a specific method for measurement by GPC of the resin component of toner and the high polymer containing a polar functional group, toner particles are beforehand extracted with a toluene solvent, for 20 hours by means of a Soxhlet extractor, and thereafter the toluene is evaporated off by means of a rotary evaporator, followed by addition of an organic solvent (e.g., chloroform) capable of dissolving the wax optionally added to the toner particles but dissolving no resin component, to thoroughly carry out washing, and thereafter dissolved in tetrahydrofuran (IHF). The solution thus obtained is then filtered with et solvent-resistant membrane filter of 0.3 $\mu$m in pore diameter to obtain a sample. Molecular weight distribution of the sample is measured using a detector 150C, manufactured by Waters Co. As column constitution, A-801, A-802, A-803, A-804, A-805, A-806 and A-807, available from Showa Denko K.K., are connected, and the molecular weight distribution is measured using a calibration curve of a standard polystyrene resin. Weight average molecular weight (Mw) and number average molecular weight are calculated from the resultant molecular weight distribution.

(9) Measurement of viscosity of masterbatch dispersion:

Measured using VT500, manufactured by Hahke Co., and using MVDIN as a sensor, under conditions of 30° C. at a number of revolution of 60 rpm.

(10) Measurement of magnetic properties of magnetic toner and magnetic toner particles:

As a device, a BHU-50 type magnetization measuring device is used. About 1.0 g of a measuring sample is weighed out, and a cell of 10 mm high is packed with it, which is then set in the device. To make measurement, an applied magnetic field is gradually increased in magnetizing force so as to be changed to be 3,000 oersteds at maximum. Then, the applied magnetic field is decreased to finally form a hysteresis curve on recording paper, from which saturation magnetization is determined.

The image forming method employing the toner of the present invention will be described below with reference to the accompanying drawings.

Figure 3:
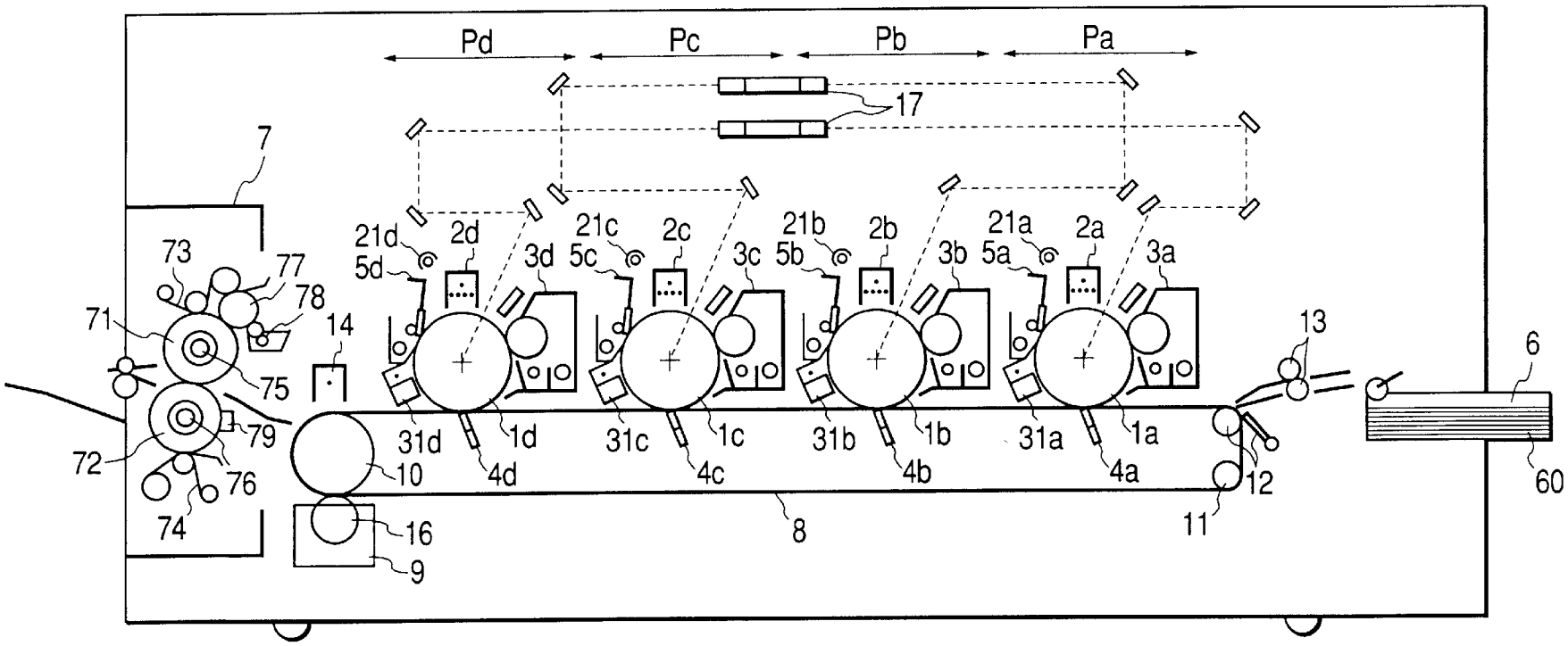
FIG. 3 schematically illustrates an image forming apparatus that can carry out the image forming method of the present invention.

FIG. 3 schematically illustrates an image forming apparatus that can carry out the image forming method of the present invention.

The main body of the image forming apparatus is provided side by side with a first image forming unit Pa, a second image forming unit Pb, a third image forming unit Pc and a fourth image forming unit Pd, and images with respectively different colors are formed on a transfer medium through the process of latent image formation, development and transfer.

Figure 4:
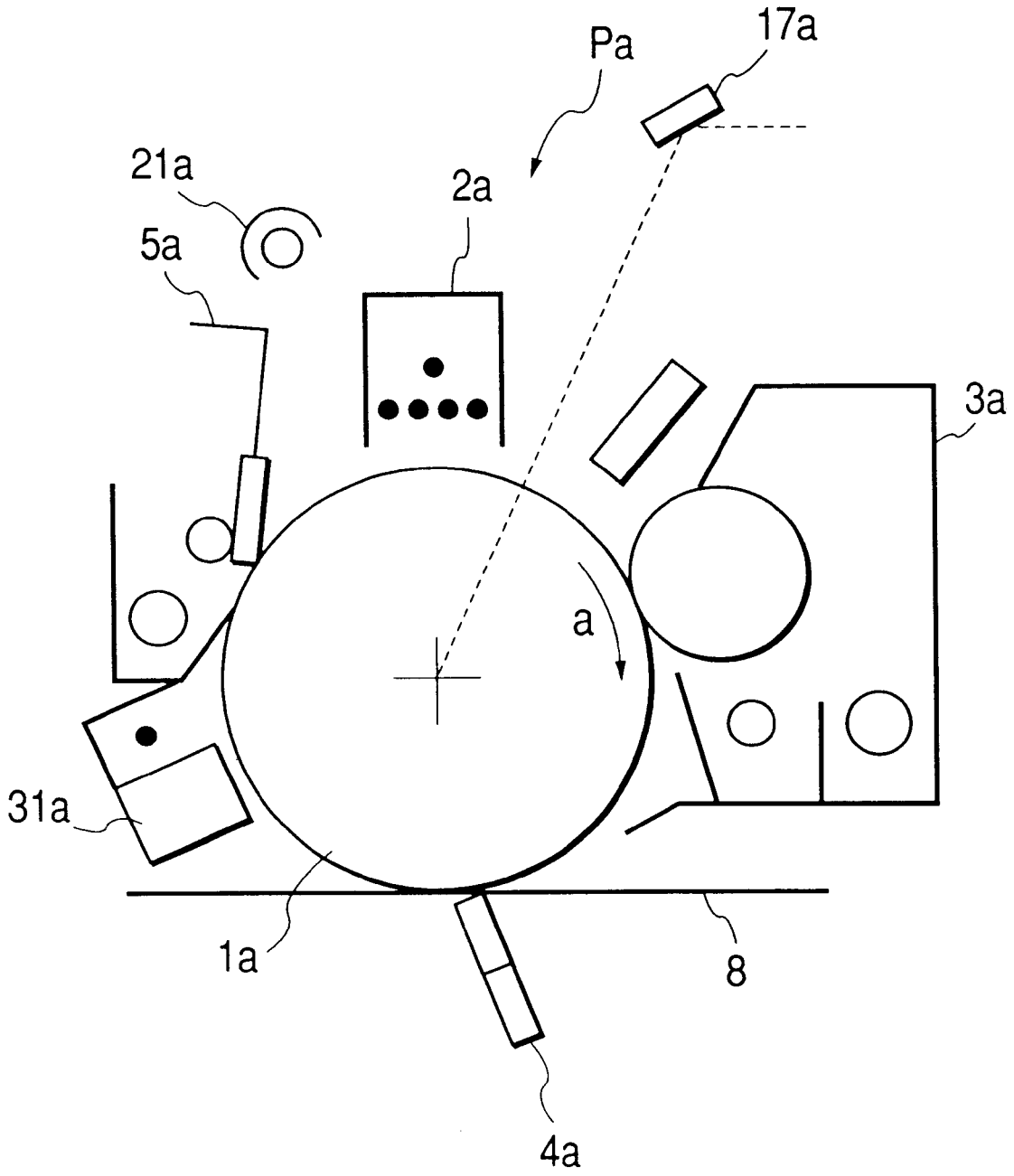
FIG. 4 schematically illustrates a part of the image forming apparatus shown in FIG. 3.

The respective image forming unit provided side by side in the image forming apparatus are each constituted as described below taking the first image forming unit Pa as shown in FIG. 4 as an example.

The first image forming unit Pa has an electrophotographic photosensitive drum 1*a* as a latent image bearing member. This photosensitive drum 1*a* is rotatingly moved in the direction of an arrow a. Reference numeral 2*a* denotes a primary charging assembly as a charging means, and a corona charging assembly is used which is in non-contact with the photosensitive drum 1*a*. Reference numeral 17*a* denotes a polygon mirror through which laser light is scanned rotatingly, serving as a latent image forming means for forming an electrostatic latent image on the photosensitive drum 1*a* whose surface has been uniformly charged by means of the primary charging assembly 2*a* Reference numeral 3*a* denotes a developing assembly as a developing means for developing the electrostatic latent image held on the photosensitive drum 1*a*, to form a color toner image, which holds a color toner. Reference numeral 4*a* denotes a transfer blade as a transfer means for transferring the color toner image formed on the surface of the photosensitive drum 1*a*, to the surface of a transfer medium 6 transported by a belt-like transfer medium carrying member 8. This transfer blade 4*a* comes into touch with the back of the transfer medium carrying member 8 and can apply a transfer bias.

Reference numeral 5*a* denotes a cleaning means for removing the color toner remaining on the surface of the photosensitive drum 1*a* after transfer. The cleaning means 5*a* has a cleaning blade coming into touch with the surface of the photosensitive drum 1*a* so as to remove the color toner, and a cleaner for collecting and holding the color toner thus removed. Reference numeral 21*a* denotes an erase exposure assembly as a charge elimination means for destatisizing the surface of the photosensitive drum 1*a*.

In this first image forming unit Pa, a photosensitive member of the photosensitive drum 1*a* is uniformly charged by the primary charging assembly 2*a*, and thereafter the electrostatic latent image is formed on the photosensitive member by the latent image forming means 17*a*. The electrostatic latent image is developed by the developing assembly 3*a* using a color toner. The toner image thus formed by development is transferred to the surface of the transfer medium 6 by applying transfer bias from the transfer blade 4*a* coming into touch with the back of the belt-like transfer medium carrying member 8 transporting the transfer medium b, at a first transfer zone (the position where the photosensitive member and the transfer medium come into contact).

The color toner present on the photosensitive member is removed from the surface of the photosensitive member by the cleaning blade of the cleaning means 5*a* and collected by the cleaner. The photosensitive member is destatisized by the erase exposure assembly 21*a*, and the above image forming process is again carried out.

In the image forming apparatus, the second image forming unit Pb, third image forming unit Pc and fourth image forming unit Pd, constituted in the same way as the first image forming unit Pa but having different color toners held in the developing assemblies are provided side by side as shown in FIG. 3. For example, a magenta toner is used in the first image forming unit Pa, a cyan toner in the second image forming unit Pb, a yellow toner in the third image forming unit Pc and a black toner in the fourth image forming unit Pd, and the respective color toners are successively transferred to the transfer medium at the transfer zones of the respective image forming units. In this course, the respective color toners are superimposed while making registration, on the same transfer medium during one-time movement of the transfer medium. After the transfer is completed, the transfer medium 6 is separated from the surface of the transfer medium carrying member 8 by a separation charging assembly 14, and then sent to a fixing assembly 7 by a transport means such as a transport belt, where a final full-color image is formed by only-one-time fixing.

The fixing assembly 7 has a fixing roller 71 and a pressure roller 72 in pair. The fixing roller 71 and the pressure roller 72 both have heating means 75 and 76, respectively. Reference numerals 73 and 74 each denote a web for removing any stains on the fixing roller and pressure roller; and 77, a coating roller as an oil application means for coating a releasing oil such as silicone oil on the surface of the fixing roller 71.

The unfixed color toner images transferred onto the transfer medium 6 are passed through the pressure contact area between the fixing roller 71 and. the pressure roller 72, whereupon they are fixed onto the transfer medium by the action of heat and pressure.

In FIG. 3, the transfer medium carrying member 8 is an endless belt-like member. This belt-like member is moved in the direction of an arrow e by a drive roller 10. Reference numeral 9 denotes a transfer belt cleaning device; 11, a belt follower roller; and 12, a belt charge eliminator. Reference numeral 13 denotes a pair of resist rollers for transporting to the transfer medium carrying member 8 the transfer medium 6 kept in the transfer medium holder 60. Reference numeral 17 denotes a polygon mirror. Through this polygon mirror, laser light emitted from a light source device (not shown) is scanned, where the scanning light whose light flux has been changed in direction by a reflecting mirror is shed on the generatrix of the photosensitive drum through an fθ lens to form latent images corresponding to image signals.

In the present invention, the charging means for primarily charging the photosensitive member may comprise a non-contact charging member that carries out charging in non-contact with the photosensitive member, as exemplified by a corona charging assembly, or a contact charging member that carries out charging in contact with the photosensitive member, as exemplified by a roller, a blade or a magnetic bruch, any of which may be used. In view of the advantage that the quantity of ozone generated at the time of charging can be controlled, it is preferable to use the contact charging member.

As the transfer means, the transfer blade coming into touch with the back of the transfer medium carrying member may be replaced with a contact transfer means that comes into contact with the back of the transfer medium carrying member and can directly apply a transfer bias, as exemplified by a roller type transfer roller.

The above contact transfer means may also be replaced with a non-contact transfer means that performs transfer by applying a transfer bias from a corona charging assembly provided in non-contact with the back of the transfer medium carrying member, as commonly used.

However, in view of the advantage that the quantity of ozone generated at the time of charging can be controlled, it is preferable to use the contact transfer means.

The non-magnetic toner of the present invention is used in the image forming unit having black toner in the above image forming apparatus, and is used to form color images or full-color images in combination with chromatic color toners or to form monochromatic images using black toner only.

In the above image forming apparatus, an image forming method is employed which is of the type the toner image formed on the latent image bearing member is directly transferred to the transfer medium without using any intermediate transfer member.

An image forming method in which the toner image formed on the latent image bearing member is firstly transferred to an intermediate transfer member and the toner image transferred to the intermediate transfer member is secondly transferred to the recording medium will be described below on an image forming apparatus shown in FIG. 5.

Figure 5:
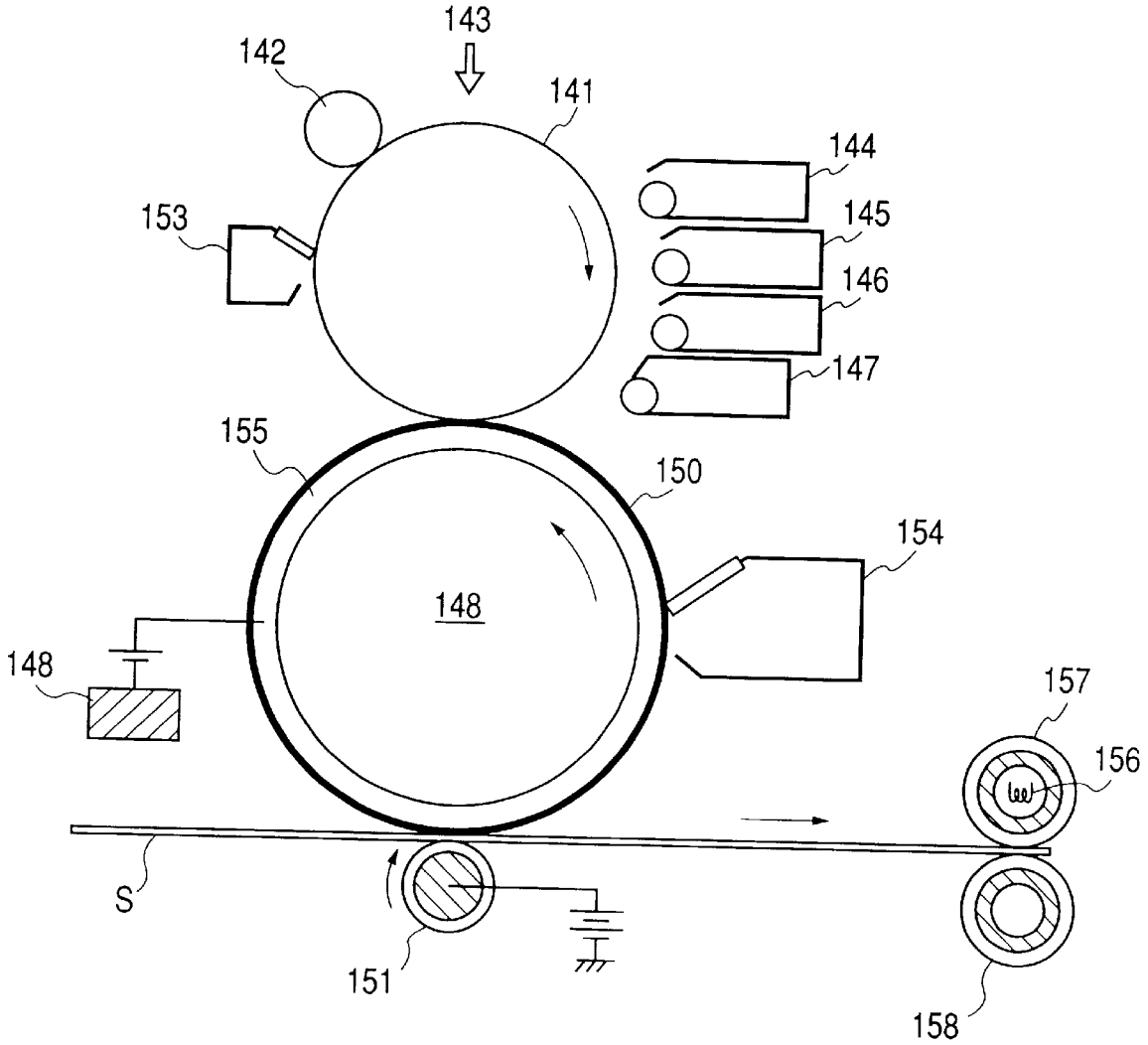
FIG. 5 schematically illustrates another image forming apparatus that can carry out the image forming method of the present invention.

In the apparatus shown in FIG. 5, the surface of a photosensitive drum 141 is made to have surface potential by a charging roller 142 set opposingly to the photosensitive drum 141 serving as the latent image bearing member and rotated in contact with it, and electrostatic latent images are formed by an exposure means 143. The electrostatic latent images are developed by developing assemblies 144, 145, 146 and 147 using four color toners, a magenta toner, a cyan toner, a yellow toner and a black toner, to form toner images. The toner images are transferred to an intermediate transfer member 148 for each color, and are repeatedly transferred several times to form a multiple toner image.

As the intermediate transfer member 148, a drum member is used, where a member on the periphery of which a holding member has been stuck, or a member comprising a substrate and provided thereon a conductivity-providing member such as an elastic layer in which carbon black, zinc oxide, tin oxide, silicon carbide or titanium oxide has been well dispersed may be used. A belt-like intermediate transfer member may also be used.

The intermediate transfer member 148 may preferably be constituted of an elastic layer 150 having a hardness of from 10 to 50 degrees (JIS K6301), or, in the case of a transfer belt, constituted of a support member 155 having an elastic layer 150 having this hardness at the transfer area where toner images are transferred to the transfer medium (recording medium).

To transfer toner images from the photosensitive drum 141 to the intermediate transfer member 148, a bias is applied from a power source 149 to a core metal 155 serving as a support member of the intermediate transfer member 148, so that transfer currents are formed and the toner images are transferred. Corona discharge from the back of the holding member or belt, or roller charging may be utilized.

The multiple toner image on the intermediate transfer member 148 is one-time transferred to the recording medium S by a transfer means 151. As the transfer means, a corona charging assembly or a contact electrostatic transfer means making use of a transfer roller or a transfer belt may be used.

The recording medium S having the toner image is sent to a heat fixing assembly having a fixing roller 157 as a fixing member having a heating element 156 in its inside and a pressure roller 158 coming into contact with this fixing roller 157, and is passed through a contact nip between the fixing roller 157 and the pressure roller 158, so that the toner image is fixed to the recording medium S.

The non-magnetic toner of the present invention is used as a black toner of any one of the developing assemblies 144, 145, 146 and 147 of the above image forming apparatus, and three chromatic color toners are used in the remaining three developing assemblies. Then, the non-magnetic toner of the present invention is used to form color images or full-color images in combination with chromatic color toners or to form monochromatic images using black toner only.

As described above, the non-magnetic toner of the present invention has a high coloring power, a superior charging performance, and can form good images. Also, in the process for producing non-magnetic toner particles of the present invention, when toner particles are produced by aqueous phase polymerization, toner particles having a superior and stable dispersibility of carbon black can be obtained and toner particles promising a high coloring power and a good charging performance can be produced.

The developing device useful in the present invention has a construction described below in detail by reference to a drawing.

The developing system in the present invention includes contact development systems in which a developer held by a developer holder is brought into contact with a photosensitive member surface at a development zone; and also non-contact jumping development systems in which a developer held. by a developer holder set apart from a photosensitive member is allowed to fly onto the surface of the photosensitive member at a development zone.

The contact development systems include a method employing a two-component developer comprising a toner and a carrier, and a method employing one component developer.

Figure 8:
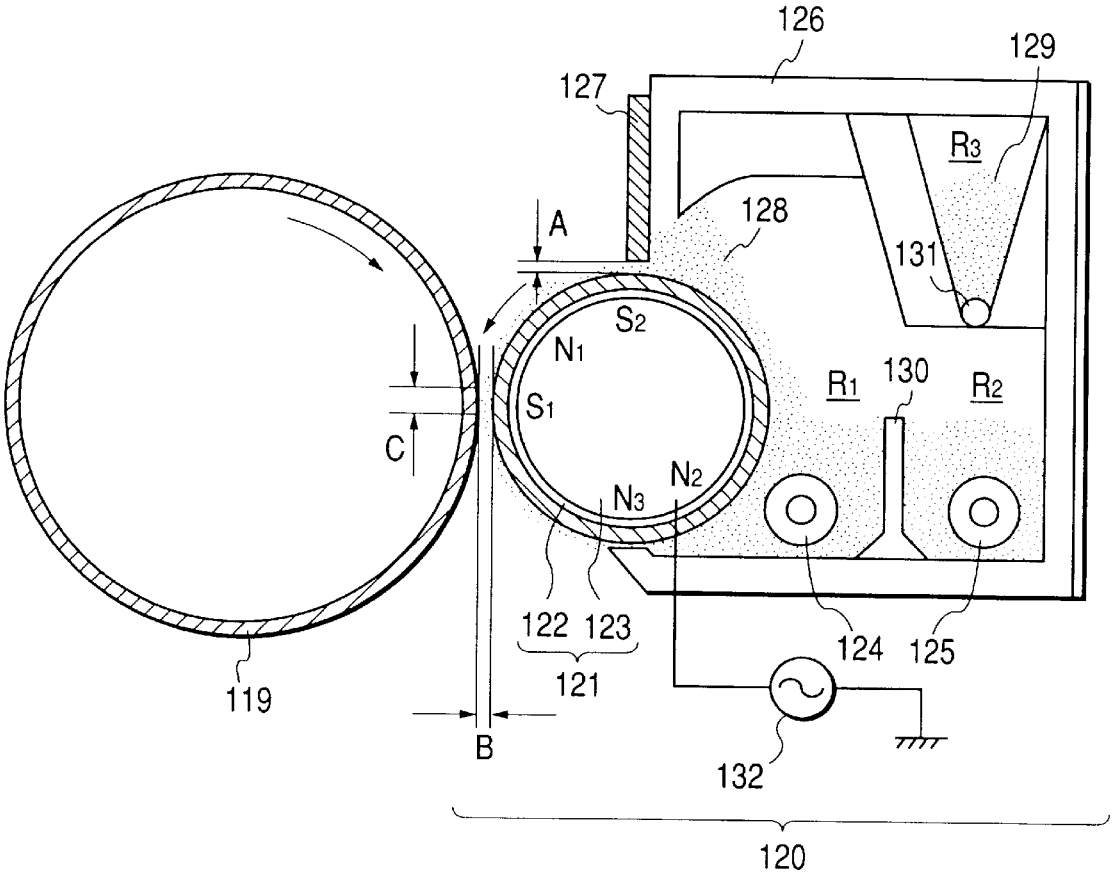
FIGS. 8, 9 and 10 schematically illustrate developing systems used in Examples.

The two-component contact development system conducts development with a two-component developer containing a toner and a carrier, for example, by means of a development apparatus 120 shown in FIG. 8.

The development apparatus 120 comprises a developer vessel 126 containing a two-component developer 128, a developing sleeve 121 as a developer holding member for holding the two-component developer 128 and feeding it to a development zone, and a development blade 127 as a means for controlling the thickness of the developer layer to control the thickness of the toner layer formed on the development sleeve 121. The development sleeve 121 has EL magnet 123 inside a non-magnetic sleeve base 122.

The inside of the developing vessel 126 is partitioned by a partitioning wall 130 into a development room (first room) $R_1$ and an agitation room (second room) $R_2$. Above the agitation room $R_2$, a toner storage room $R_3$ is provided apart from the partitioning wall 130. The developer 128 is stored in the development room $R_1$ and the agitation room $R_2$. A toner for replenishment (non-magnetic toner) 129 is stored in the toner storage room $R_3$. The toner storage room $R_3$ has a replenishing opening 131 for replenishing the toner 129 to the agitation room $R_2$ by gravity in an amount corresponding to the consumed toner.

A delivering screw 124 provided in the development room $R_1$ rotates to deliver the developer 128 in the development room $R_1$ in the direction of the length of the developing sleeve 121. Similarly, a delivery screw 125 provided in the storage room $R_2$ rotates to deliver the toner having fallen from the replenishing opening 131 to the agitation room $R_2$ in the direction of the length of the developing sleeve 121.

The developer 128 is a two-component developer composed of a non-magnetic toner and a magnetic carrier. An aperture is provided at the portion of the development vessel 126 near the photosensitive drum 119. From the aperture, the developing sleeve 121 protrudes outside. A gap is provided between the developing sleeve 121 and the photosensitive drum 119. A bias application means 132 is connected to the non-magnetic developing sleeve 121 to apply a bias.

The magnetic roller, namely a magnet 123, as a magnetic field-generating means fixed in the sleeve base 122 has a developing magnetic pole $S_1$, and a magnetic pole $N_3$, and magnetic poles $N_2$, $S_2$, and $N_1$ for delivery of the developer 128. The magnet 123 is placed in the sleeve base 122 such that the developing magnetic pole $S_1$ is placed in the counter position to the photosensitive drum 119. The developing magnetic pole $S_1$ generates a magnetic field near the development zone between the developing sleeve 121 and the photosensitive drum 119. The magnetic brush is formed by this magnetic field.

The controlling blade 127 placed above the developing sleeve 121 is made of a non-magnetic material such as aluminum and SUS316, and serves to control the layer thickness of the developer 128 on the development sleeve 121. The distance between the edge of the non-magnetic blade 127 and the surface of the developing sleeve 121 is preferably in the range of from 300 to 1000 $\mu$m, more preferably from 400 to 900 $\mu$m. The distance smaller than 300 $\mu$m causes problems of accumulation of the magnetic carrier therein, tending to result in irregularity in the developer layer and insufficient application of the developer, thus forming an irregular image with a low density. In order to prevent non-uniform application of the developer (or blade clogging) caused by unnecessary particles existing in the developer, the distance is preferably not less than 400 $\mu$m. The distance larger than 1000 $\mu$m will cause increase of the amount of the developer applied onto the developing sleeve 121 to make difficult the control of the development agent layer thickness, whereby the magnetic carrier particles attach to the photosensitive drum in a larger amount to prevent satisfactory circulation of the developer and the control of the development, tending to cause fogging of the image owing to insufficient triboelectricity of the toner.

With this development apparatus 120 employing a two-component type developer, the development is preferably conducted by application of AC voltage and by bringing the magnetic brush composed of the toner and the carrier into contact with the latent image holding member such as a photosensitive drum. The distance B between the developer holding member (developing sleeve) 121 and the photosensitive drum 119 (S-D distance) is preferably in the range of from 100 to 1000 $\mu$m to prevent the carrier adhesion and to improve the dot image reproducibility. With the distance shorter than 100 $\mu$m, the feed of the developer is liable to be insufficient resulting in low image density, while with the distance longer than 1000 μm, the magnetic force lines will diffuse to lower the density of the magnetic brush, causing poor dot reproducibility and carrier adhesion owing to the weak confining force for the carrier.

The peak to peak voltage of the alternating electric field ranges preferably from 500 to 5000 V, and the frequency thereof ranges preferably from 500 to 10000 Hz, more preferably from 500 to 3000 Hz. The voltage and the frequency are selected to be suitable for the process. The waveform of the alternating electric fields may be triangle, rectangle, or sine curve, or the one having a modified duty ratio. With the applied voltage lower than 500 V, sufficient image density cannot be achieved, and fogging in a non-image area can occur and toner recovery can be insufficient. With the applied voltage of higher than 50000 V, the electrostatic image is liable to be disturbed through the magnetic brush to deteriorate the image quality.

Use of a satisfactorily electrified two-component type developer reduces the fog-inhibiting voltage (Vback) and reduces the primary electrification of the photosensitive member, thereby lengthening the life of the photosensitive member. The Vback is preferably is not higher than 150 V, more preferably not higher than 100 V depending on the developing system.

The contrast potential ranges preferably from 200 to 500 V for sufficient image density.

When the frequency is lower than 500 Hz, charge injection to the carrier is liable to occur to disturb the latent image and lower the image quality. With the frequency higher than 10000 Hz, the toner cannot follow the electric field to cause low image quality.

For conducting the development to obtain sufficient image density with high dot reproducibility without carrier adhesion, the contact width (development nip C) of the magnetic brush on the developing sleeve 121 with the photosensitive drum 119 is preferably in the range of from 3 to 8 mm. With the development nip C of less than 3 mm, sufficient image density and satisfactory dot reproducibility cannot readily be achieved, while with the development nip C of larger than 8 mm, packing of the developer tends to occur to stop the machine or to render difficult the prevention of carrier adhesion. The development nip can be adjusted suitably by adjusting the distance A between the developer-controlling member 127 and the developing sleeve 121, or adjusting the distance B between the developing sleeve 121 and the photosensitive drum 119.

Figure 9:
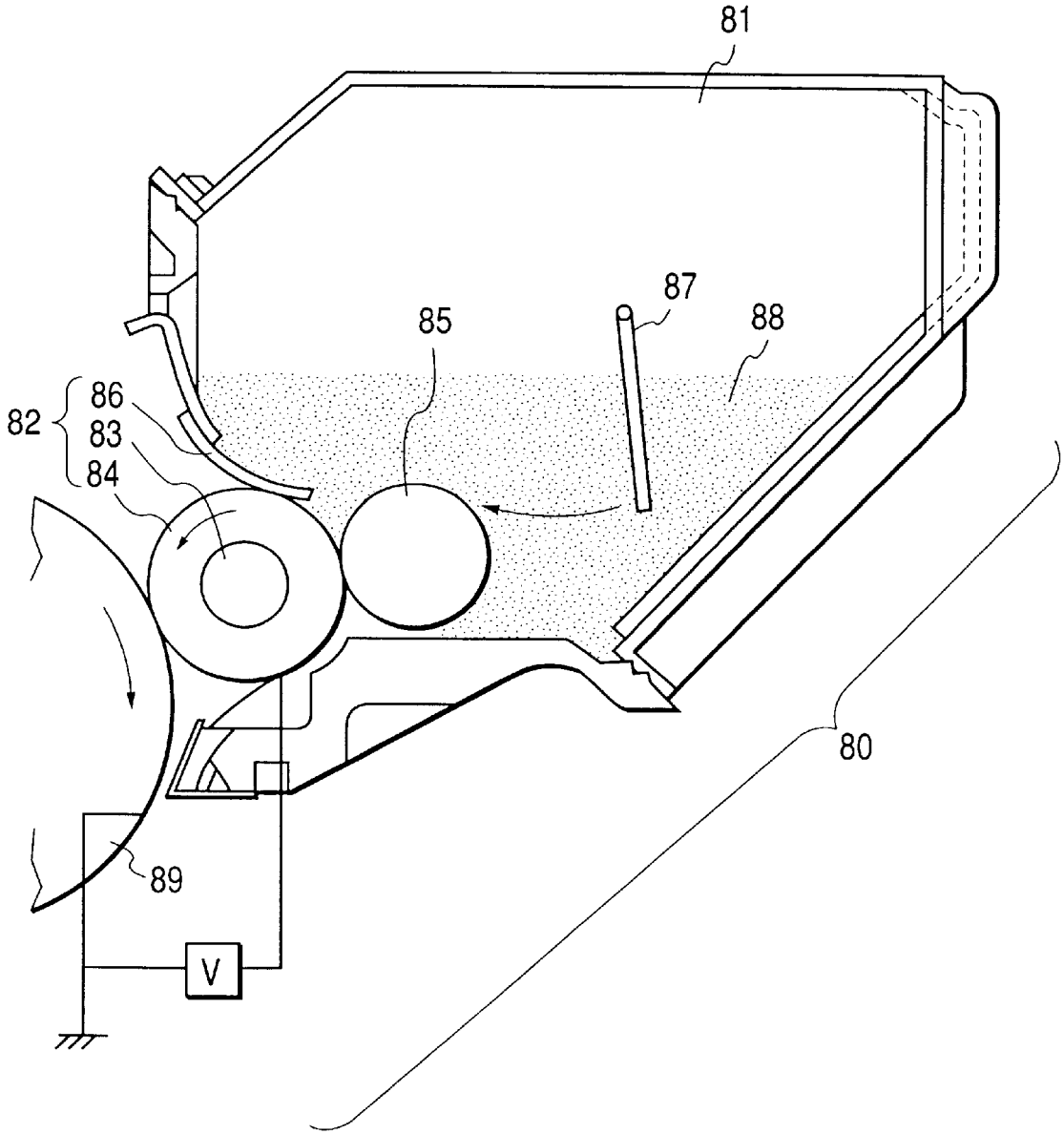

The contact development with a one-component developer can be conducted by using a non-magnetic toner, and by using, for example, a developing apparatus 80 shown in FIG. 9. The developing apparatus 80 comprises a development vessel 81 containing therein a one-component developer 88 comprised of a magnetic or non-magnetic toner, a developer holding member 82 for holding the one-component developer 88 contained in the development vessel 81 and delivering it to the developing zone. a feeding roller 85 for feeding the developer to the developer holding member, an elastic blade 86 as a member for controlling the thickness of the developer layer on the developer holding member, and an agitation member 87 for stirring the developer 88 in the development vessel 81. The developer holding member 82 is preferably an elastic roller comprising a base roller 83, and an elastic layer 84 formed thereon made of an elastic material such as an elastic rubber or resin (e.g. a foamed silicone rubber). The elastic roller 82 pressed to come into contact with the surface of the photosensitive drum 89 which is the latent image holder, develops a latent image formed on the photosensitive member with the one-component developer 88 present on the surface of the elastic roller, and at the same time it recovers the unnecessary one-component developer 88 remaining on the photosensitive member after the image transfer.

In this embodiment of the present invention, the developer holding member is substantially in contact with the surface of the photosensitive member. That is, even when the one-component developer is not present, the developer holding member is in contact with the photosensitive member. With this developer holding member, an image is obtained without the edge effect owing to the electric field exerting between the photosensitive member and the developer holding member through the developer, and simultaneously cleaning is conducted. The surface of the elastic roller as the developer holding member or vicinity thereof should have a certain level of electric potential, and an electric field needs to exist between the surfaces of the photosensitive member and the elastic roller. For this purpose, the elastic roller is prevented from its electrical conduction with the surface of the photosensitive member by controlling the resistance of the elastic rubber to a medium-resistance range, or a thin dielectric layer may be formed on the surface layer of the conductive roller. As the other constitution, it is also possible to provide a conductive roller with a conductive resin sleeve where the surface facing the photosensitive member is coated with an insulating material, or with an insulating sleeve having a conductive layer on its surface not facing the photosensitive member.

The elastic roller holding the one-component developer may be rotated in the same direction with the photosensitive member or in the reverse direction. When rotated in the same direction, the toner carrying member may preferably be rotated at a different peripheral speed from that of the photosensitive member, at a peripheral speed ratio of 100% or more. to that of the photosensitive member. If it is less than 100%, a problem occurs in image quality, such that the line sharpness is poor. As the peripheral speed ratio increases, the quantity of the toner fed to a developing zone increases and the toner more frequently comes off and on the latent image, where the toner is taken off at unnecessary areas and imparted to necessary areas, and this is repeated to obtain a toner image faithful to the latent image. More preferably, the peripheral speed ratio is not less than 110%.

The member 86 for controlling the developer layer thickness is not limited to the elastic blade, and may be an elastic roller of any other type of member which is capable of press-contact with elasticity with the surface of the developer holding member 82.

The elastic blade and the elastic roller may be made from a rubbery elastic material such as silicone rubbers, urethane rubbers, and NBR rubbers; elastic synthetic resin such as polyethylene terephthalates; and elastic metallic articles such as stainless steel and steel; and composites thereof.

When an elastic blade is employed, the blade is fixed at the upper edge portion thereof to the developer container, and the lower portion of the blade is bent in the normal or reverse direction of the developing sleeve against the blade elasticity with the inside (outside for reverse direction) blade face elastically pressed to the sleeve at an appropriate pressure.

The feeding roller 85 is produced from a foamed material like a polyurethane foam, and rotates in a normal or reversed direction (not a speed of zero) relative to the developer holding member, thereby feeding the one-component developer and scraping off the remaining developer after development (unused toner).

When an electrostatic latent image on the photosensitive member is developed with a one-component developer in the developing zone, a DC and/or AC bias is preferably applied between the developer holding member and the photosensitive drum.

Next, the non-contact jumping development system is explained below. In the non-contact jumping development system, there are a development system employing a one-component non-magnetic developer containing a non-magnetic toner.

A development system employing one-component non-magnetic developer containing a non-magnetic toner is explained below by reference to a schematic diagram shown in FIG. 10. The development apparatus 170 comprises a development vessel 171 containing a one-component non-magnetic developer 176 containing a member 172 for holding the one-component non-magnetic developer 176 and delivering it to the development region, a roller 173 for feeding the one-component non-magnetic developer onto the developer holding member, an elastic blade 174 as a member for controlling developer layer thickness on the developer holding member, and an agitating member 175 for agitating the one-component non-magnetic developer 176 in the development vessel 171.

A latent image is formed on a latent image holder 169 by an electrophotographic means or an electrostatic recording means not shown in the drawing. A development sleeve 172 is employed as the developer holder, which is a non-magnetic sleeve made of aluminum or stainless steel.

As the development sleeve, a drawn pipe of aluminum or stainless may be used without further processing. However, the surface is preferably roughened uniformly by blowing glass beads; mirror-polished; or coated with a resin.

The one-component non-magnetic developer 176 is stored in the development vessel 171, and is fed by the feeding roller 173 onto the developer holding member 172. The feeding roller 173 is made of a foamed material such as polyurethane foam, and rotates at a relative rotation speed of not zero in the same or reverse direction of the rotation of the developer holding member, thereby feeding the developer, and scraping off the developer not used for development from the developer holding member 172. The one-component non-magnetic developer fed onto the developer holding member 172 is applied in a uniform thin layer by the elastic blade 174.

The contact line pressure of the elastic application blade against the developer holding member preferably in the range of from 0.3 to 25 kg/m, more preferably from 0.5 to 12 kg/m along the generatrix direction of the development sleeve. With the contact pressure of lower than 0.3 kg/m, the application of the one-component non-magnetic developer becomes non-uniform to broaden the electrification distribution in the developer causing image fogging and scattering image. With the contact line pressure of higher than 25 kg/m, the developer is exposed to an excessively high pressure to cause deterioration and agglomeration of the developer, and thereby a larger torque is required for driving the developer holding member, disadvantageously. The contact pressure of from 0.3 to 25 kg/m enables effective disintegration of the aggregates of the one-component non-magnetic developer in the present invention, and instantaneous charge up of the one-component developer.

As to the control member for developer layer thickness, the material for the elastic blade and the elastic roller can be used and is selected from the materials having triboelectric characteristics suitable for electrifying the developer to the desired polarity. The suitable material includes silicone rubbers, urethane rubbers, and styrene-butadiene rubbers. Additionally, an organic resin layer may be formed thereon in the present invention, the organic resin including polyamides, polyimides, nylons, melamine resins, melamine-crosslinked nylons, phenol resins, fluororesins, silicone resins, polyester resins, urethane resins, and styrene resins. For an appropriate electroconductivity and suitable properties for electrifying non-contacting one-component developer, the elastic blade or the roller, which is made of an electroconductive rubber or resin, may contain in the rubber, a filler or a charge-controlling agent such as metal oxides, carbon black, inorganic whiskers, and inorganic fibers.

In formation of the thin layer of one-component non-magnetic developer on the developing sleeve by means of a blade in the one-component non-magnetic developing system, preferably the layer thickness of the developer is controlled to be smaller than the gap β between the development sleeve and the latent image holding member and an AC voltage is applied to the gap in order to obtain a sufficient image density. Specifically, as shown in FIG. 10, an AC field or a AC-DC superposition field is applied as a development bias from the bias source 177 between the development sleeve 172 and the latent image-holding member 169 to facilitate the transfer of the one-component non-magnetic developer from the development sleeve to the latent image-holding member.

EXAMPLES

The present invention will be described below in greater detail by giving a specific toner production process, Examples and Comparative Examples.

Examples 1 to 8 & Comparative Examples 1 to 8

(Preparation of Masterbatch Dispersions 1 to 17)

As shown in Table 2 below, to 2,000 g of styrene monomer, carbon black a to h and dispersants were respectively added in the combination of the type and amount shown in Table 2, which were then put into Attritorl 1S (manufactured by Mitsui Mining Co., Ltd.) making use of zirconia beads of 2 mm diameter, and stirred at 200 rpm at a temperature of 25° C. for 180 minutes to prepare masterbatch dispersions (fluid dispersions) 1 to 17 comprising the styrene monomer with the carbon black and azo type iron compound dispersed therein.

Values of physical properties of the carbon black used are shown in Table 1 below.

TABLE 1

| Carbon black No. | Particle diameter (mμ) | Specific surface area ($m^2/g$) | DBP oil absorption (ml/100 g) | Volatile component (%) |
|---|---|---|---|---|
| a | 40 | 50 | 140 | 1.5 |
| b | 27 | 80 | 123 | 0.9 |
| c | 26 | 90 | 50 | 1.0 |
| d | 26 | 130 | 110 | 1.0 |
| e | 18 | 265 | 120 | 1.2 |
| f | 28 | 90 | 99 | 3.0 |
| g | 56 | 45 | 45 | 0.6 |
| h | 66 | 28 | 66 | 1.0 |

TABLE 2

Masterbatch Formulation

| Masterbatch dispersion No. | Amount of styrene monomer (g) | Type of carbon black | Amount A of carbon black (g) | Dispersant | Amount B of dispersant (g) | A/B | Viscosity (cPs) |
|---|---|---|---|---|---|---|---|
| 1 | 2,000 | a | 300 | Azo type iron compound (1) | 40 | 7.5 | 510 |
| 2 | 2,000 | a | 300 | Azo type iron compound (1) | 80 | 3.75 | 250 |
| 3 | 2,000 | a | 300 | Azo type iron compound (1) | 20 | 15.0 | 400 |
| 4 | 2,000 | b | 300 | Azo type iron compound (2) | 40 | 7.5 | 660 |
| 5 | 2,000 | a | 300 | Azo type iron compound (7) | 40 | 7.5 | 480 |
| 6 | 2,000 | a | 300 | Azo type iron compound (8) | 40 | 7.5 | 500 |
| 7 | 2,000 | a | 300 | Azo type iron compound (1) | 100 | 3.0 | 90 |
| 8 | 2,000 | a | 300 | Azo type iron compound (1) | 7.5 | 40.0 | 110 |
| 9 | 2,000 | a | 300 | — (not used) | — | — | 10 |
| 10 | 2,000 | c | 300 | Azo type iron compound (1) | 40 | 7.5 | 120 |
| 11 | 2,000 | d | 300 | Azo type iron compound (1) | 40 | 7.5 | 560 |
| 12 | 2,000 | e | 300 | Azo type iron compound (1) | 40 | 7.5 | —*1 |
| 13 | 2,000 | f | 300 | Azo type iron compound (1) | 40 | 7.5 | 200 |
| 14 | 2,000 | g | 300 | Azo type iron compound (1) | 40 | 7.5 | 160 |
| 15 | 2,000 | h | 300 | Azo type iron compound (1) | 40 | 7.5 | 100 |
| 16 | 2,000 | i | 300 | Azo type chromium compound of the formula shown below*2 | 40 | 7.5 | 120 |
| 17 | 2,000 | j | 300 | Zinc compound of di-tert-butylsalicylic acid | 40 | 7.5 | 100 |

*1 No. 12 had too high a masterbatch viscosity to be taken out normally, and was unusable.
*2 Azo type chromium compound:

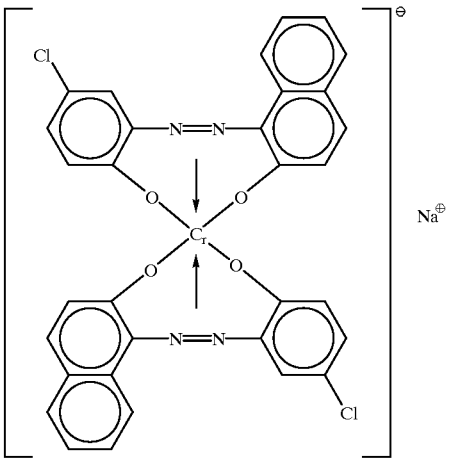

Preparation of Toners A to P)

Into 710 g of ion-exchanged water, 450 g of an aqueous 0.1 M $Na_3PO_4$ solution was introduced, followed by heating to 60° C. and thereafter stirring at 12,000 rpm using a TK-type homomixer (manufactured by Tokushukika Kogyo). Then, 68 g of an aqueous 1.0 M $CaCl_2$ solution was added thereto little by little to obtain an aqueous medium containing $Ca_3(PO_4)_2$.

Next, materials formulated as shown in Table 3 were heated to 60° C., and then stirred to uniformly dissolve or dispersed them. To the mixture obtained, 10 g of a polymerization initiator 2,2'-azobis(2,4-dimethylvaleronitrile) was added to prepare a polymerizable monomer composition.

Then, the above polymerizable monomer composition was introduced into the aqueous medium previously prepared, followed by stirring using the TK-type homomixer at 10,000 rpm for 10 minutes, at 60° C. in an atmosphere of $N_2$ to granulate the polymerizable monomer composition. Thereafter, its temperature was raised to 80° C. while stirring by means of a paddle stirring blade, to carry out reaction for 10 hours. After the polymerization reaction was completed, residual monomers were removed under reduced pressure, followed by cooling, and thereafter hydrochloric acid was added to dissolve calcium phosphate, followed by filtration, washing water and drying to obtain black toner particles.

To 98.5 parts by weight of the respective black toner particles thus obtained, 1.5% by weight of hydrophobic silica having a specific surface area of 200 $m^2/g$ as measured by the BET method was externally added, to obtain suspension polymerization black toners A to P.

As the saturated polyester resin added when the polymerizable monomer composition is prepared, a polyester resin was used which was obtained by condensation of propoxylated bisphenol with terephthalic acid, having Mw of 11,000, Mw/Mn of 2.1 and an acid value of 10.

Formulation and various physical properties of the toners A to P obtained are shown in Table 3 [3(A)–3(B)].

TABLE 3(A)

Toner Formulation

| Toner | Formulation: Masterbatch Type | Masterbatch Amount (g) | Amount of: Styrene monomer (g) | n-Butyl acrylate monomer (g) | Saturated polyester resin (g) | Ester wax (m.p. 75° C.) (g) | Content of: Carbon black (wt. %) | Azo type iron comp. (wt. %) | Saturated polyester Resin (wt. %) | Ester wax (wt. %) |
|---|---|---|---|---|---|---|---|---|---|---|
| A | 1 | 117.0 | 66.0 | 34.0 | 10.0 | 30.0 | 5.8 | 0.8 | 3.9 | 11.7 |
| B | 2 | 119.0 | 66.0 | 34.0 | 10.0 | 30.0 | 5.8 | 1.5 | 3.9 | 11.6 |
| C | 3 | 116.0 | 66.0 | 34.0 | 10.0 | 30.0 | 5.8 | 0.4 | 3.9 | 11.7 |
| D | 4 | 117.0 | 66.0 | 34.0 | 10.0 | 30.0 | 5.8 | 0.8 | 3.9 | 11.7 |
| E | 5 | 117.0 | 66.0 | 34.0 | 10.0 | 30.0 | 5.8 | 0.8 | 3.9 | 11.7 |
| F | 6 | 117.0 | 66.0 | 34.0 | 10.0 | 30.0 | 5.8 | 0.8 | 3.9 | 11.7 |
| G | 7 | 120.0 | 66.6 | 34.0 | 10.0 | 30.0 | 6.5 | 2.2 | 4.3 | 13.0 |
| H | 8 | 115.4 | 66.0 | 34.0 | 10.0 | 30.0 | 6.7 | 0.2 | 4.4 | 13.3 |
| I | 9 | 115.0 | 66.0 | 34.0 | 10.0 | 30.0 | 5.9 | 0 | 3.9 | 11.8 |
| J | 10 | 117.0 | 66.0 | 34.0 | 10.0 | 30.0 | 5.8 | 0.8 | 3.9 | 11.7 |
| K | 11 | 117.0 | 66.0 | 34.0 | 10.0 | 30.0 | 5.8 | 0.8 | 3.9 | 11.7 |
| L | 13 | 117.0 | 66.0 | 34.0 | 10.0 | 30.0 | 5.8 | 0.8 | 3.9 | 11.7 |
| M | 14 | 117.0 | 66.0 | 34.0 | 10.0 | 30.0 | 5.8 | 0.8 | 3.9 | 11.7 |
| N | 15 | 117.0 | 66.0 | 34.0 | 10.0 | 30.0 | 5.8 | 0.8 | 3.9 | 11.7 |
| O | 16 | 117.0 | 66.0 | 34.0 | 10.0 | 30.0 | 5.8 | 0.8 | 3.9 | 11.7 |
| P | 17 | 117.0 | 66.0 | 34.0 | 10.0 | 30.0 | 5.8 | 0.8 | 3.9 | 11.7 |

TABLE 3(B)

Physical Properties

| Toner | Toner particles: Weight average particle diameter (μm) | % by number of 40 μm or smaller particles | % by volume of 10.1 μm or larger particles | Saturation magnetization of toner ($Am^2/kg$) | Volume resistivity of toner ($\Omega \cdot cm$) | Particle size distribution by GPC of resin component in toner particles: Mw | Mw/Mn |
|---|---|---|---|---|---|---|---|
| A | 6.5 | 10.5 | 0.4 | 0 | $3 \times 10^{14}$ | $1.4 \times 10^5$ | 8.5 |
| B | 6.3 | 11.2 | 0.2 | 0 | $4 \times 10^{14}$ | $1.7 \times 10^5$ | 9.0 |
| C | 7.0 | 11.5 | 0.5 | 0 | $3 \times 10^{14}$ | $1.6 \times 10^5$ | 8.3 |
| D | 6.9 | 11.8 | 0.4 | 0 | $7 \times 10^{13}$ | $1.2 \times 10^5$ | 7.6 |
| E | 6.6 | 12.5 | 0.8 | 0 | $2 \times 10^{14}$ | $1.3 \times 10^5$ | 7.9 |
| F | 6.7 | 13.2 | 0.9 | 0 | $3 \times 10^{14}$ | $1.2 \times 10^5$ | 7.5 |
| G | 6.6 | 19.5 | 1.3 | 0 | $8 \times 10^{13}$ | $1.0 \times 10^5$ | 7.0 |
| H | 6.8 | 18.2 | 1.2 | 0 | $9 \times 10^{13}$ | $1.1 \times 10^5$ | 7.8 |
| I | 6.8 | 25.7 | 0.3 | 0 | $3 \times 10^{13}$ | $1.2 \times 10^5$ | 6.8 |
| J | 6.5 | 21.2 | 0.5 | 0 | $2 \times 10^{13}$ | $1.3 \times 10^5$ | 6.9 |
| K | 6.8 | 25.2 | 1.6 | 0 | $5 \times 10^{12}$ | $1.4 \times 10^5$ | 7.2 |
| L | 6.9 | 24.1 | 2.2 | 0 | $7 \times 10^{12}$ | $1.5 \times 10^5$ | 7.5 |
| M | 6.7 | 16.3 | 0.5 | 0 | $7 \times 10^{13}$ | $1.5 \times 10^5$ | 8.7 |
| N | 6.8 | 19.8 | 0.5 | 0 | $9 \times 10^{13}$ | $1.7 \times 10^5$ | 7.6 |
| O | 6.6 | 27.2 | 0.9 | 0 | $6 \times 10^{12}$ | $1.5 \times 10^5$ | 5.7 |
| P | 6.7 | 25.6 | 1.3 | 0 | $7 \times 10^{12}$ | $1.3 \times 10^5$ | 4.8 |

(Evaluation of Toner)

The above toners were evaluated in the following way.

(1) Production stability was evaluated to examine whether or not coalescence or agglomeration of toners occur during their production.

Evaluated on the basis of the % by volume of toner particles with diameters of 10.1 μm or larger.

Evaluated according to the following evaluation criteria.

Rank 1: Not more than 0.5% by volume

Rank 2: More than 0.5% by volume to 1.0% by volume

Rank 3: More than 1.0% by volume to 1.5% by volume

Rank 4: More than 1.5% by volume to 2.0% by volume

Rank 5: More than 2.0% by volume (2) Charging performance of toner particles were evaluated.

Using a mixture prepared by mixing 5 parts by weight of toner particles available before the external addition of hydrophobic silica and 95 parts by weight of acryl-coated ferrite carrier, the charge quantity of toner particles was measured by the following measuring method.

Figure 7:
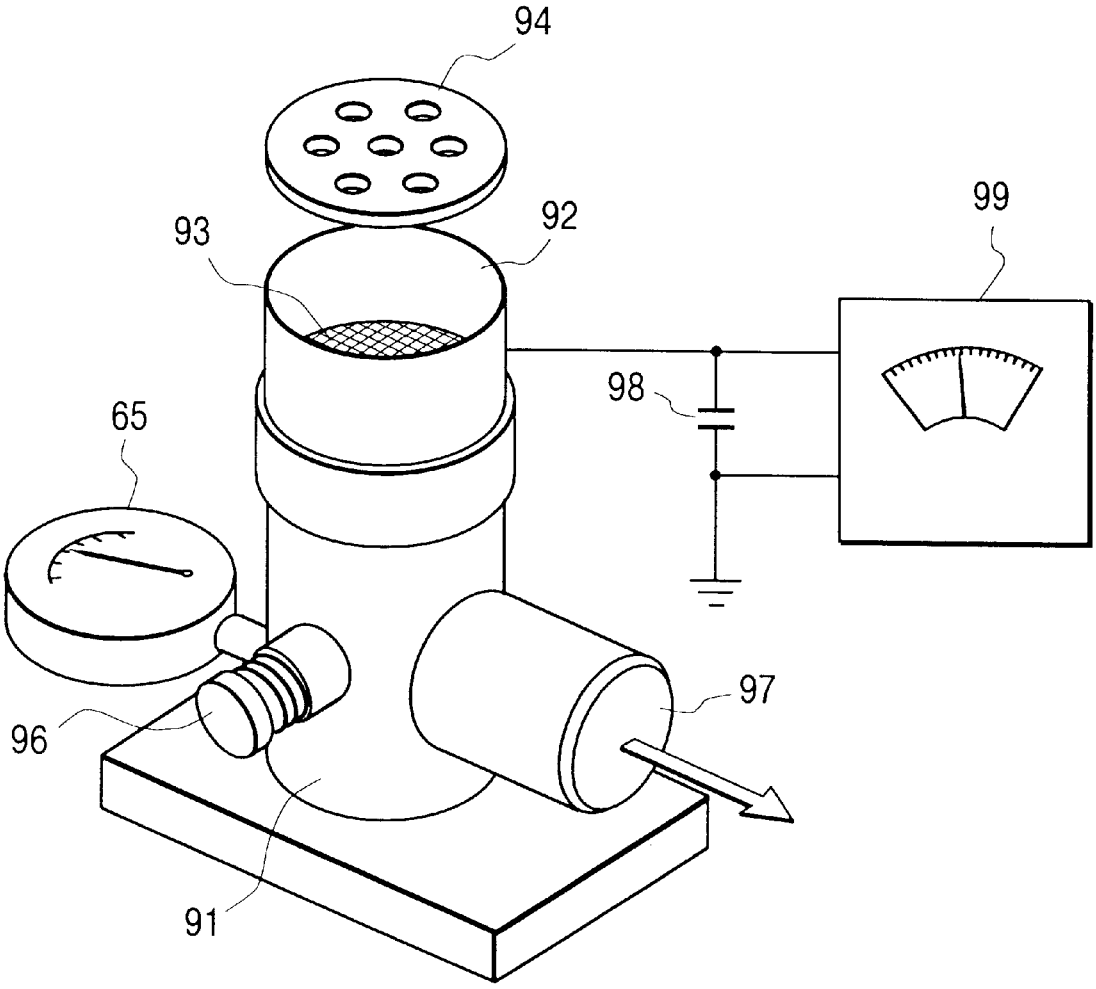
FIG. 7 schematically illustrates a device used to measure the charge quantity of toner particles.

A method of measuring the charge quantity of toner particles in the present invention will be described below with reference to FIG. 7.

In an environment of 23° C. and relative humidity of 60%, the mixture of carrier and toner particles, prepared as described above, is put in a polyethylene bottle of 50 to 100 ml volume, followed by manual shaking 50 times. Next, 1.0 to 1.2 g of the above mixture is put in a measuring container 92 made of a metal at the bottom of which is provided a screen 93 of 500 meshes, and the container is covered with a plate 94 made of a metal. The total mass of the measuring container 92 in this state is weighed and is expressed by $W_1$ (g). Next, in a suction device 91 (made of an insulating material at least at the part coming into contact with the measuring container 92), air is sucked from a suction opening 97 and an air-flow control valve 96 is operated to control the pressure indicated by a vacuum indicator 95 to be 2,450 hPa (250 mmAq). In this state, suction is carried out for 1 minute to remove the toner by suction. The potential indicated by a potentiometer 99 at this time is expressed by V (volt). Reference numeral 98 denotes a capacitor, whose capacitance is expressed by C ($\mu$F). The total mass of the measuring container after completion of the suction is also weighed and is expressed by $W_2$ (g). The quantity Q (mC/kg) of triboelectricity is calculated as shown by the following equation. Quantity of triboelectricity:

$$(\text{mC/kg})=CV/(W_1-W_2)$$

(3) Evaluation was made on images formed using the non-magnetic toner.

Using as an image forming apparatus the apparatus constituted as shown in FIG. 3 and in which a developing system as shown in FIG. 8 is employed in the developing assembly 3*d* of the fourth image forming unit Pd, black toner monochromatic solid black images were formed using the non-magnetic toners produced as described above, to make evaluation. As an evaluation item, the weight per unit area of the toner necessary for giving an image density of 1.2 was measured to evaluate coloring power according to the following evaluation criteria.

Rank 1: From 0.40 mg/cm$^2$ to less than 0.45 mg/cm$^2$
Rank 2: From 0.45 mg/cm$^2$ to less than 0.50 mg/cm$^2$
Rank 3: From 0.50 mg/cm$^2$ to less than 0.60 mg/cm$^2$
Rank 4: From 0.60 mg/cm$^2$ to less than 0.70 mg/cm$^2$
Rank 5: 0.70 mg/cm$^2$ or more Results of evaluation are shown in Table 4.

TABLE 2

| | Evaluation Results | | | | |
|---|---|---|---|---|---|
| | Toner | (1) Production stability | (2) Charge quantity (mC/kg) | (3) Coloring power (mg/cm$^2$) | Remarks |
| Example: | | | | | |
| 1 | A | 1 | −31 | 1 (0.42) | |
| 2 | B | 1 | −29 | 1 (0.41) | |
| 3 | C | 1 | −30 | 1 (0.42) | |
| 4 | D | 1 | −28 | 1 (0.40) | |
| 5 | E | 2 | −26 | 2 (0.46) | |
| 6 | F | 2 | −25 | 2 (0.47) | |
| 7 | G | 3 | −20 | 3 (0.52) | |
| 8 | H | 3 | −18 | 3 (0.53) | |
| Comparative Example: | | | | | |
| 1 | I | 1 | −10 | 4 (0.65) | |
| 2 | J | 1 | −15 | 4 (0.60) | |
| 3 | K | 4 | −14 | 3 (0.59) | |
| 4 | L | 5 | — | — | Coalesced and agglomerated during production of toner particles, and unable to be taken out. |
| 5 | M | 1 | −11 | 5 (0.71) | |
| 6 | N | 1 | −12 | 5 (0.75) | |
| 7 | O | 2 | −25 | 4 (0.63) | |
| 8 | P | 3 | −23 | 4 (0.61) | |

(Magenta Toner Production Example)

The procedure of Example 1 was repeated except that the carbon black and the azo type iron compound were replaced with a quinacridone pigment and an aluminum compound of di-tert-butylsalicylic acid, respectively. Thus, magenta toner 1 with a weight average particle diameter of 6.5 $\mu$m was obtained.

(Cyan Toner Production Example)

The procedure for the production of the magenta toner was repeated except that the quinacridone pigment was replaced with a ⅔-fold amount of a phthalocyanine pigment. Thus, cyan toner 1 with a weight average particle diameter of 6.6 $\mu$m was obtained.

(Yellow Toner Production Example)

The procedure for the production of the magenta toner was repeated except that the quinacridore pigment was replaced with a yellow pigment. Thus, yellow toner 1 with a weight average particle diameter of 6.7 $\mu$m was obtained.

Example 9

Using as an image forming apparatus the apparatus constituted as shown in FIG. 3 and in which a developing system as shown in FIG. 9 is employed in the developing assemblies 3*a*, 3*b*, 3*c* and 3*d* of the first image forming unit Pa, the second image forming unit Pb, the third image forming unit Pc and the fourth image forming unit Pd, respectively, the magenta toner 1, the cyan toner 1, the yellow toner 1 and as a black toner the non-magnetic toner A produced as described above were used in the developing assemblies 3*a*, 3*b*, 3*c* and 3*d*, respectively, to form full-color images.

As the result, full-color images free of fog, having a high image density and having a sharp color reproducibility were formed.

Example 10

Figure 10:
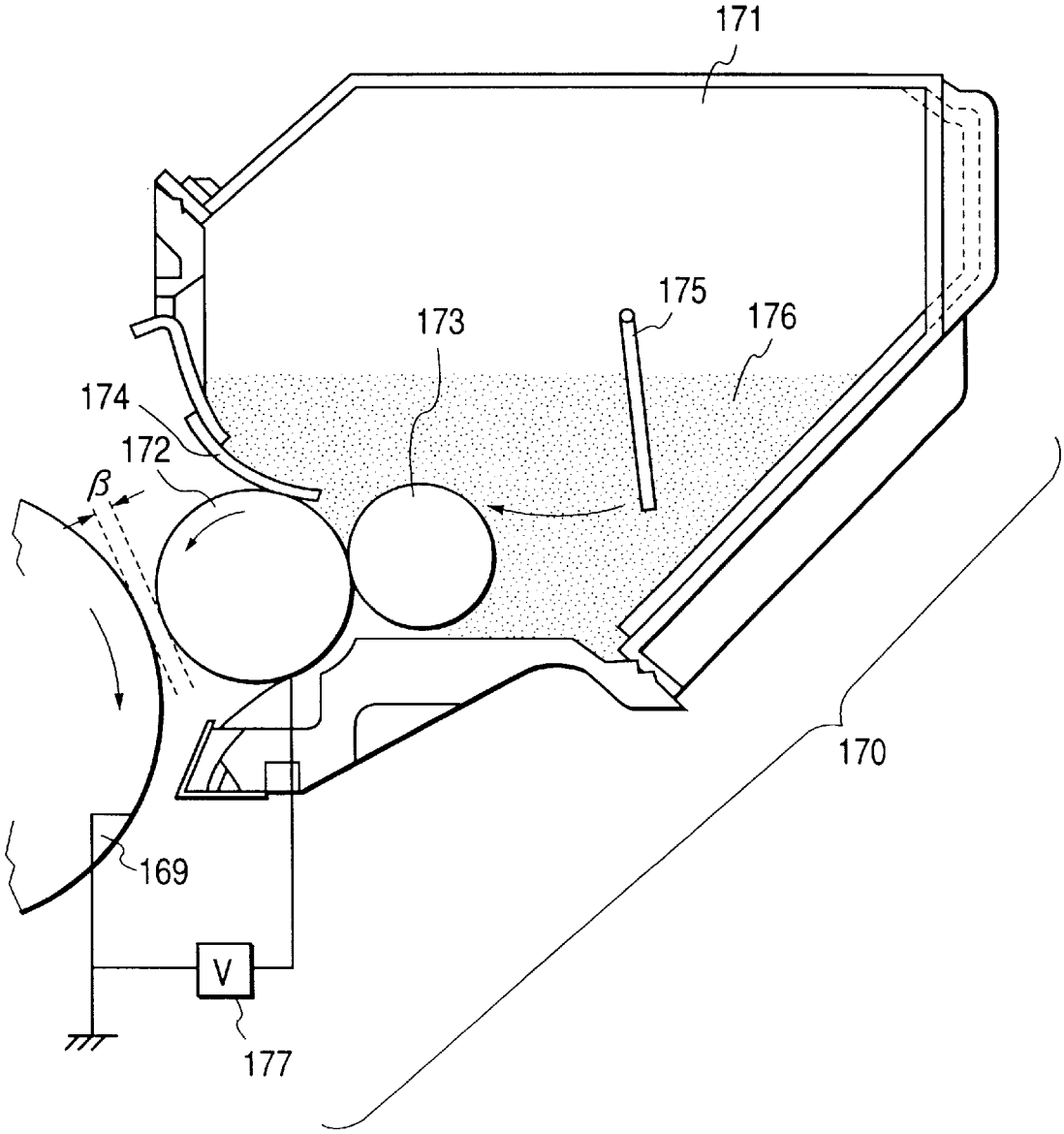

Using as an image forming apparatus the apparatus constituted as shown in FIG. 5 and in which a developing system as shown in FIG. 10 is employed in the developing assemblies 144, 145, 146 and 147, the magenta toner 1, the cyan toner 1, the yellow toner 1 and as a black toner the non-magnetic toner A produced as described above were used in the developing assemblies 144, 145, 146 and 147, respectively, to form full-color images.

As the result, full-color images free of toner scatter (spots around images) or the like and having a superior line-image reproducibility were formed also when the intermediate transfer member was used.

What is claimed is:

1. A non-magnetic toner for developing an electrostatic image, comprising non-magnetic toner particles produced by polymerizing in an aqueous medium a polymerizable monomer composition containing at least a polymerizable monomer, a carbon black and an azo iron compound, wherein;

said carbon black has a DPB oil absorption of from 110 ml/100 g to 200 ml/100 g, a specific surface area of 100 $m^2/g$ or below as measured by nitrogen adsorption, a volatile component of 2% or less and an average primary particle diameter of from 25 mμ to 45 mμ; and said azo iron compound comprises a compound represented by the following Formula (1):

Formula (1)

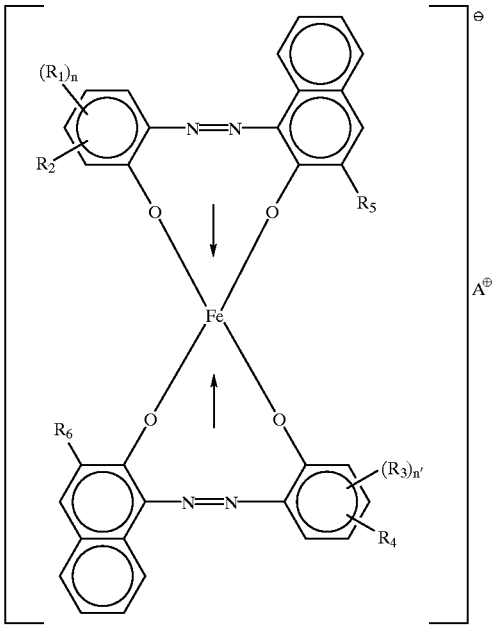

wherein $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ are the same or different; n and n' each represent an integer of 1 to 3; $R_2$ and $R_4$ are each represent a member selected from the group consisting of a hydrogen atom and a nitro group, and $R_2$ and $R_4$ are the same or different; $R_5$ and $R_6$ each represent a member selected from the group consisting of a hydrogen atom, a halogen atom, a nitro group, a carboxyl group, an anilide group, an alkyl group having 1 to 18 carbon atoms, an alkenyl group, an aralkyl group, an alkoxyl group, a aryl group, a carboxylate group and a

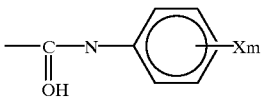

group, where X represents a member selected from the group consisting of a hydrogen atom, a lower alkyl group, a lower alkoxyl group, a nitro group and a halogen atom and m represents an integer of 1 to 3, and $R_5$ and $R_6$ are the same or different; and $A^+$ represents a member selected from the group consisting of a hydrogen ion, a sodium ion, a potassium ion, an ammonium ion and a mixture of any of these.

2. The non-magnetic toner according to claim 1, wherein said carbon black has a DPB oil absorption of from 120 ml/100 g to 180 ml/100 g.

3. The non-magnetic toner according to claim 1, wherein said carbon black has a specific surface area of from 30 $m^2/g$ to 90 $m^2/g$ as measured by nitrogen adsorption.

4. The non-magnetic toner according to claim 1, wherein said carbon black has a volatile component of from 0.1% to 1.8%.

5. The non-magnetic toner according to claim 1, wherein said toner particles have the carbon black in a content A (% by weight) and the azo iron compound in a content B (% by weight), and the content A and content B satisfy the following relationship:

$$3 \leqq A/B \leqq 50$$

6. The non-magnetic toner according to claim 1, wherein said toner particles have the carbon black in a content A (% by weight) and the azo iron compound in a content B (% by weight), and the content A and content B satisfy the following relationship:

$$3 \leqq A/B \leqq 38$$

7. The non-magnetic toner according to claim 1, wherein said toner particles have the carbon black in a content A of from 2% by weight to 20% by weight.

8. The non-magnetic toner according to claim 1, wherein said toner particles have the carbon black in a content A of from 3% by weight to 15% by weight.

9. The non-magnetic toner according to claim 1, wherein said toner particles have the azo iron compound in a content B of from 0.1% by weight to 3.0% by weight.

10. The non-magnetic toner according to claim 1, wherein said toner particles have the azo iron compound in a content B of from 0.3% by weight to 2.0% by weight.

11. The non-magnetic toner according to claim 1, wherein the X in Formula (1) represents a member selected from the group consisting of a hydrogen atom, an alkyl group having 1 to 18 carbon atoms, an alkoxyl group having 1 to 18 carbon atoms, a nitro group and a halogen atom.

12. The non-magnetic toner according to claim 1, wherein said azo iron compound comprises a compound represented by the following Formula (2):

Formula (2)

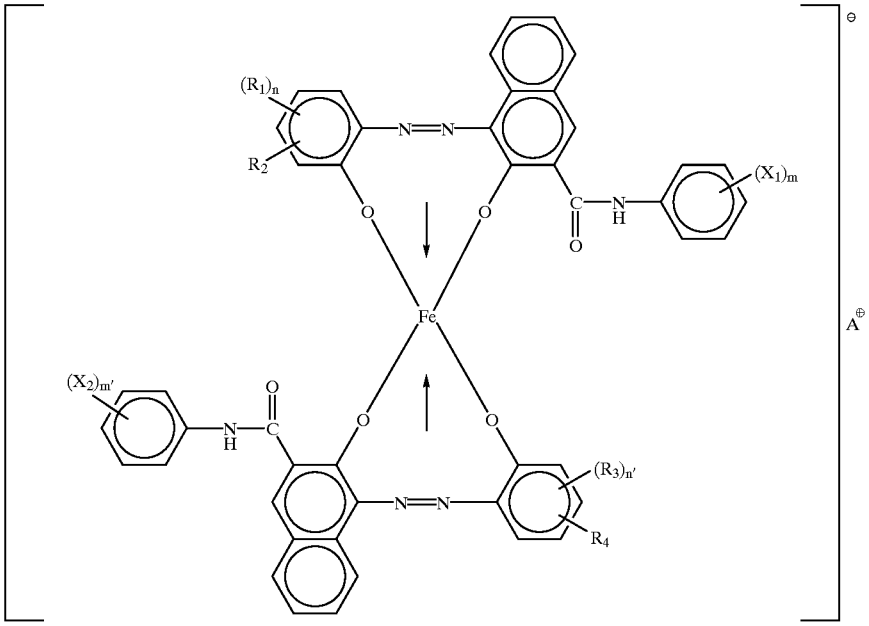

wherein $X_1$ and $X_2$ each represent a member selected from the group consisting of a hydrogen atom, a lower alkyl group, a lower alkoxyl group, a nitro group and a halogen atom, and $X_1$ and $X_2$ are the same or different; m and m' each represent an integer of 1 to 3; $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ are the same or different; n and n' each represent an integer of 1 to 3; $R_2$ and $R_4$ each represent a member selected from the group consisting of a hydrogen atom and a nitro group; and $A^+$ represents a hydrogen ion, a sodium ion, a potassium ion, an ammonium ion and a mixture of any of these.

13. The non-magnetic toner according to claim 12, wherein the $X_1$ and $X_2$ in Formula (2) each represent a member selected from the group consisting of a hydrogen atom, an alkyl group having 1 to 18 carbon atoms, an alkoxyl group having 1 to 18 carbon atoms, a nitro group and a halogen atom.

14. The non-magnetic toner according to claim 1, wherein said azo iron compound comprises any one of the following compounds (1) to (12):

Azo iron compound (1)
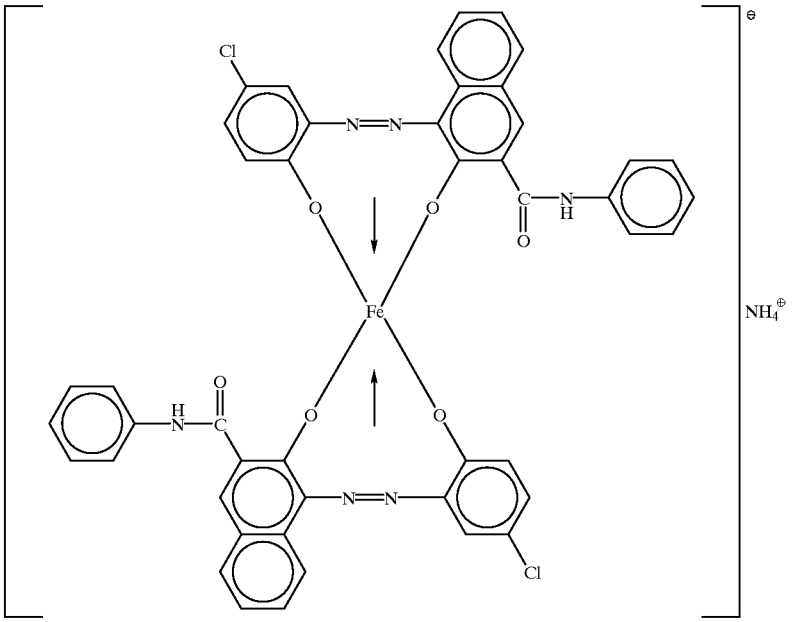
Azo iron compound (2)
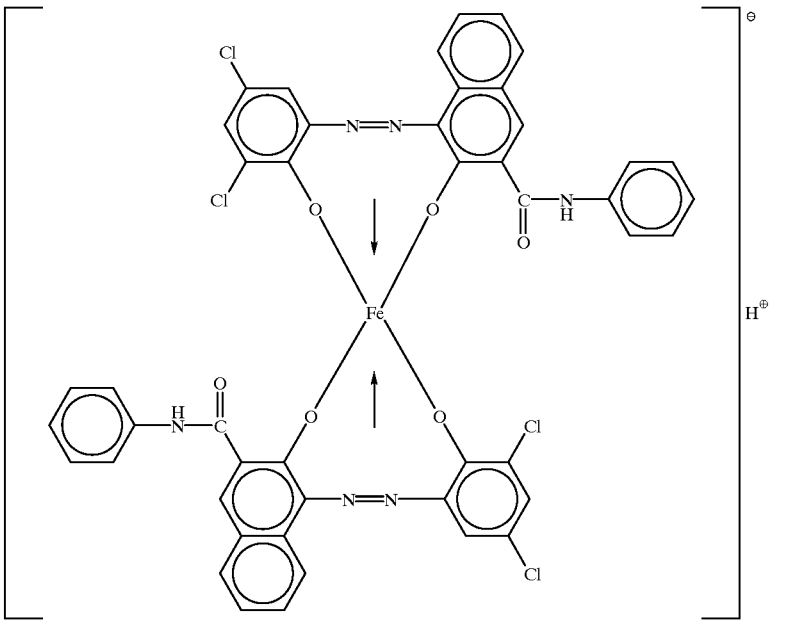

-continued
Azo iron compound (3)
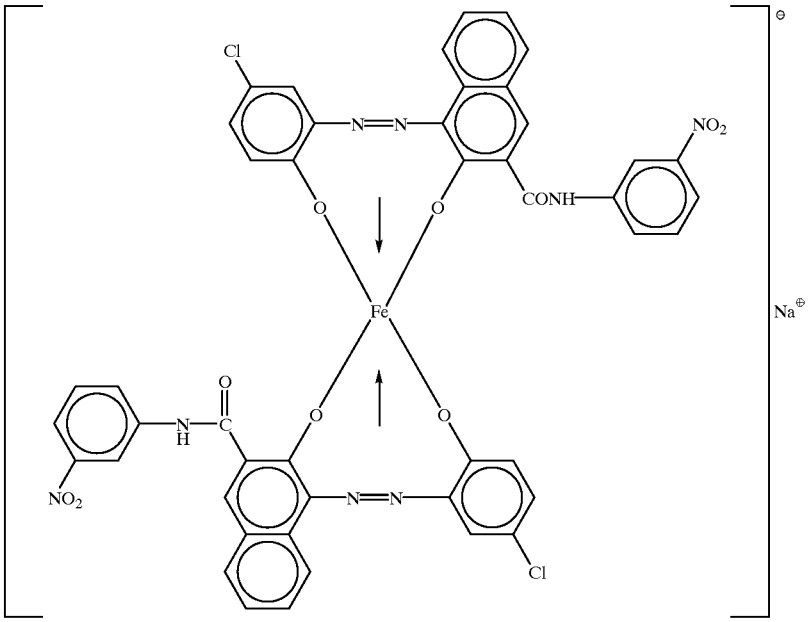
Azo iron compound (4)
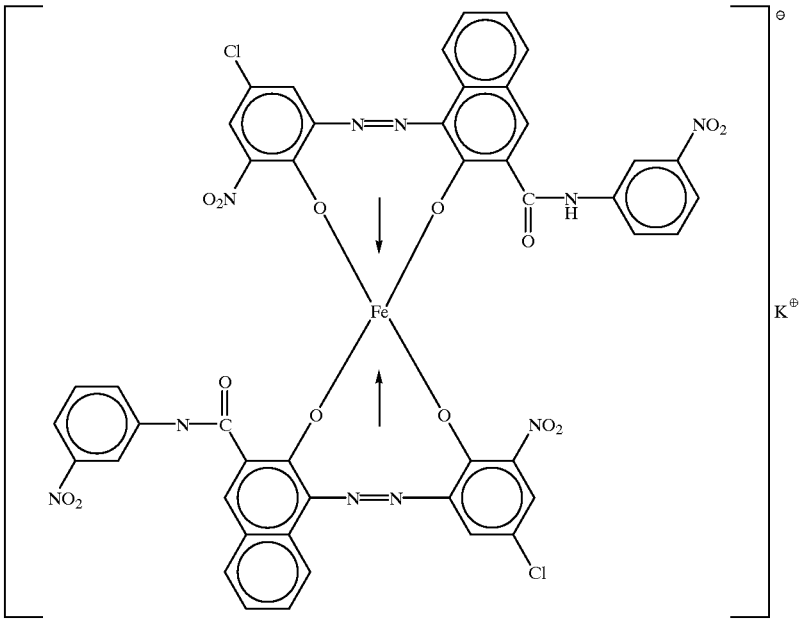

-continued
Azo iron compound (5)
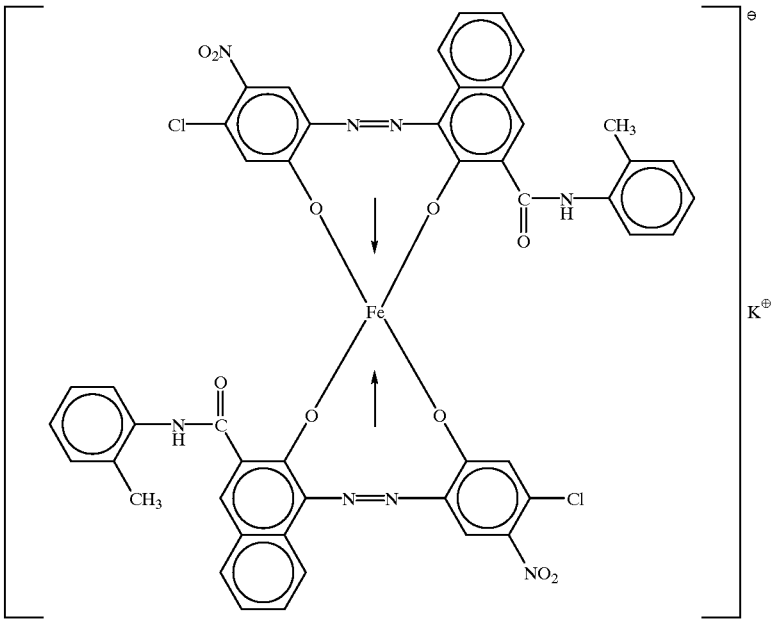
Azo iron compound (6)
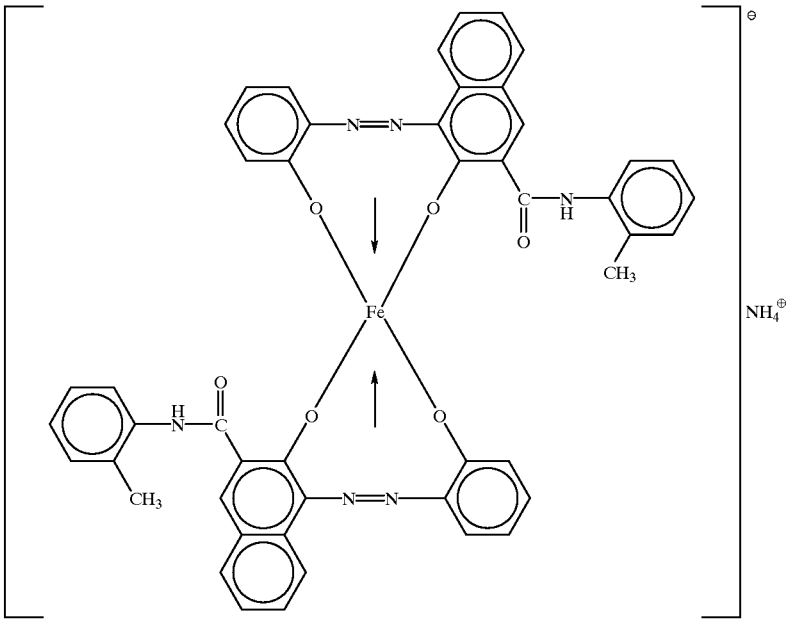

-continued
Azo iron compound (7)
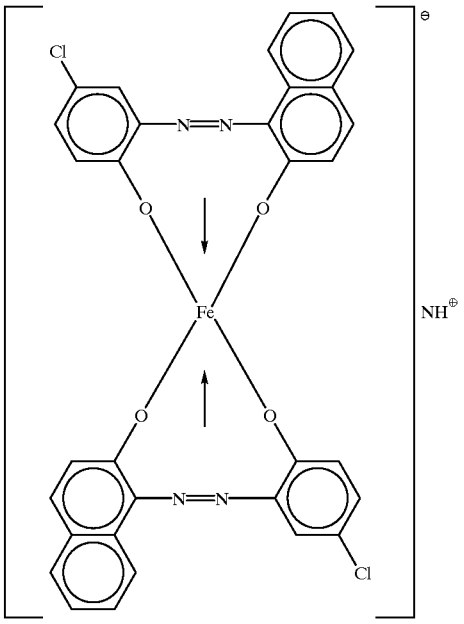
Azo iron compound (8)
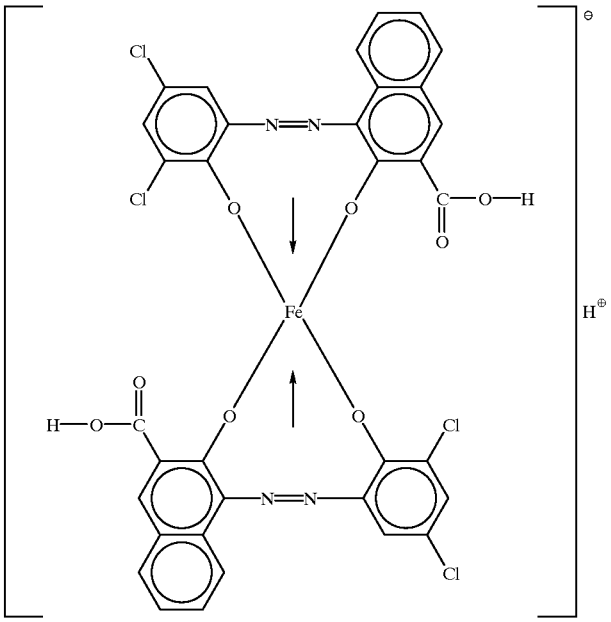

-continued
Azo iron compound (9)
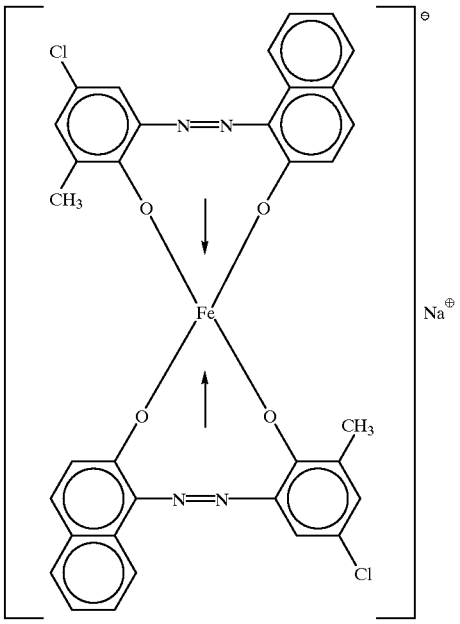
Azo iron compound (10)
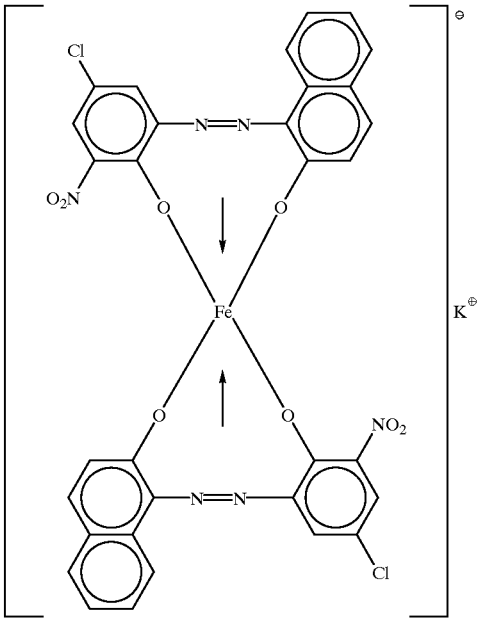

-continued

Azo iron compound (11)

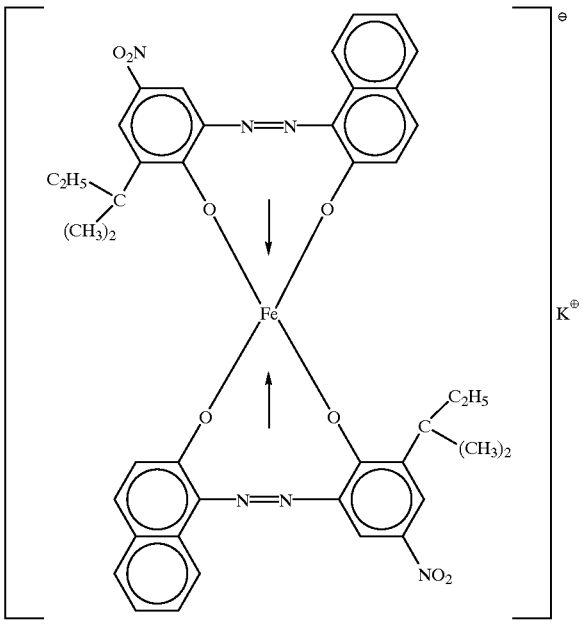

Azo iron compound (12)

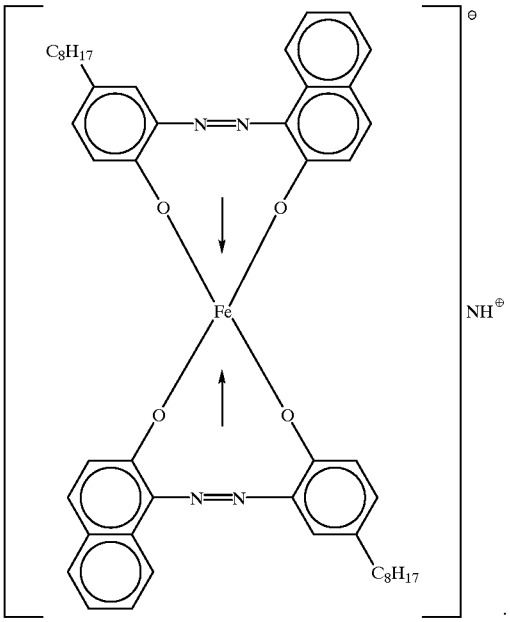

15. The non-magnetic toner according to claim 1, wherein said toner particles have a weight average particle diameter of from 2 μm to 10 μm.

16. The non-magnetic toner according to claim 1, wherein said toner particles have a weight average particle diameter of from 3 μm to 8 μm.

17. The non-magnetic toner according to claim 1, wherein said toner particles have toner particles with diameters of 4 μm or smaller in a content of not more than 25% by number, and toner particles with diameters of 10.1 μm or larger in a content of not more than 2.0% by volume.

18. The non-magnetic toner according to claim 1, wherein said toner particles have toner particles with diameters of 4 μm or smaller in a content of from 5% by number to 25% by number, and toner particles with diameters of 10.1 μm or larger in a content of from 0.1% by volume to 1.3% by volume.

19. The non-magnetic toner according to claim 1, wherein said non-magnetic toner has a saturation magnetization of 20 $Am^2/kg$ or below.

20. The non-magnetic toner according to claim 1, wherein said toner particles further contain a wax component.

21. The non-magnetic toner according to claim 1, wherein said toner particles further contain a polymer having a polar functional group and a weight average molecular weight of at least 5,000.

22. The non-magnetic toner according to claim 1, wherein said toner particles further contain a charge control agent other than said azo iron compound.

23. A process for producing non-magnetic toner particles, comprising the step of;

mixing at least a first polymerizable monomer, a carbon black and an azo iron compound to prepare a dispersion in which the carbon black and the azo iron compound are dispersed in the polymerizable monomer, wherein;

said carbon black has a DPB oil absorption of from 110 ml/100 g to 200 ml/100 g, a specific surface area of 100 $m^2/g$ or below as measured by nitrogen adsorption, a volatile component of 2% or less and an average primary particle diameter of from 25 mμ to 45 mμ; and said azo iron compound comprises a compound represented by the following Formula (1):

Formula (1)

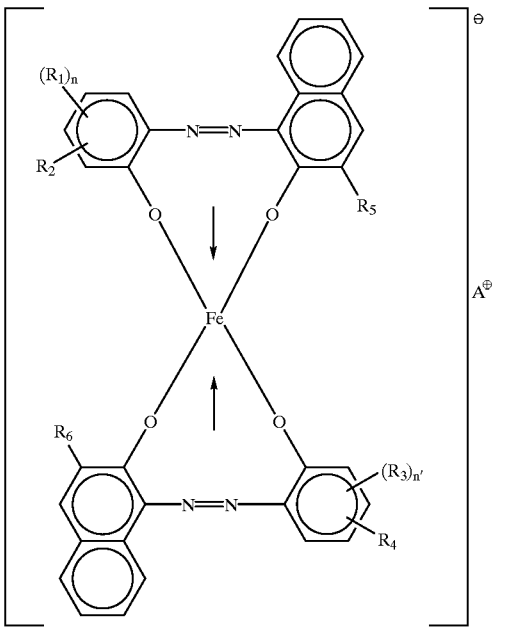

wherein $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ are the same or different; n and n' each represent an integer of 1 to 3; $R_2$ and $R_4$ each represent a member selected from the group consisting of a hydrogen atom and a nitro group, and $R_2$ and $R_4$ are the same or different; $R_5$ and $R_6$ each represent a member selected from the group consisting of a hydrogen atom, a halogen atom, a nitro group, a carboxyl group, an anilide group, an alkyl group having 1 to 18 carbon atoms, an alkenyl group, an aralkyl group, an alkoxyl group, a aryl group, a carboxylate group and a

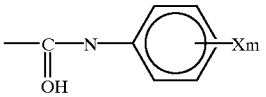

group, where X represents a member selected from the group consisting of a hydrogen atom, a lower alkyl group, a lower alkoxyl group, a nitro group and a halogen atom and m represents an integer of 1 to 3, and $R_5$ and $R_6$ are the same or different; and $A^+$ represents a member selected from the group consisting of a hydrogen ion, a sodium ion, a potassium ion, an ammonium ion and a mixture of any of these;

mixing at least the resultant dispersion and a second polymerizable monomer to prepare a polymerizable monomer composition; and polymerizing the resultant polymerizable monomer composition in an aqueous medium to produce non-magnetic toner particles.

24. The process according to claim 23, wherein the X in Formula (1) represents a member selected from the group consisting of a hydrogen atom, an alkyl group having 1 to 18 carbon atoms, an alkoxyl group having 1 to 18 carbon atoms, a nitro group and a halogen atom.

25. The process according to claim 23, wherein said azo iron compound comprises a compound represented by the following Formula (2):

Formula (2)

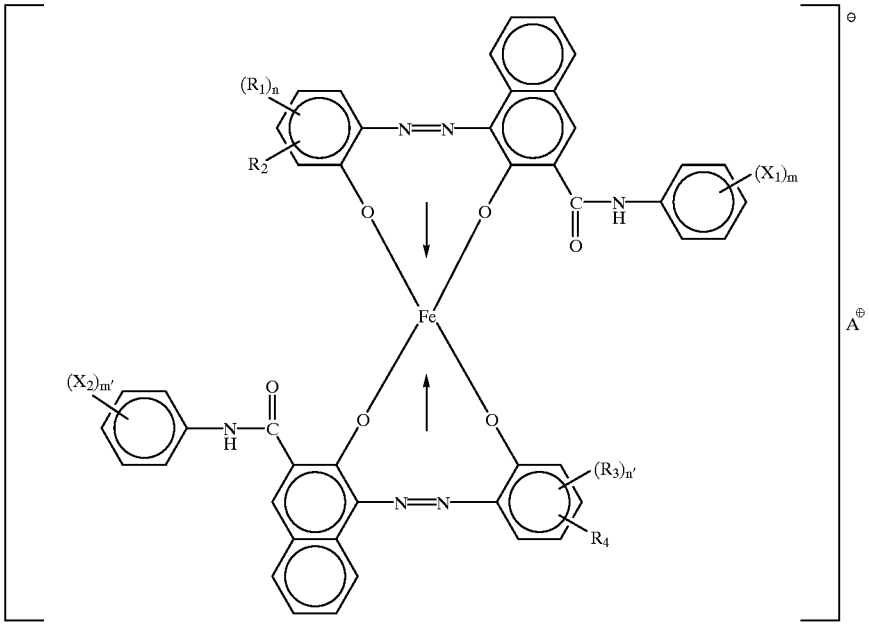

wherein $X_1$ and $X_2$ each represent a member selected from the group consisting of a hydrogen atom, a lower alkyl group, a lower alkoxyl group, a nitro group and a halogen atom, and $X_1$ and $X_2$ are the same or different; m and m' each represent an integer of 1 to 3; $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ are the same or different; n and n' each represent an integer of 1 to 3; $R_2$ and $R_4$ each represent a member selected from the group consisting of a hydrogen atom and a nitro group; and $A^+$ represents a hydrogen ion, a sodium ion, a potassium ion, an ammonium ion and a mixture of any of these.

26. The process according to claim 25, wherein the $X_1$ and $X_2$ in Formula (2) each represents a member selected from the group consisting of a hydrogen atom, an alkyl group having 1 to 18 carbon atoms, an alkoxyl group having 1 to 18 carbon atoms, a nitro group and a halogen atom.

27. The process according to claim 23, wherein said azo iron compound comprises any one of the following compounds (1) to (12):

Azo iron compound (1)
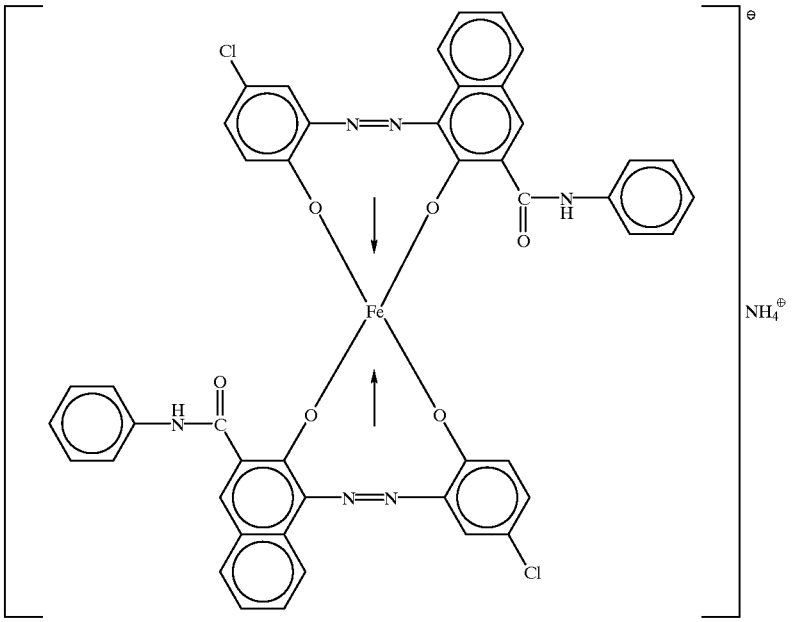
Azo iron compound (2)
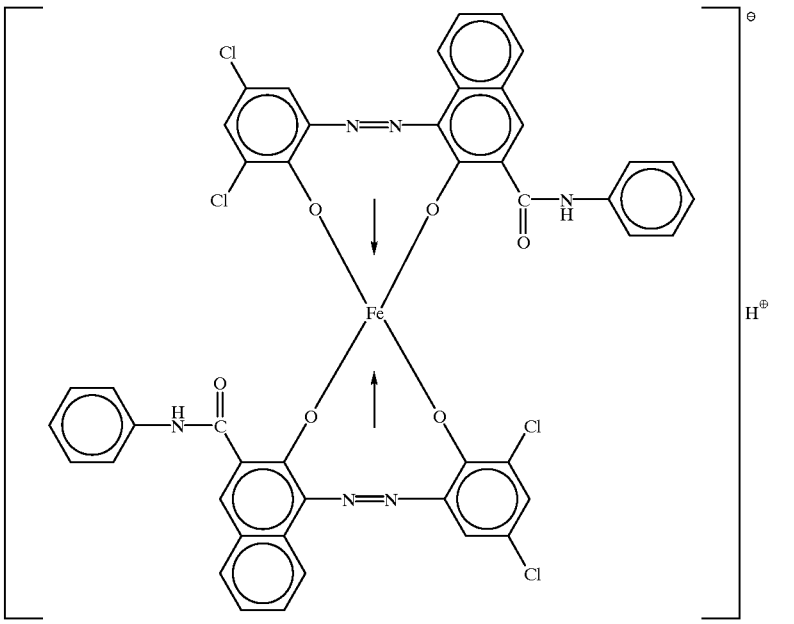

-continued
Azo iron compound (3)
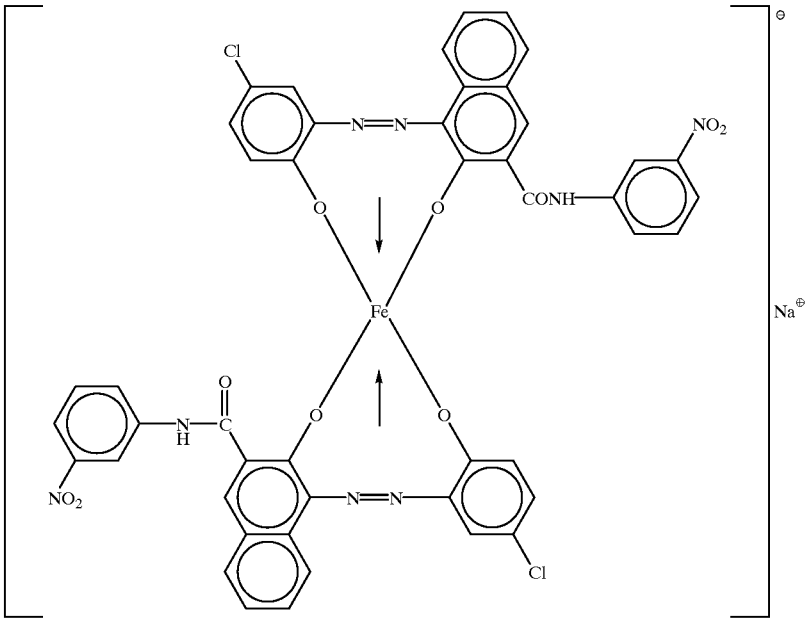
Azo iron compound (4)
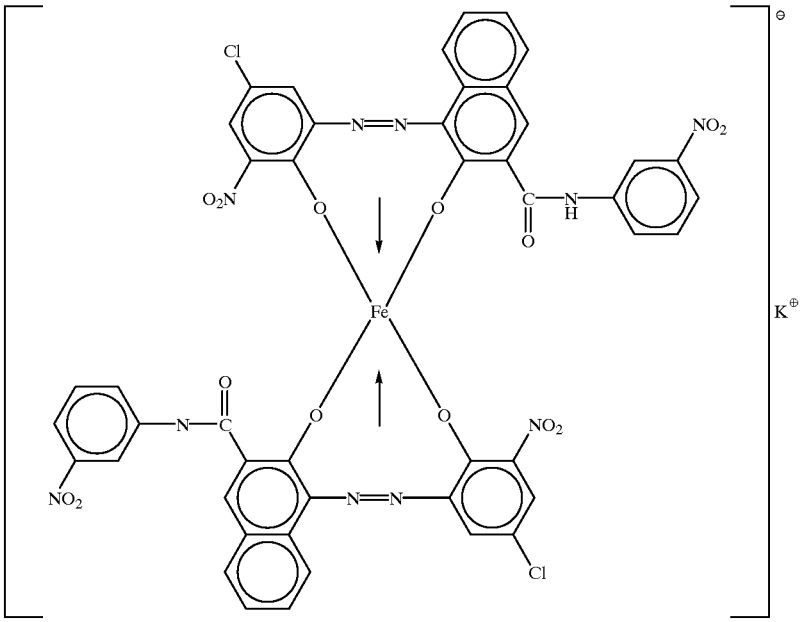

-continued
Azo iron compound (5)
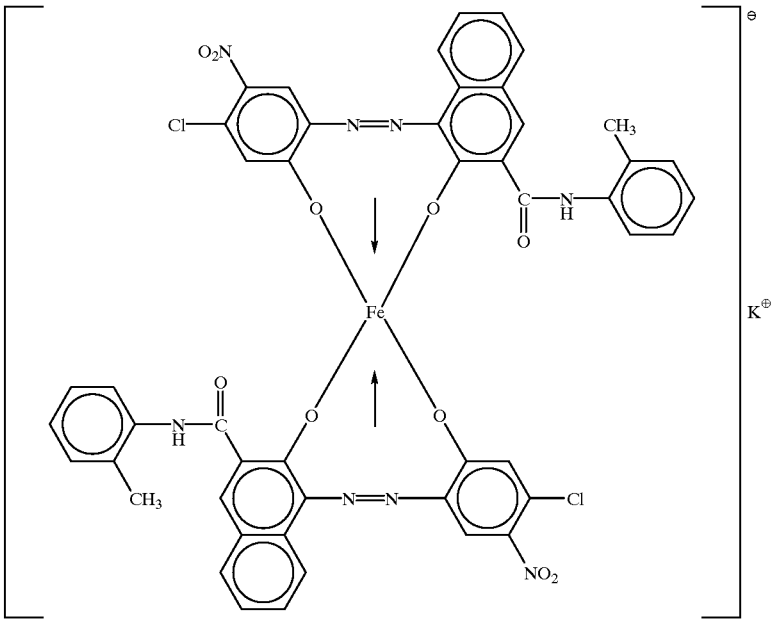
Azo iron compound (6)
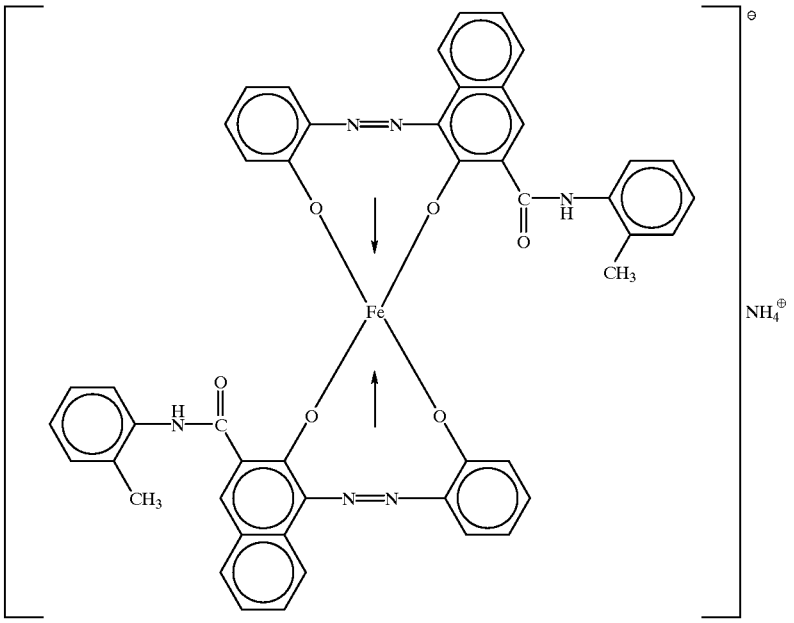

-continued
Azo iron compound (7)
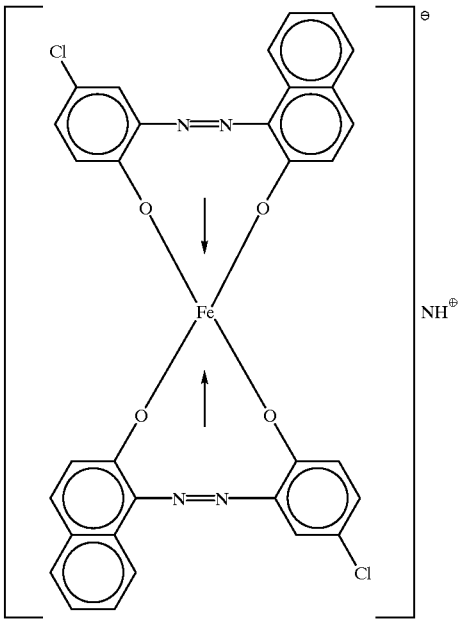
Azo iron compound (8)
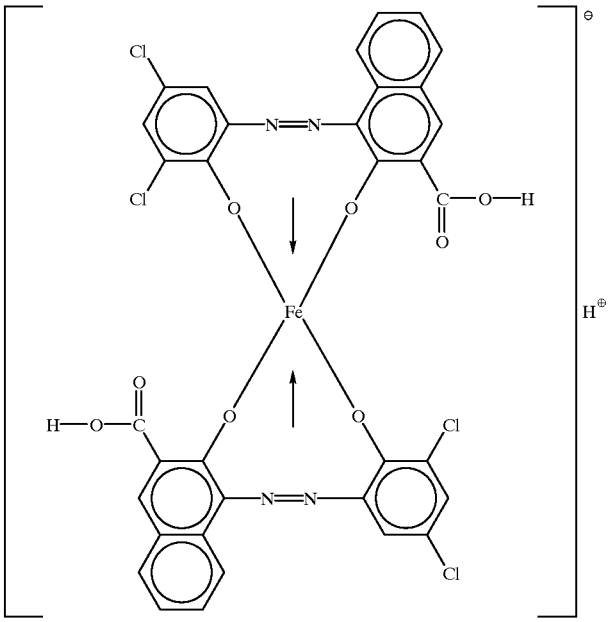

-continued
Azo iron compound (9)
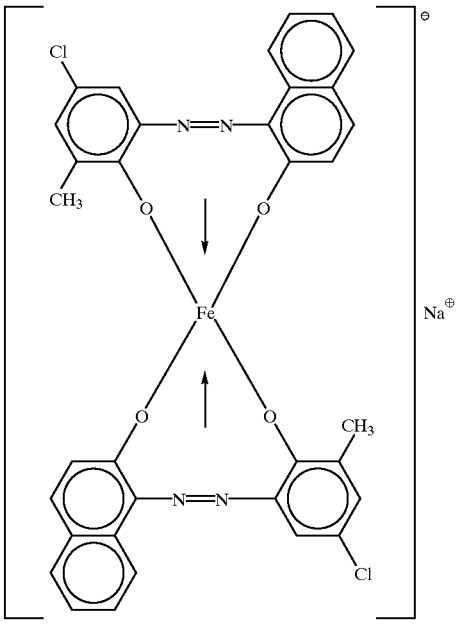
Azo iron compound (10)
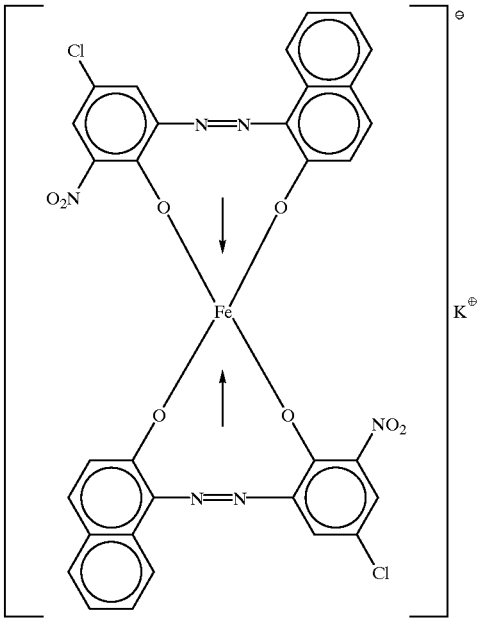

-continued

Azo iron compound (11)

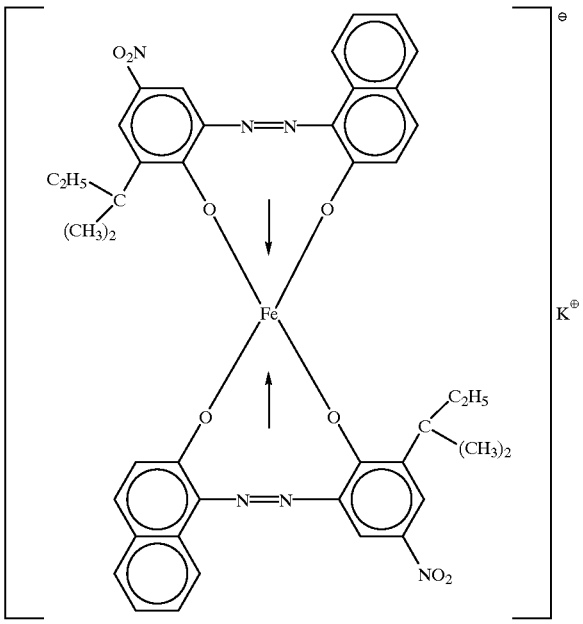

Azo iron compound (12)

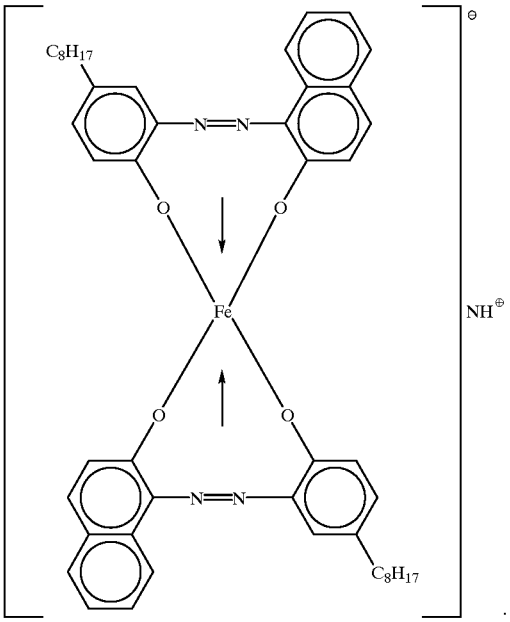

28. The process according to claim 23, wherein said dispersion contains said carbon black in an amount of from 10 parts by weight to 40 parts by weight and said azo iron compound in an amount of from 0.2 part by weight to 5 parts by weight, based on 100 parts by weight of said first polymerizable monomer.

29. The process according to claim 23, wherein said dispersion contains said carbon black in an amount of from 10 parts by weight to 25 parts by weight and said azo iron compound in an amount of from 0.5 part by weight to 3 parts by weight, based on 100 parts by weight of said first polymerizable monomer.

30. The process according to claim 23, wherein said dispersion has a viscosity of from 100cPs to 2,000 cPs.

31. The process according to claim 23, wherein said dispersion has a viscosity of from 150 cPs to 1,600 cPs.

32. The process according to claim 23, wherein said polymerizable monomer composition contains said second polymerizable monomer in an amount of from 20 parts by weight to 100 parts by weight based on 100 parts by weight of said dispersion.

33. The process according to claim 23, wherein said polymerizable monomer composition contains said second polymerizable monomer in an amount of from 30 parts by weight to 70 parts by weight based on 100 parts by weight of said dispersion.

34. The process according to claim 23, wherein said polymerizable monomer composition contains said carbon black in an amount of from 2% by weight to 20% by weight and said azo iron compound in an amount of from 0.1% by weight to 3.0% by weight.

35. The process according to claim 23, wherein said polymerizable monomer composition contains said carbon black in an amount of from 3% by weight to 15% by weight and said azo iron compound in an amount of from 0.2% by weight to 2.0% by weight.

36. The process according to claim 23, wherein said polymerizable monomer composition further contains a wax component.

37. The process according to claim 23, wherein said polymerizable monomer composition further contains a polymer having a polar functional group and a weight-average molecular weight of at least 5,000.

38. The process according to claim 23, wherein said polymerizable monomer composition further contains a charge control agent other than said azo iron compound.

39. The process according to claim 23, wherein said non-magnetic toner particles have a saturation magnetization of 20 $Am^2/kg$ or below.

40. An image forming method comprising the steps of;

developing an electrostatic latent image held on a latent image bearing member, by the use of a non-magnetic toner to form a toner image;

transferring the toner image formed on the latent image bearing member, to a recording medium via or not via an intermediate transfer member; and fixing the toner image transferred onto the recording medium;

wherein;

said non-magnetic toner comprises non-magnetic toner particles produced by polymerizing in an aqueous medium a polymerizable monomer composition containing at least a polymerizable monomer, a carbon black and an azo iron compound, wherein;

said carbon black has a DPB oil absorption of from 110 ml/100 g to 200 ml/100 g, a specific surface area of 100 $m^2/g$ or below as measured by nitrogen adsorption, a volatile component of 2% or less and an average primary particle diameter of from 25 mμ to 45mμ; and said azo iron compound comprises a compound represented by the following Formula (1):

Formula (1)

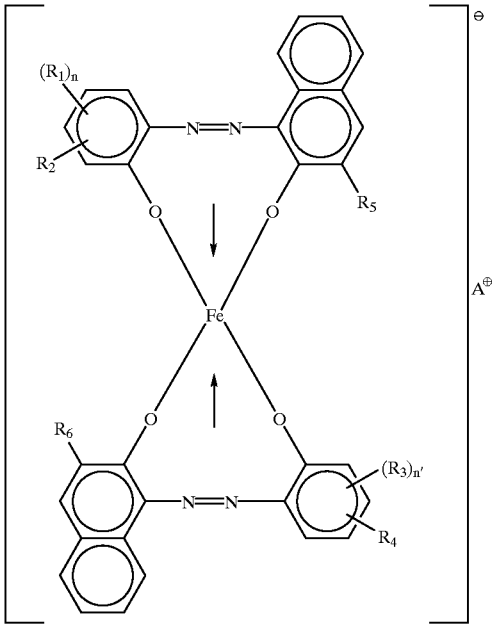

wherein $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ are the same or different; n and n' each represent an integer of 1 to 3; $R_2$ and $R_4$ each represent a member selected from the group consisting of a hydrogen atom and a nitro group, and $R_2$ and $R_4$ are the same or different; $R_5$ and $R_6$ each represent a member selected from the group consisting of a hydrogen atom, a halogen atom, a nitro group, a carboxyl group, an anilide group, an alkyl group having 1 to 18 carbon atoms, an alkenyl group, an aralkyl group, an alkoxyl group, a aryl group, a carboxylate group and a

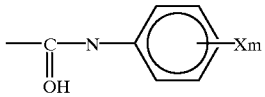

group, where X represents a member selected from the group consisting of a hydrogen atom, a lower alkyl group, a lower alkoxyl group, a nitro group and a halogen atom and m represents an integer of 1 to 3, and $R_5$ and $R_6$ are the same or different; and $A^+$ represents a member selected from the group consisting of a hydrogen ion, a sodium ion, a potassium ion, an ammonium ion and a mixture of any of these.

41. The method according to claim 40, wherein said carbon black has a DBP oil absorption of from 120 ml/100 g to 180 ml/100 g.

42. The method according to claim 40, wherein said carbon black has a specific surface area of from 30 $m^2/g$ to 90 $m^2/g$ as measured by nitrogen adsorption.

43. The method according to claim 40, wherein said carbon black has a volatile component of from 0.1% to 1.8%.

44. The method according to claim 40, wherein said toner particles have the carbon black in a content A (% by weight) and the azo iron compound in a content B (% by weight), and the content A and content B satisfy the following relationship:

$$3 \leqq A/B \leqq 50$$

45. The method according to claim 40, wherein said toner particles have the carbon black in a content A (% by weight) and the azo iron compound in a content B (% by weight), and the content A and content B satisfy the following relationship:

$$3 \leqq A/B \leqq 38$$

46. The method according to claim 40, wherein said toner particles have the carbon black in a content A of from 2% by weight to 20% by weight.

47. The method according to claim 40, wherein said toner particles have the carbon black in a content A of from 3% by weight to 15% by weight.

48. The method according to claim 40, wherein said toner particles have the azo iron compound in a content B of from 0.1% by weight to 3.0% by weight.

49. The method according to claim 40, wherein said toner particles have the azo iron compound in a content B of from 0.3% by weight to 2.0% by weight.

50. The method according to claim 40, wherein the X in Formula (1) represents a member selected from the group consisting of a hydrogen atom, an alkyl group having 1 to 18 carbon atoms, an alkoxyl group having 1 to 18 carbon atoms, a nitro group and a halogen atom.

51. The method according to claim 40, wherein said azo iron compound comprises a compound represented by the following Formula (2):

Formula (2)

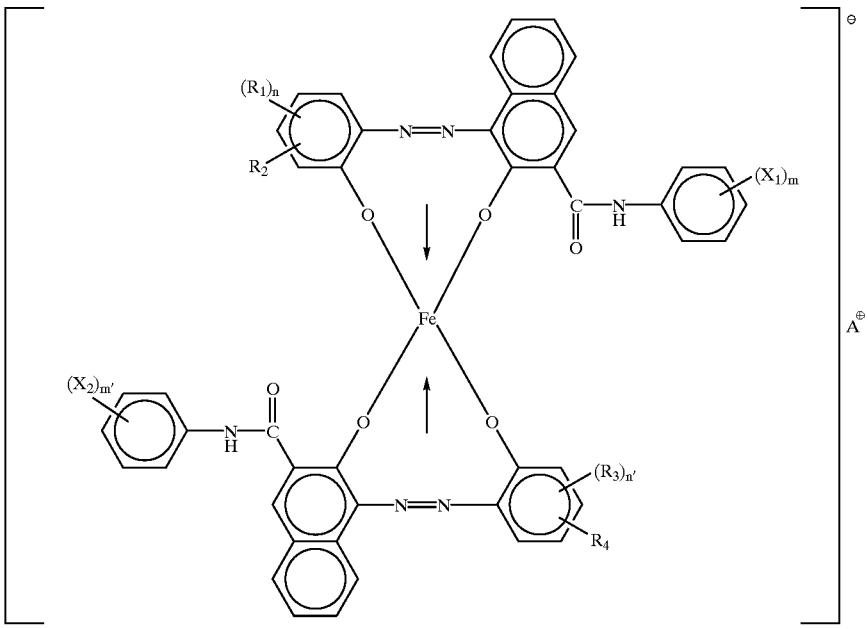

wherein $X_1$ and $X_2$ each represent a member selected from the group consisting of a hydrogen atom, a lower alkyl group, a lower alkoxyl group, a nitro group and a halogen atom, and $X_1$ and $X_2$ are the same or different; m and m' each represent an integer of 1 to 3; $R_1$ and $R_3$ each represent a member selected from the group consisting of a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoylamino group and a halogen atom, and $R_1$ and $R_3$ are the same or different; n and n' each represent an integer of 1 to 3; $R_2$ and $R_4$ each represent a member selected from the group consisting of a hydrogen atom and a nitro group; and $A^+$ represents a hydrogen ion, a sodium ion, a potassium ion, an ammonium ion and a mixture of any of these.

52. The method according to claim 51, wherein the $X_1$ and $X_2$ in Formula (2) each represents a member selected from the group consisting of a hydrogen atom, an alkyl group having 1 to 18 carbon atoms, an alkoxyl group having 1 to 18 carbon atoms, a nitro group and a halogen atom.

53. The method according to claim 40, wherein said azo iron compound comprises any one of the following compounds (1) to (12):
Azo iron compound (1)
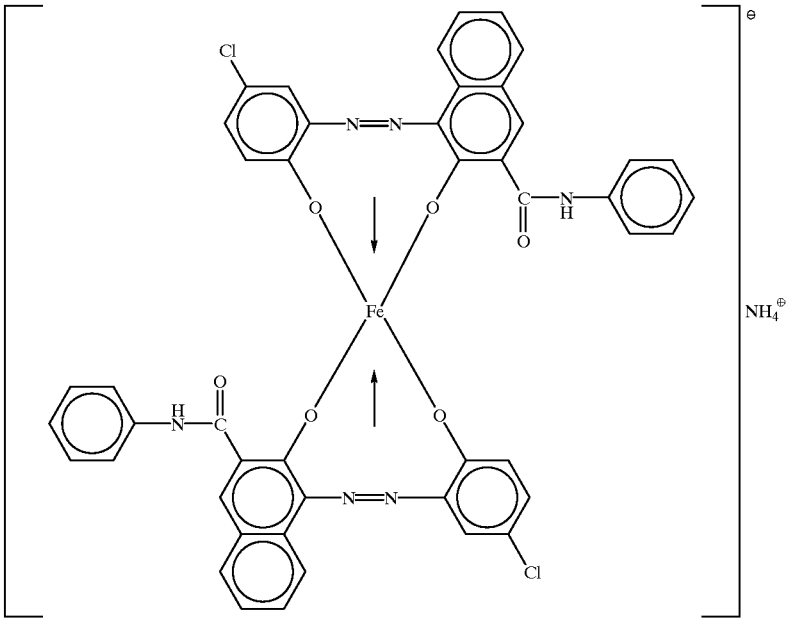
Azo iron compound (2)
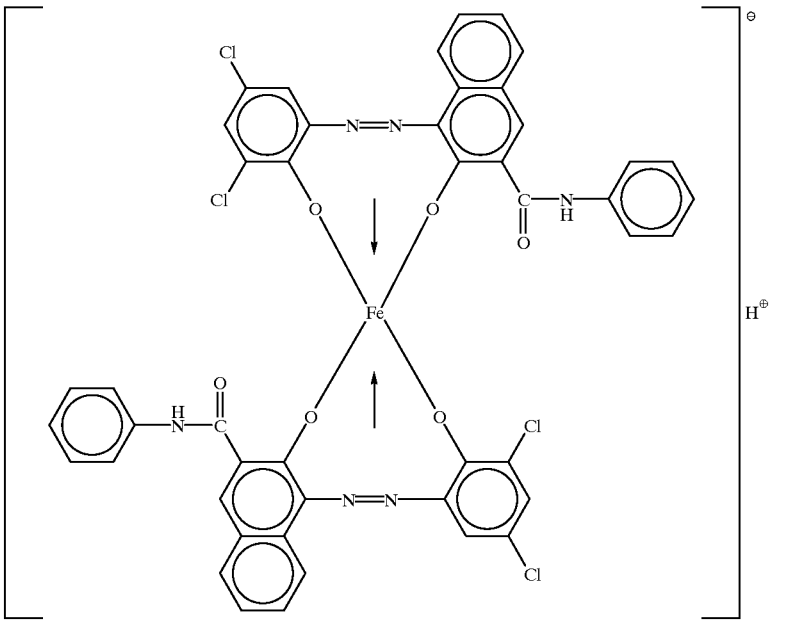

-continued
Azo iron compound (3)
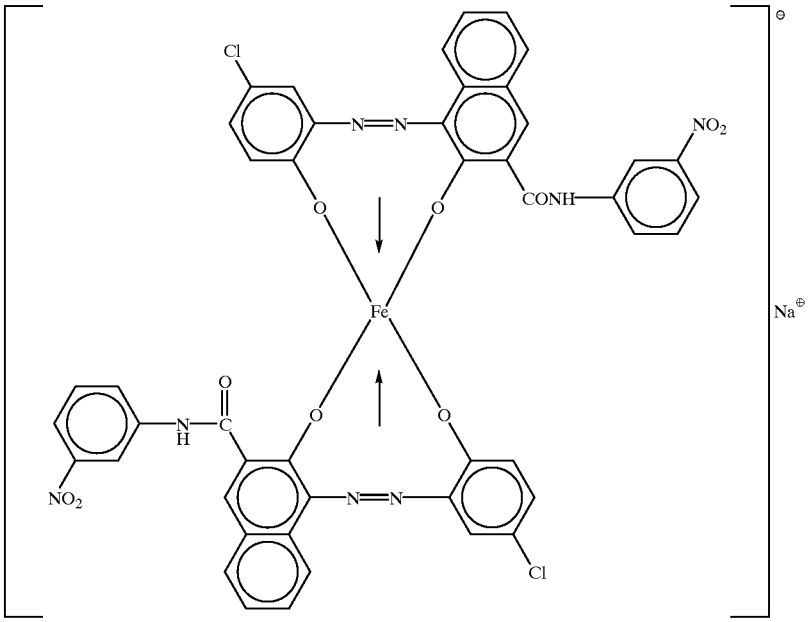
Azo iron compound (4)
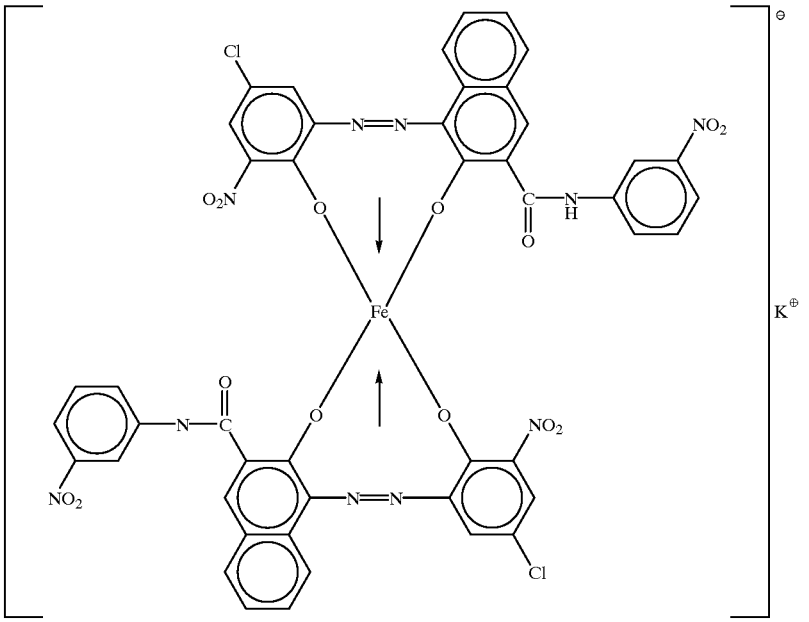

-continued
Azo iron compound (5)
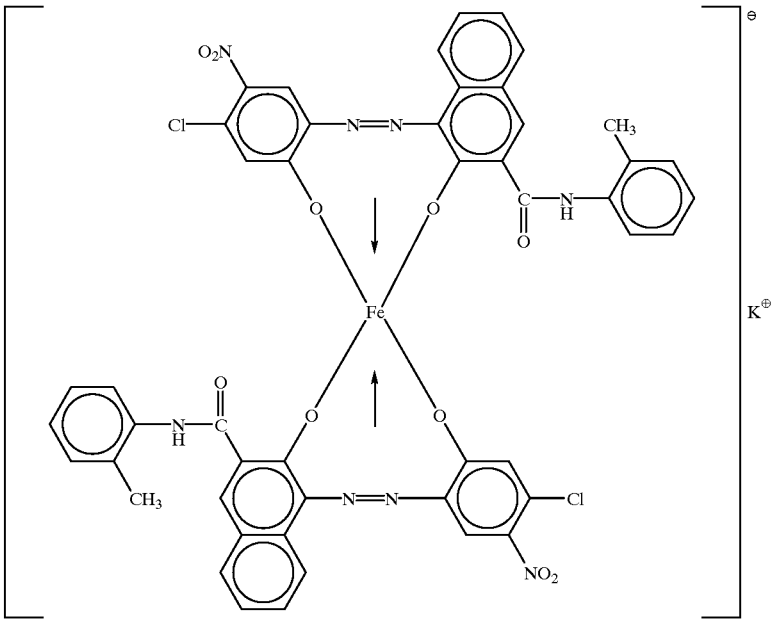
Azo iron compound (6)
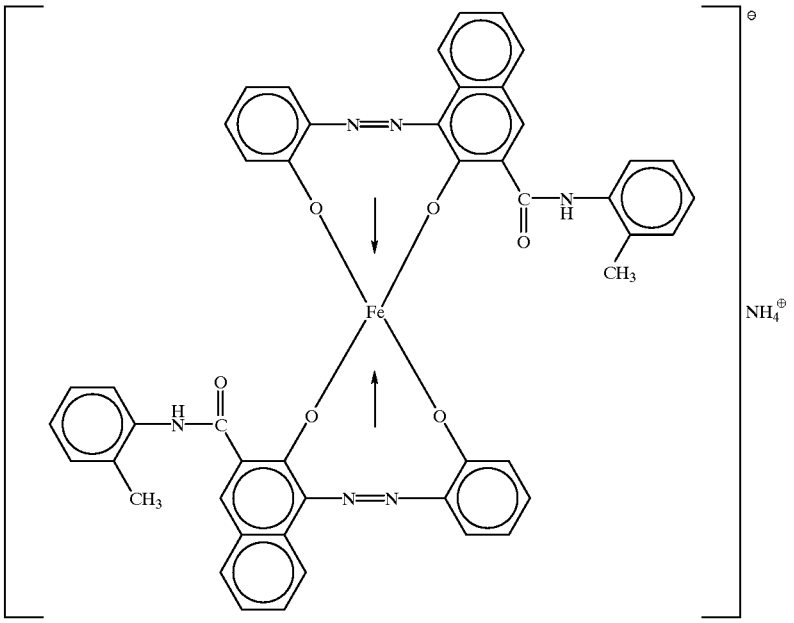

-continued
Azo iron compound (7)
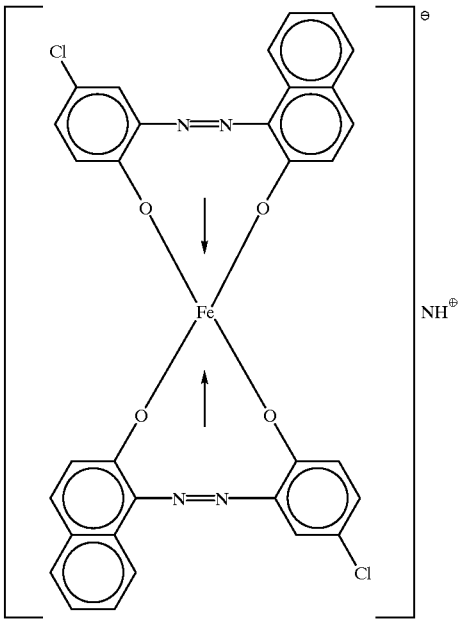
Azo iron compound (8)
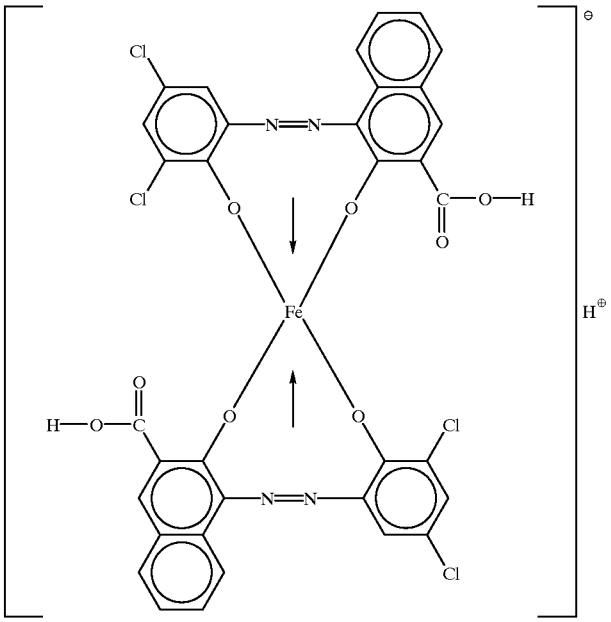

-continued
Azo iron compound (9)
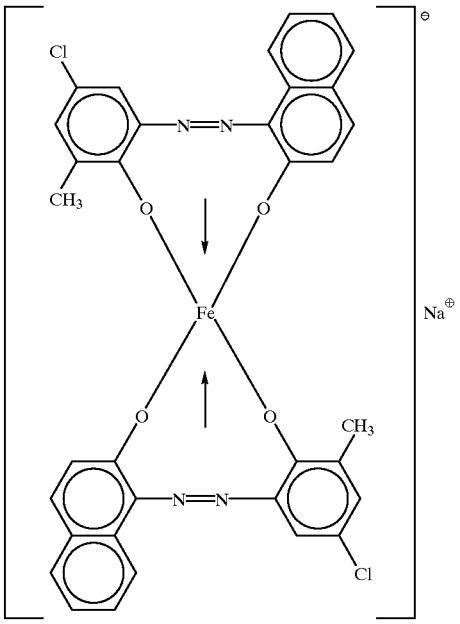
Azo iron compound (10)
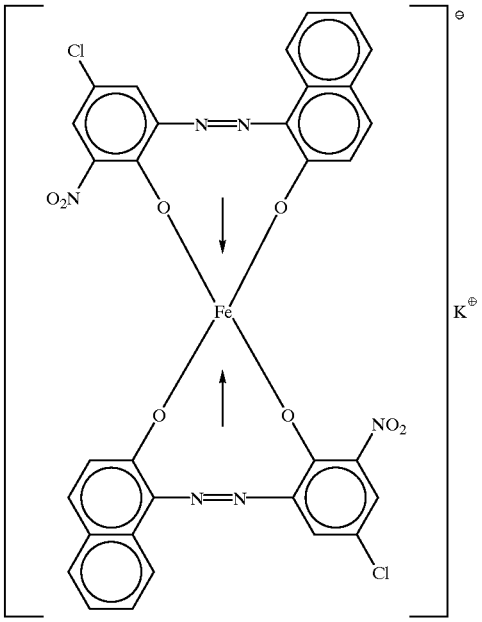

-continued

Azo iron compound (11)

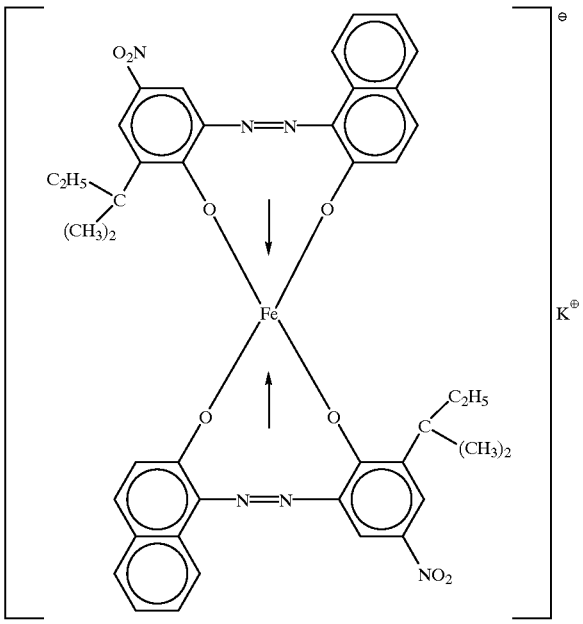

Azo iron compound (12)

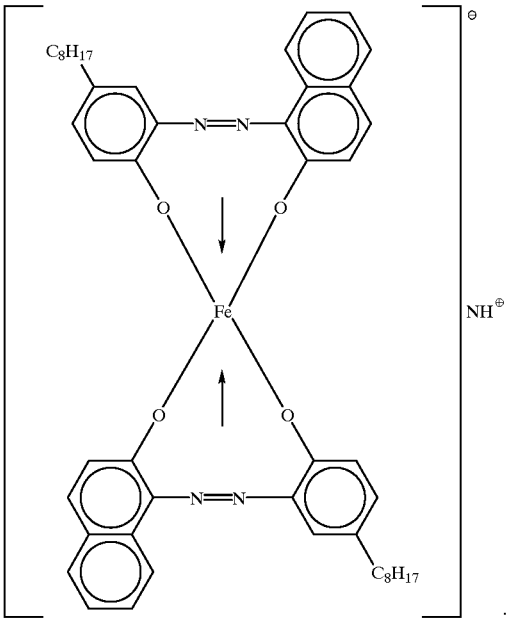

54. The method according to claim 40, wherein said toner particles have a weight average particle diameter of from 2 μm to 10 μm.

55. The method according to claim 40, wherein said toner particles have a weight average particle diameter of from 3 μm to 8 μm.

56. The method according to claim 40, wherein said toner particles have toner particles with diameters of 4 μm or smaller in a content of not more than 25% by number, and toner particles with diameters of 10.1 μm or larger in a content of not more than 2.0% by volume.

57. The method according to claim 40, wherein said toner particles have toner particles with diameters of 4 μm or smaller in a content of from 5% by number to 25% by number, and toner particles with diameters of 10.1 μm or larger in a content of from 0.1% by volume to 1.3% by volume.

58. The method according to claim 40, wherein said non-magnetic toner has a saturation magnetization of 20 $Am^2/kg$ or below.

59. The method according to claim 40, wherein said toner particles further contain a wax component.

60. The method according to claim 40, wherein said toner particles further contain a polymer having a polar functional group and a weight-average molecular weight of at least 5.000.

61. The method according to claim 40, wherein said toner particles further contain a charge control agent other than said azo iron compound.

62. The method according to claim 40, wherein said toner image is a color toner image comprising said non-magnetic toner and a chromatic color toner.

63. The method according to claim 40, wherein said toner image is a full-color toner image comprising said non-magnetic toner, a cyan toner, a magenta toner and a yellow toner.

64. The method according to claim 40, wherein said latent image bearing member comprises an electrophotographic photosensitive member.

* * * * *

UNITED STATES PATENT AND TRADEMARK OFFICE

CERTIFICATE OF CORRECTION

PATENT NO. : 6,030,737
DATED : February 29, 2000
INVENTOR(S) : Toshiyuki Ugai et al.

It is certified that error appears in the above-identified patent and that said Letters Patent is hereby corrected as shown below:

Title page:
Item[30] Foreign Application Priority Data,
"9-304105" should read -- 9-304106 --.
Item [57] ABSTRACT:
Line 6, "DPB" should read -- DBP --;
Line 9, "20" should read -- 25 --;
Line 10, "60" should read -- 45 --.

COLUMN 2:
Line 45, "can not" should read -- cannot --.

COLUMN 3:
Line 1, "further" should read -- a further --;
Line 13, "DPB" should read -- DBP --;
Line 57, "is" should read -- are --;
Line 61, "is" should read -- are --.

COLUMN 4:
Line 11, "is" should read -- are --;
Line 22, "DPB" should read -- DBP --;
Line 28, "Formula (1)." should read -- Formula (1): --;
Line 65, "is" should read -- are --.

COLUMN 5:
Line 1, "is" should read -- are --;
Line 23, "is" should read -- are --;
Line 59, "DPB" should read -- DBP --.

COLUMN 6:
Line 37, "is" should read -- are --;
Line 40, "is" should read -- are --;
Line 58, "is" should read -- are--.

COLUMN 7:
Line 49, "DPB" should read -- DBP --;
Line 52, "20 to 60" should read -- 25 to 45 --.

UNITED STATES PATENT AND TRADEMARK OFFICE

CERTIFICATE OF CORRECTION

PATENT NO. : 6,030,737
DATED : February 29, 2000
INVENTOR(S) : Toshiyuki Ugai et al.

It is certified that error appears in the above-identified patent and that said Letters Patent is hereby corrected as shown below:

COLUMN 8:
Line 32, "20 to 60" should read -- 25 to 45 --.

COLUMN 9:
Line 34, "$3 \leq A/B < 38$" should read -- $3 \leq A/B \leq 38$;
Line 23, "is" should read -- are --;
Line 59, "DPB" should read -- DBP --.

COLUMN 10:
Line 9, "inversely" should read -- inversely have --; and "the" (second occurrence) should be deleted;
Line 58, "is" should read -- are --;
Line 61, "is" should read -- are --.

COLUMN 11:
Line 13, "is" should read -- are --;
Line 57, "is" should read -- are --.

COLUMN 12:
Line 1, "is" should read -- are --;
Line 64, "compounds." should read -- compounds: --.

COLUMN 25:
Line 10, "cross section" should read -- cross-section --;
Line 58, "of (first occurrence) should read -- to --.

COLUMN 26:
Line 6, "of" (first occurrence) should be deleted;
Line 15, "extremely narrow" should read -- narrow extremely --;
Line 16, "i:one" should read -- tone --;
Line 40, "wax" should read -- wax components --.

COLUMN 27:
Line 24, "weigh" should read -- weight --;
Line 64, "a little differ" should read -- differ a little --.

COLUMN 28:
Line 60, "acton" should read -- action --.

UNITED STATES PATENT AND TRADEMARK OFFICE

CERTIFICATE OF CORRECTION

PATENT NO. : 6,030,737
DATED : February 29, 2000
INVENTOR(S) : Toshiyuki Ugai et al.

It is certified that error appears in the above-identified patent and that said Letters Patent is hereby corrected as shown below:

COLUMN 30:
Line 37, "DPB" should read -- DBP --;
Line 47, "cross sections" should read -- cross-sections --.

COLUMN 31:
Line 11, "the" (first occurrence) should be deleted;
Line 21, "cross sections" should read -- cross-sections --;
Line 38, after "3mm;" the line break should be deleted;
Line 39, before "and" the paragraph indent should be deleted;
Line 52, "(IHF)" should read -- (THF) --;
Line 53, "et" should read -- a --;
Line 67, "revolution" should read -- revolutions --.

COLUMN 32:
Line 40, "2a" should read -- 2a. --.

COLUMN 34:
Line 1, "bruch," should read -- brush, --.

COLUMN 35:
Line 43, "held." should read -- held --;
Line 62, "EL" should read -- a --.

COLUMN 37:
Line 22, "is" (second occurrence) should be deleted.

COLUMN 39:
Line 28, "stainless" should read -- stainless steel --;
Line 51, "image" should be deleted.

COLUMN 40:
Line 22, "a" (first occurrence) should read -- an -- .

COLUMN 41
Line 47, "Preparation" should read -- (Preparation --.

UNITED STATES PATENT AND TRADEMARK OFFICE

CERTIFICATE OF CORRECTION

PATENT NO. : 6,030,737
DATED : February 29, 2000
INVENTOR(S) : Toshiyuki Ugai et al.

It is certified that error appears in the above-identified patent and that said Letters Patent is hereby corrected as shown below:

COLUMN 47:
Line 4, "DPB" should read -- DBP --;
Line 50, "are" should be deleted.

COLUMN 48:
Line 11, "DPB" should read -- DBP --.

COLUMN 63:
Line 7, "DPB" should read -- DBP --.

COLUMN 79:
Line 46, "medium;" should read -- medium, --; and the line break should be deleted;
Line 56, "DPB" should read -- DBP --.

COLUMN 94:
Line 64, "5.000." should read -- 5,000. --.

Signed and Sealed this

Fourth Day of September, 2001

Nicholas P. Godici

*Attest:*

*Attesting Officer*

NICHOLAS P. GODICI
*Acting Director of the United States Patent and Trademark Office*